United States Patent [19]

Smith

[11] Patent Number: 4,492,061

[45] Date of Patent: Jan. 8, 1985

[54] CONTROL SYSTEM FOR GRINDING APPARATUS

[75] Inventor: Roderick L. Smith, Rockford, Ill.

[73] Assignee: Energy-Adaptive Grinding, Inc., Rockford, Ill.

[21] Appl. No.: 355,303

[22] Filed: Mar. 5, 1982

[51] Int. Cl.[3] ..... B24B 1/00

[52] U.S. Cl. ..... 51/325; 51/165.87

[58] Field of Search ..... 51/165.19, 165.77, 165.87, 51/165.88, 325, 281 R

[56] References Cited

U.S. PATENT DOCUMENTS

| | | | |
|---|---|---|---|
| 1,666,237 | 4/1928 | Fuller | 51/165.87 |
| 2,545,730 | 3/1951 | Fouquet | 51/165.87 |
| 3,736,704 | 6/1973 | Robillard | 51/165.87 |
| 3,913,277 | 10/1975 | Hahn | 51/165.87 |
| 4,053,289 | 10/1977 | Tatsumi | 51/165.88 |
| 4,071,980 | 2/1978 | Kubo | 51/165.87 |
| 4,118,900 | 10/1978 | Moritomo | 51/165.87 |
| 4,163,346 | 8/1979 | Matson | 51/165.87 |

*Primary Examiner*—Harold D. Whitehead

*Attorney, Agent, or Firm*—Leydig, Voit, Osann, Mayer & Holt, Ltd.

[57] ABSTRACT

A grinding system is controlled by (1) determining the exact nature of a power function relationship between (a) the rate at which material is removed from one of the surfaces at a rubbing interface and (b) the feed rate at which the rubbing surfaces are fed into each other, for a particular grinding operation, i.e., a particular grinding wheel and other specified conditions affecting the rate of material removal at the rubbing interface; and (2) controlling, measuring or setting the material removal rate or the feed rate in such a grinding operation in accordance with said power function relationship.

27 Claims, 27 Drawing Figures

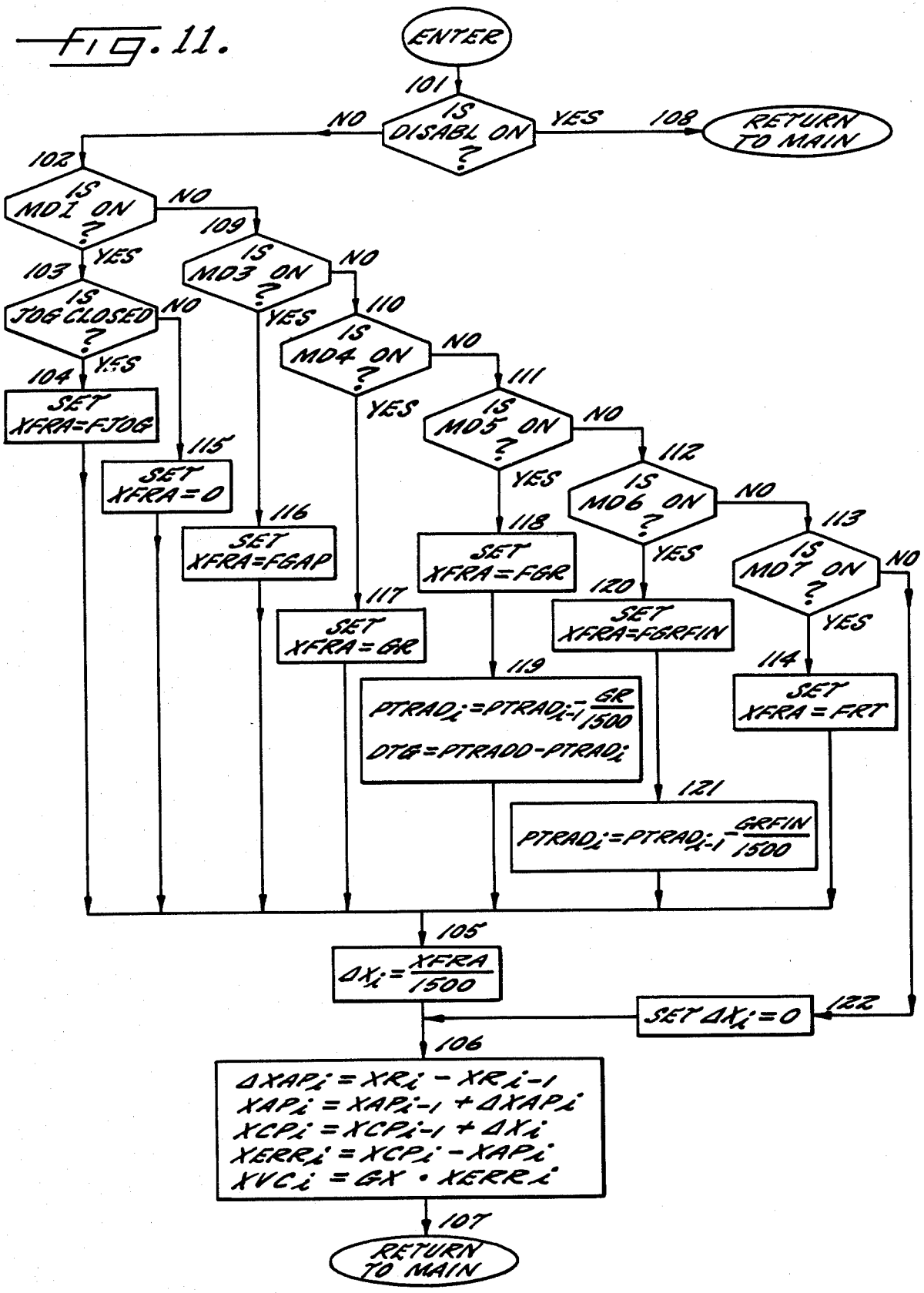
Fig. 11.
ENTER
101
IS DISABL ON ?
NO
YES
108
RETURN TO MAIN
102
IS MD1 ON ?
NO
YES
109
IS MD3 ON ?
NO
YES
103
IS JOG CLOSED ?
NO
YES
110
IS MD4 ON ?
NO
YES
104
SET XFRA=FJOG
111
IS MD5 ON ?
NO
YES
115
SET XFRA=0
112
IS MD6 ON ?
NO
YES
116
SET XFRA=FGAP
118
SET XFRA=FGR
113
IS MD7 ON ?
NO
YES
117
SET XFRA=GR
120
SET XFRA=FGRFIN
114
SET XFRA=FRT
119
PTRAD_i=PTRAD_i-1 - GR/1500
DTG=PTRADD-PTRAD_i
121
PTRAD_i=PTRAD_i-1 - GRFIN/1500
105
ΔX_i = XFRA/1500
SET ΔX_i=0
122
106
ΔXAP_i = XR_i - XR_i-1
XAP_i = XAP_i-1 + ΔXAP_i
XCP_i = XCP_i-1 + ΔX_i
XERR_i = XCP_i - XAP_i
XVC_i = GX · XERR_i
107
RETURN TO MAIN

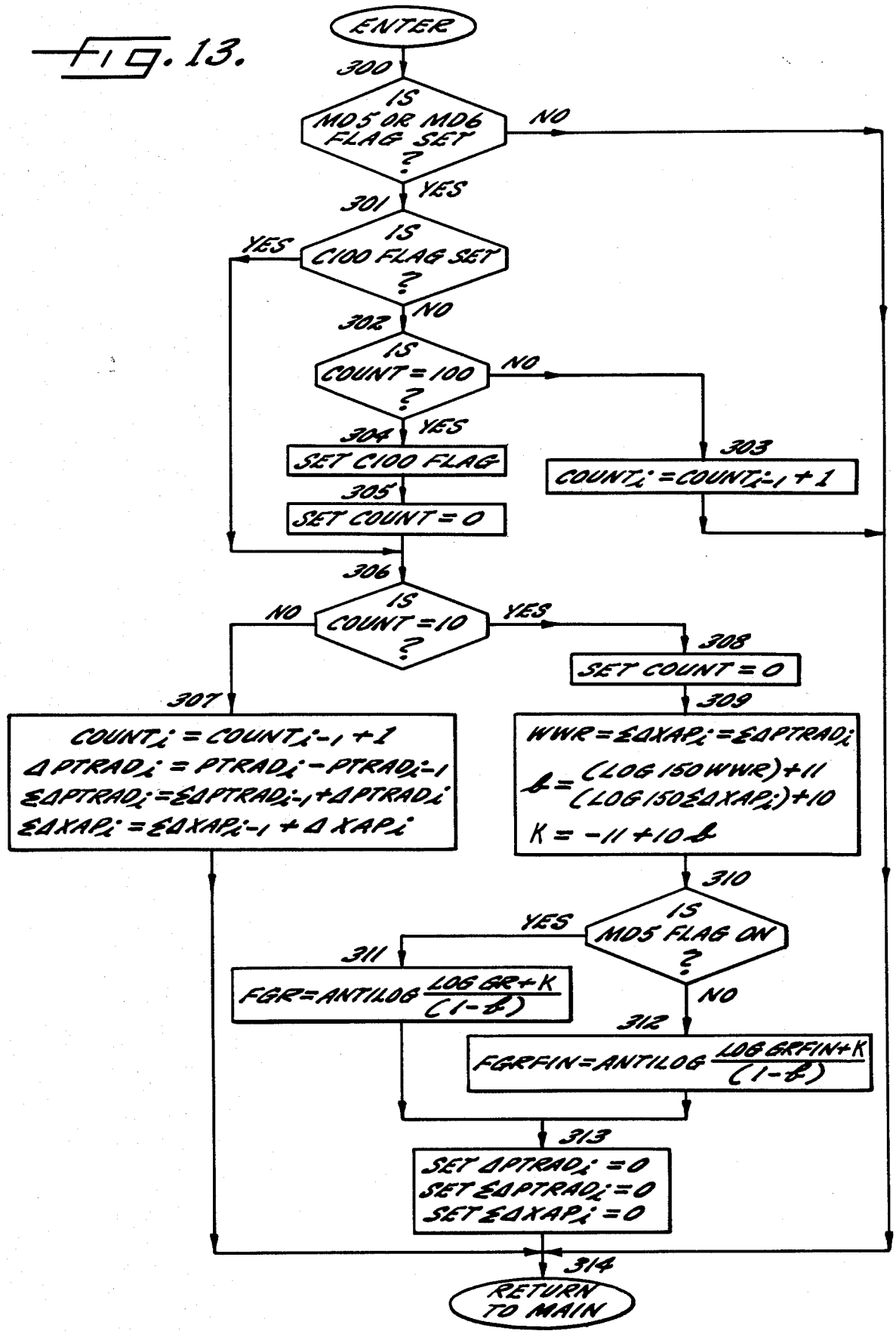
FIG. 13.
ENTER
300
IS MD5 OR MD6 FLAG SET ?
NO
YES
301
IS C100 FLAG SET ?
YES
NO
302
IS COUNT = 100 ?
NO
YES
304
SET C100 FLAG
303
COUNT_i = COUNT_i-1 + 1
305
SET COUNT = 0
306
IS COUNT = 10 ?
NO
YES
308
SET COUNT = 0
307
COUNT_i = COUNT_i-1 + 1
ΔPTRAD_i = PTRAD_i - PTRAD_i-1
ΣΔPTRAD_i = ΣΔPTRAD_i-1 + ΔPTRAD_i
ΣΔXAP_i = ΣΔXAP_i-1 + ΔXAP_i
309
WWR = ΣΔXAP_i = ΣΔPTRAD_i
b = (LOG 150 WWR) + 11 / (LOG 150 ΣΔXAP_i) + 10
K = -11 + 10b
310
IS MD5 FLAG ON ?
YES
NO
311
FGR = ANTILOG (LOG GR + K) / (1 - b)
312
FGRFIN = ANTILOG (LOG GRFIN + K) / (1 - b)
313
SET ΔPTRAD_i = 0
SET ΣΔPTRAD_i = 0
SET ΣΔXAP_i = 0
314
RETURN TO MAIN ωp
ωw
ωte
39
TA
36
61
Vpm
Vwm
Vtm
PM
WM
TM
40
41
20
TORw
35
TORte
60
24
20a
50
Rp
G
50a
24a
50b
51
Vtfm
TFM
UR
58
42
24b
20b
TS
22
WS
Vwfm
26
WFM
XR
29
80
80a
80b
PTRAD
KNORAD
FJOG
WWRT
MACHREF
FGAP
GU
XSO
GRI
GWT
RETRP
GRZ
STEO
DDI
GRFIN
GT
DDZ
FRT
PTVD
PTRADD
GX
GPV
PTREF
RADT
WHVD
GP
GAP
GWV
GI
SGV
GD
CV
XAP
XR
UR
PTV
WHV
TRV
GS
TORTE
TORW
ADC
206
207
208
209
210
211
212
213
XVC
UVC
VPM
VWM
VTM
DAC
201
202
203
204
205
Vwfm
Vtfm
Vpm
Vwm
Vtm

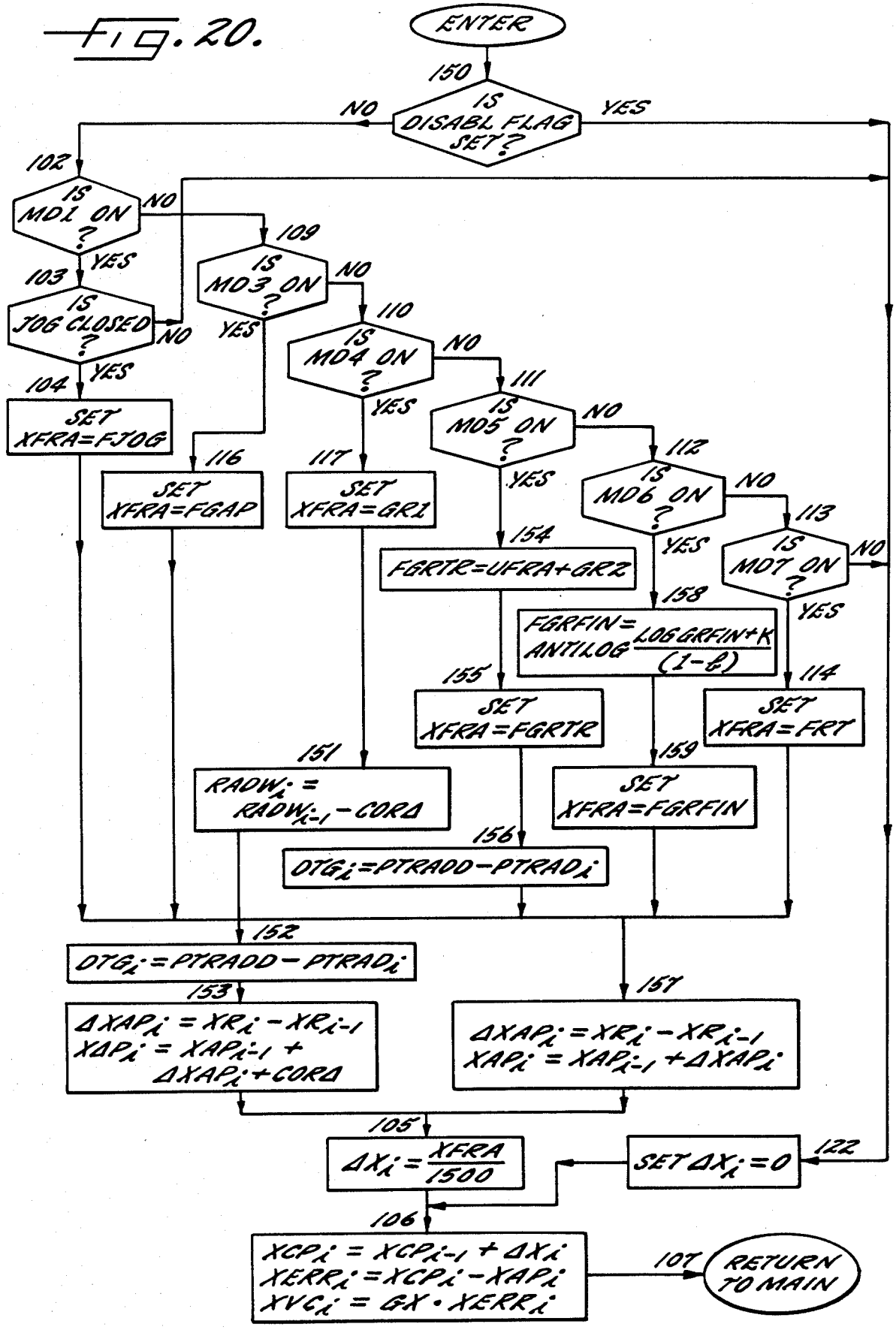
FIG. 20.
ENTER
150
IS DISABL FLAG SET?
NO
YES
102
IS MD1 ON ?
NO
YES
103
IS JOG CLOSED ?
NO
YES
104
SET XFRA=FJOG
109
IS MD3 ON ?
NO
YES
116
SET XFRA=FGAP
110
IS MD4 ON ?
NO
YES
117
SET XFRA=GR1
111
IS MD5 ON ?
NO
YES
154
FGRTR=UFRA+GR2
112
IS MD6 ON ?
NO
YES
158
FGRFIN= ANTILOG LOGGRFIN+K / (1-ℓ)
113
IS MD7 ON ?
NO
YES
155
SET XFRA=FGRTR
114
SET XFRA=FRT
151
RADW_i = RADW_i-1 - CORΔ
159
SET XFRA=FGRFIN
156
DTG_i=PTRADD-PTRAD_i
152
DTG_i=PTRADD-PTRAD_i
153
ΔXAP_i = XR_i - XR_i-1
XAP_i = XAP_i-1 + ΔXAP_i+CORΔ
157
ΔXAP_i = XR_i - XR_i-1
XAP_i = XAP_i-1 + ΔXAP_i
105
ΔX_i = XFRA / 1500
122
SET ΔX_i = 0
106
XCP_i = XCP_i-1 + ΔX_i
XERR_i = XCP_i - XAP_i
XVC_i = GX · XERR_i
107
RETURN TO MAIN

CONTROL SYSTEM FOR GRINDING APPARATUS

FIELD OF INVENTION AND OBJECTS

The present invention relates to grinding systems for grinding a wide variety of different kinds of workpieces with rotationally driven grinding wheels which wear down during grinding. This invention specifically relates to methods and apparatus for controlling such grinding operations to improve grinding accuracy, efficiency and/or reliability, and/or to reduce grinding time or cost.

One of the problems in controlling a grinding operation is the uncertainty of the rate at which the grinding wheel is wearing away under certain grinding conditions. If the grinding machine has a workpiece gage and only a single wheel contact area where the grinding wheel is being worn down, the wheel wear rate can be ascertained by simply determining the difference between the wheel feed rate and the rate at which the workpiece is actually being ground. There are, however, a number of situations where determination of the wheel wear rate is not so simple. One such situation is presented by a system which trues or conditions the grinding wheel simultaneously with the grinding of a workpiece, as described in my co-pending U.S. patent application Ser. No. 249,192, filed Mar. 30, 1981 for "Grinding Control Methods and Apparatus".

In simultaneous truing and grinding, it is difficult to determine how much of the total wheel wear is occurring at the grinding interface and how much is occurring at the truing interface. Without this breakdown of the total wheel wear rate, it is difficult at best to feed the truing roll into the grinding wheel at a rate which will remove material from the wheel at a desired rate at the truing interface. The *total* wheel wear rate is always equal to the truing roll feed rate. Only part of that total wheel wear is effected by the truing roll, however, and it is difficult to quantify that part.

Consequently, the results that are attainable only by truing the wheel at a known and controlled rate, simultaneously with grinding, are difficult to achieve in actual practice. For example, my aforementioned copending application describes the significant advantages that can be realized by controlling the truing operation to maintain a desired "STE"—Specific Truing Energy. To accurately control the STE during simultaneous truing and grinding, however, the wheel removal rate *at the truing interface* must be accurately known. In the absence of such information, the best that can be done is to use the total wheel wear rate as an approximation of wheel wear rate at the truing interface.

Another situation in which uncertainty about the grinding wheel wear rate can present a problem is in servo control of the wheel feed rate to maintain a desired grinding rate. When starting up such a system, or whenever it is necessary to change the commanded wheel feed rate, the value chosen for the feed rate must provide not only for the desired rate of material removal from the workpiece (grinding rate) but also the unknown rate of wear of the wheel. Because of the latter factor, it is difficult to choose exactly the right feed rate value, as a result of which grinding is not carried out at the desired rate unless the servo system is capable of accurately adjusting the feed rate to compensate for wheel wear. Such servo systems tend to be both complex and costly.

One of the primary objects of the present invention is to provide an improved method of determining the rate of wear of a grinding wheel during a grinding operation. Thus, one particular object of the invention is to provide an improved method of accurately compensating for the wear of a grinding wheel during a grinding operation, e.g., by continuously and accurately adjusting the feed rate of the grinding wheel to compensate for wheel wear.

Another important object of the present invention is to provide a method of determining the rate of wheel wear at each of multiple and simultaneous contact areas around the circumference of a grinding wheel. In this connection, one particular object of the invention is to provide an improved method of simultaneous truing and grinding in which the rates of removal of material from the grinding wheel at the grinding and truing interfaces are accurately determined and used to provide improved control of both the grinding and the truing rate.

It is a further object of the invention to provide a grinding system which continuously "gages" the radius of the workpiece being ground, without the use of a gage that senses the actual radius of the workpiece. A related object is to provide such a grinding system which continually "gages" the workpiece radius, in an indirect but accurate manner, from the feed rate of the grinding wheel.

Still another object of the invention is to provide a grinding system which improves the accuracy with which a workpiece can be ground to a desired dimension and surface finish, regardless of whether the grinding machine is equipped with a gage for sensing the actual size of the workpiece.

Yet another object of the invention is to provide a method of predetermining the grinding wheel wear rate as a function of the wheel feed rate in any given grinding operation, so that the wheel wear rate can be ascertained from the feed rate throughout the grinding operation.

These and other objects and advantages of the invention will become apparent as the following detailed description proceeds, taken in conjunction with the accompanying drawings.

IDENTIFICATION OF DRAWING FIGURES

Figures 1, 1A:
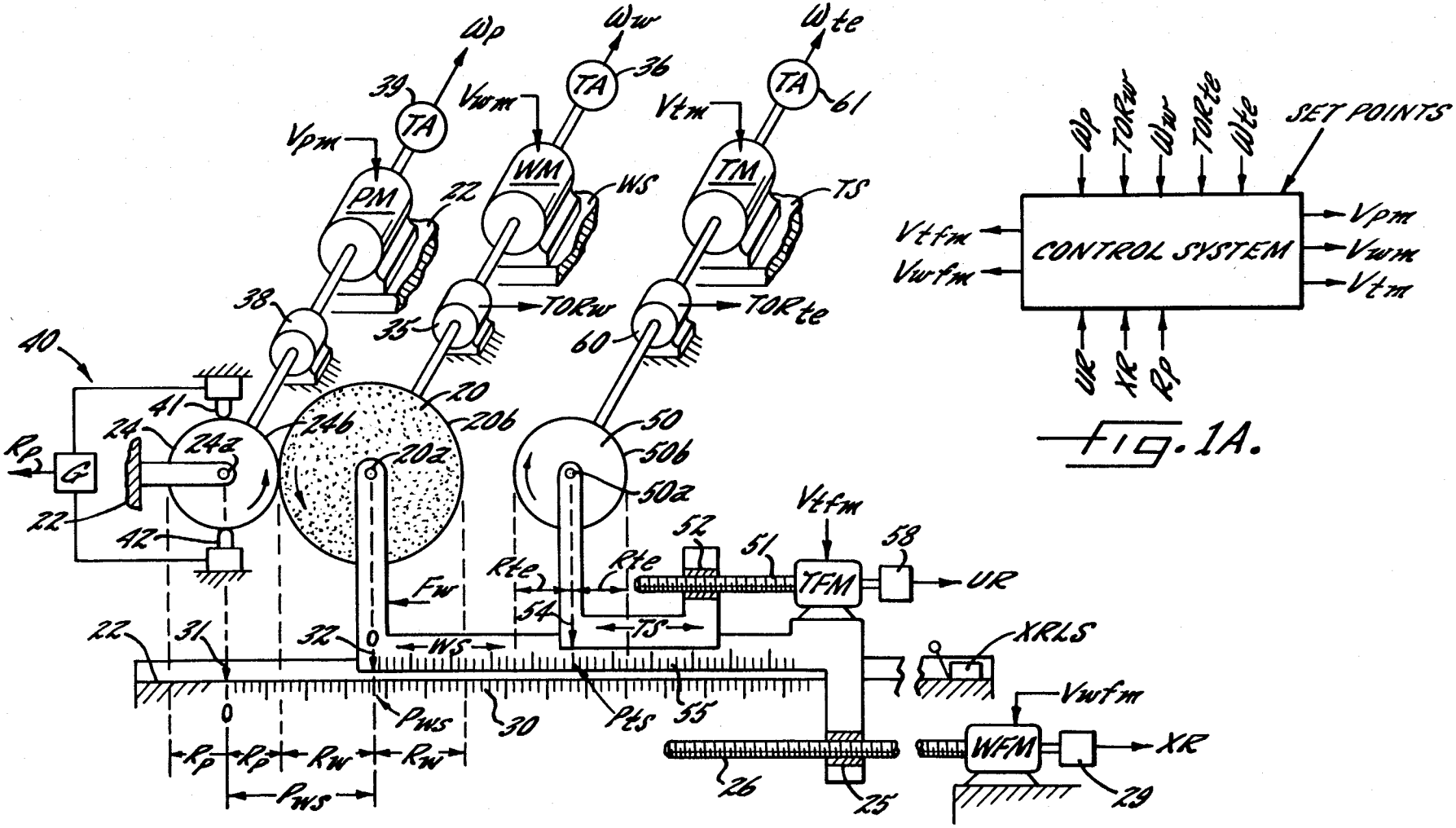
FIG. 1 is a diagrammatic illustration of an exemplary grinding machine with rotational and feed drives for the various relatively movable components, and with sensors for signaling the values of different physical parameters such as speeds, feed rates, positions and torques.
FIG. 1A is a generalized representation of a control system to be associated with the apparatus of FIG. 1 in the practice of the present invention according to any of several embodiments.
Figure 6:
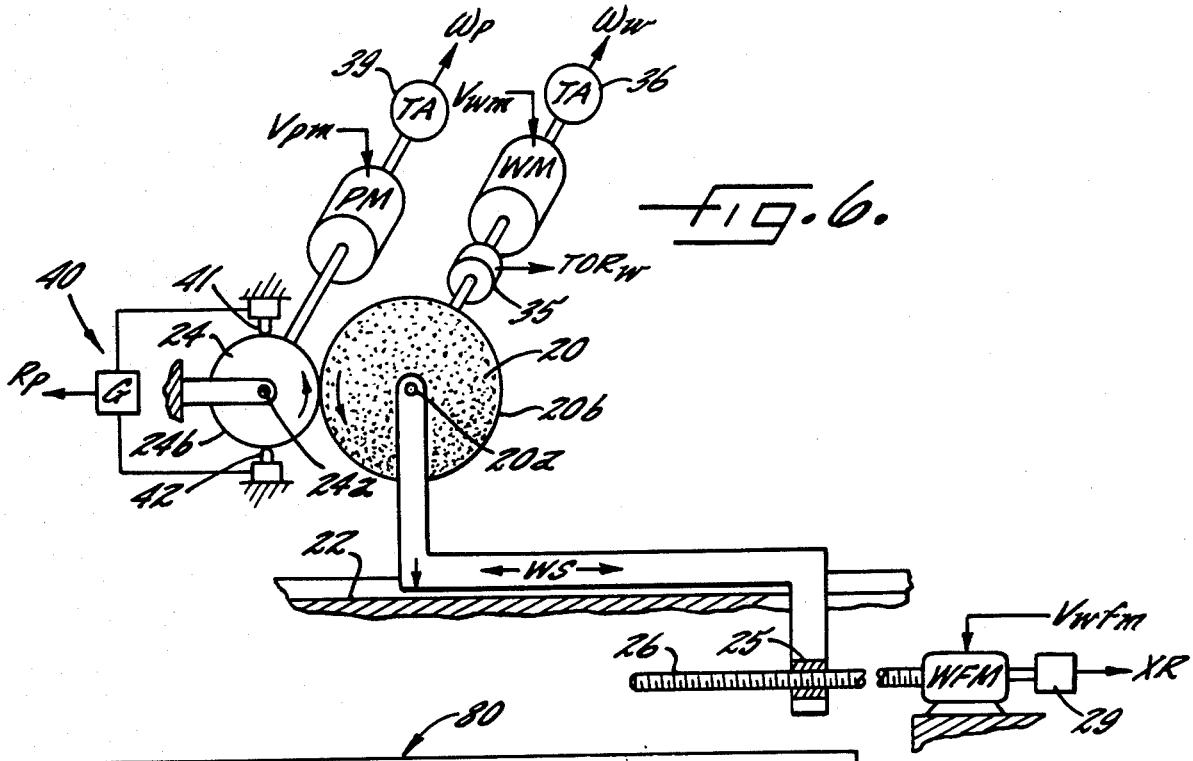
FIG. 6 is a diagrammatic illustration of a portion of the exemplary grinding machine of FIG. 1 which is used in a first example of the present invention.
Figure 8:
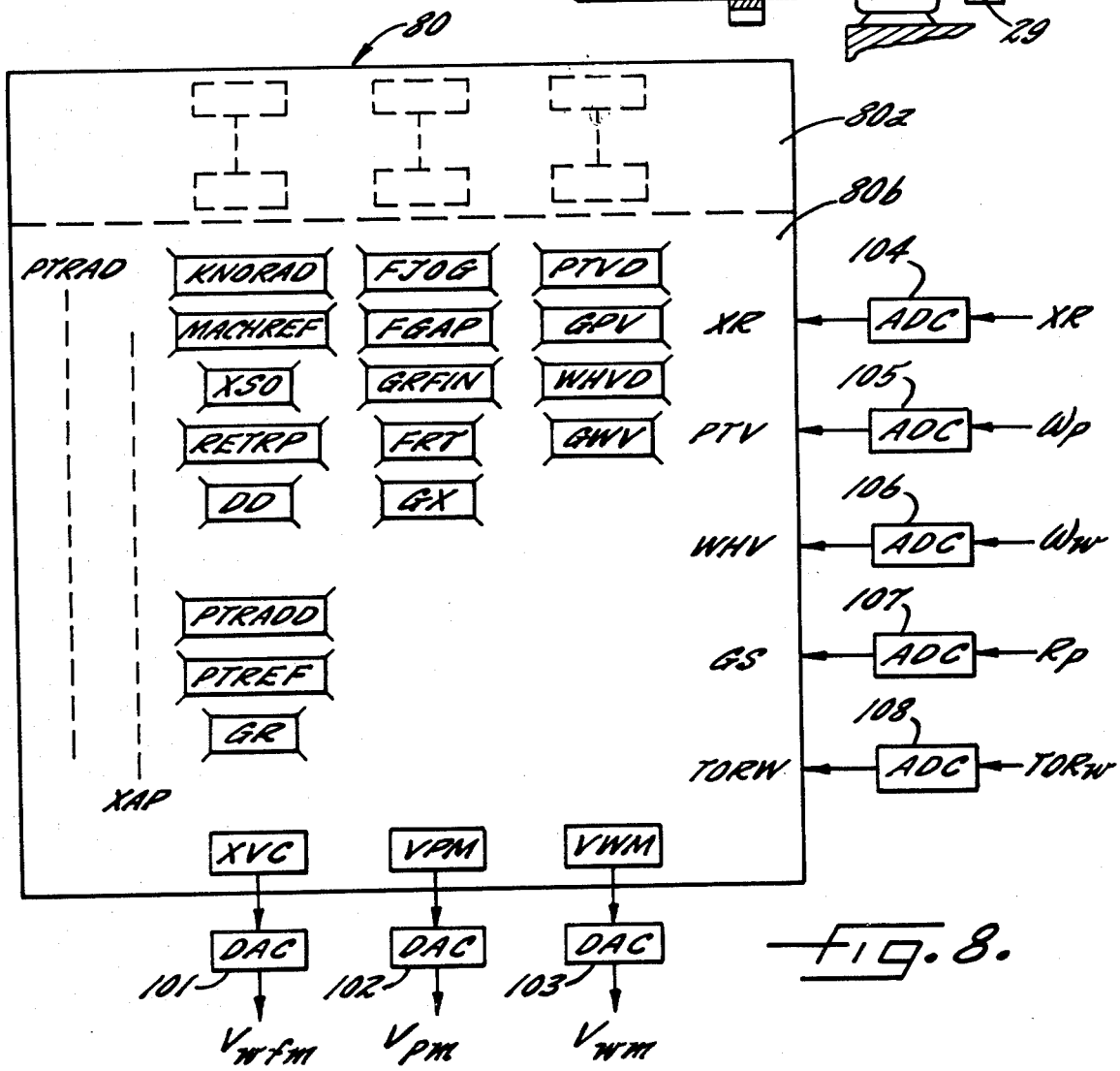
FIG. 8 is a block representation of the signal storage units or memory for the minicomputer of FIG. 7, when used to control the grinding machine of FIG. 6 according to the first example of the invention.
Figure 7:
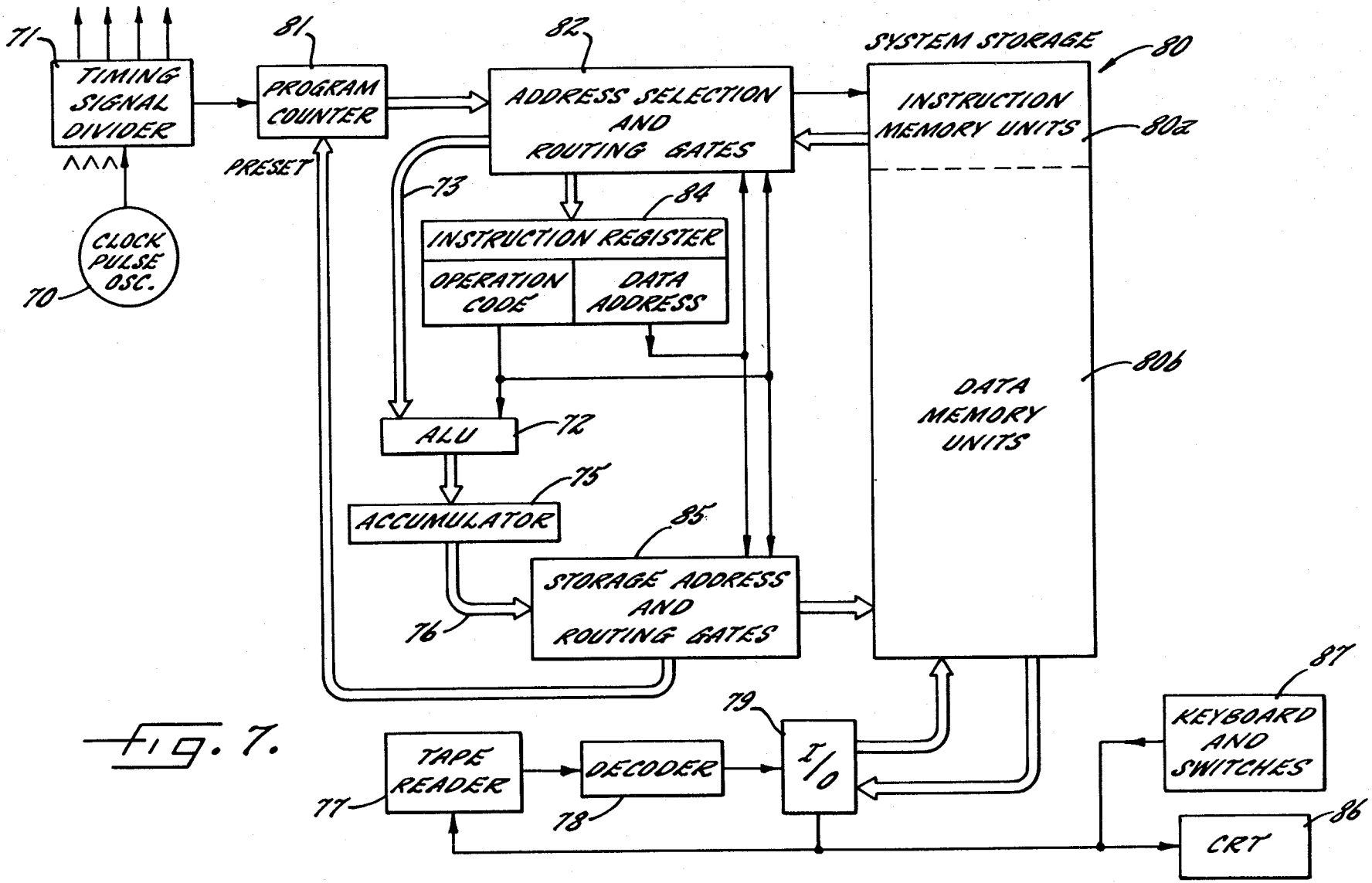
FIG. 7 is a block diagram of one suitable form of digital minicomputer with associated memory or storage, for use in controlling the grinding machine of FIG. 6.
Figure 9:
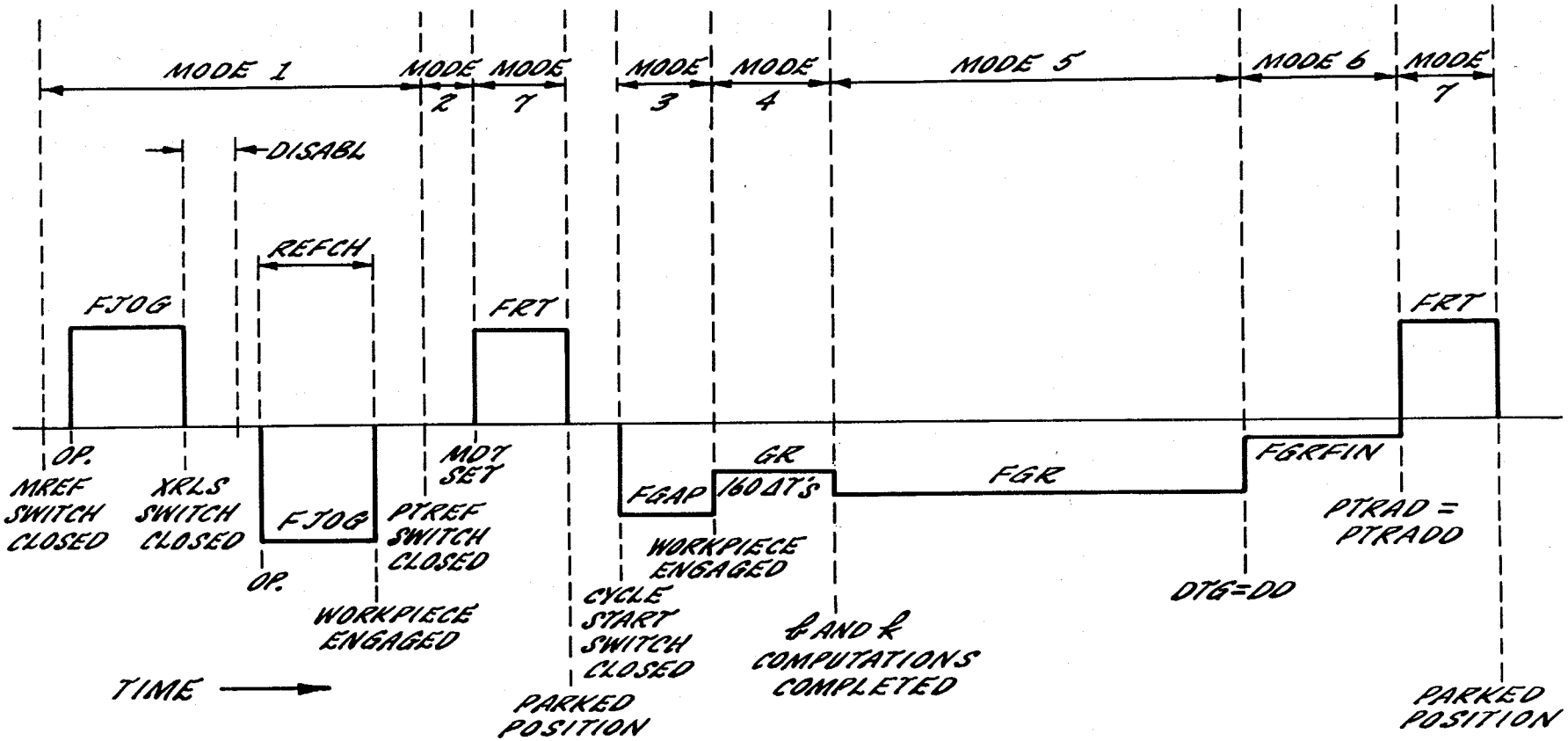
FIG. 9 is a timing diagram illustrating the various modes of operation involved in the grinding of a single workpiece according to the first example of the invention, using the grinding machine of FIG. 6 as controlled by the minicomputer of FIG. 7.
Figure 10A:
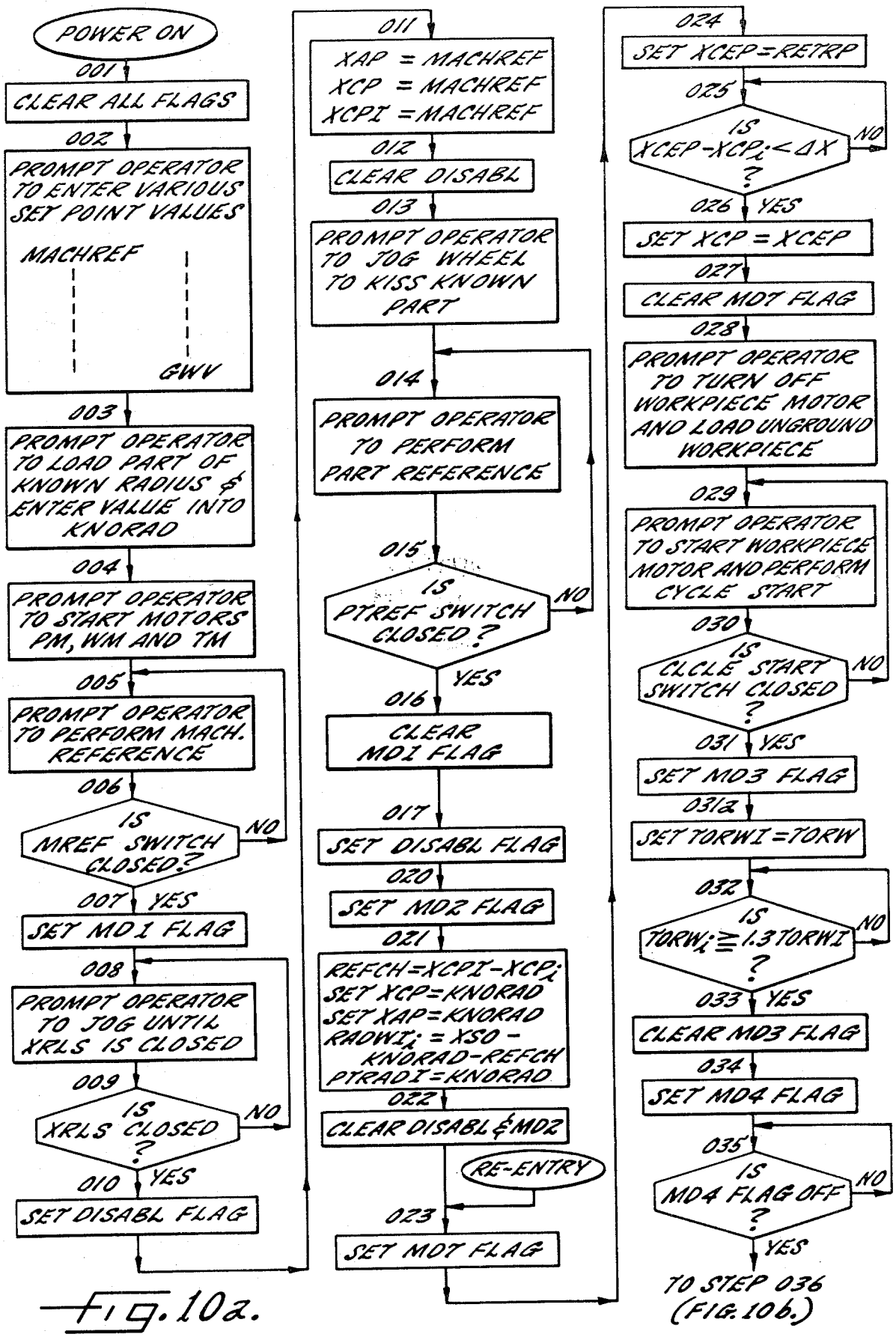
Figures 10B, 12:
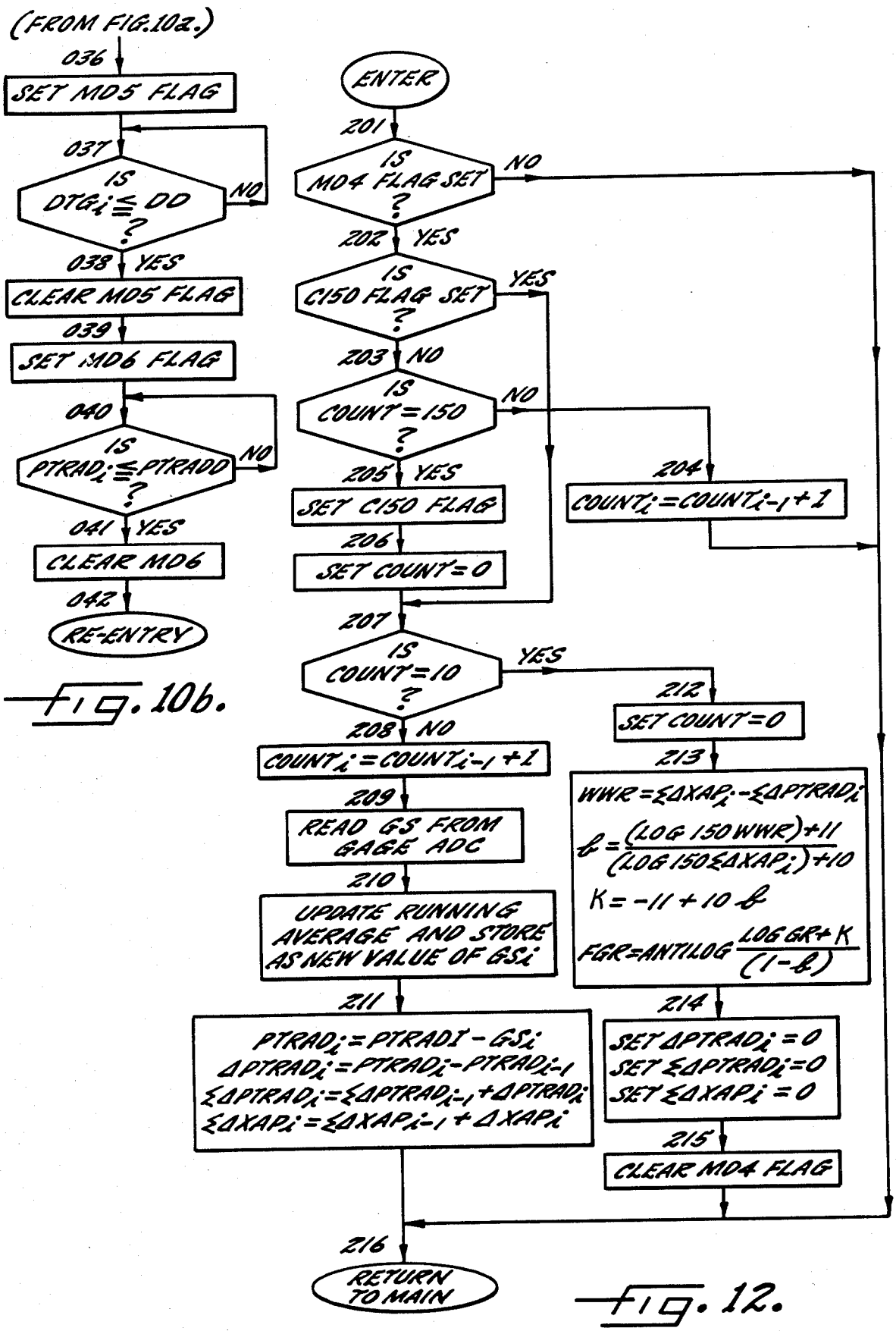
Figure 14:
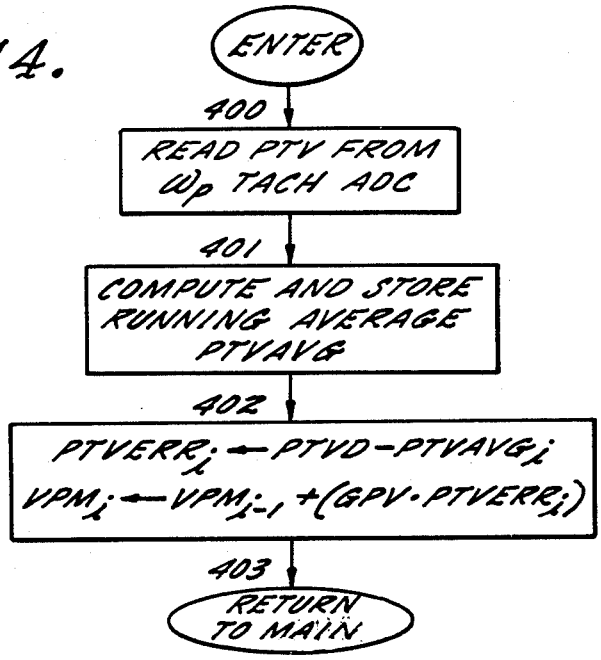
Figure 15:
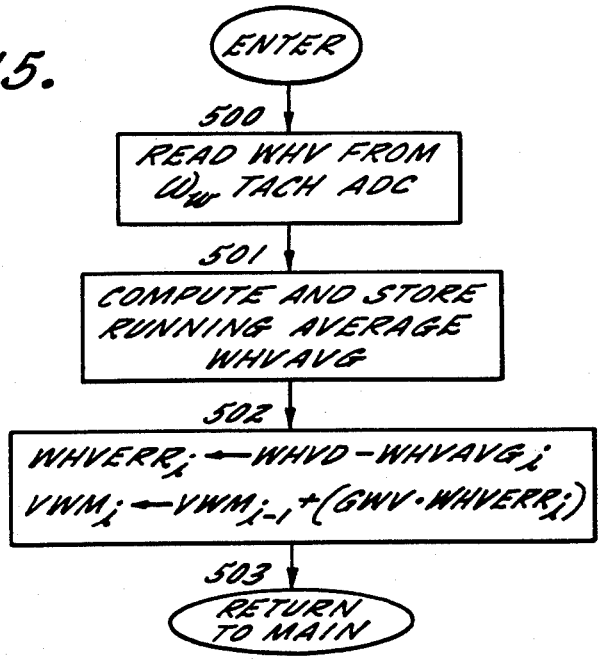
Figures 16, 17:
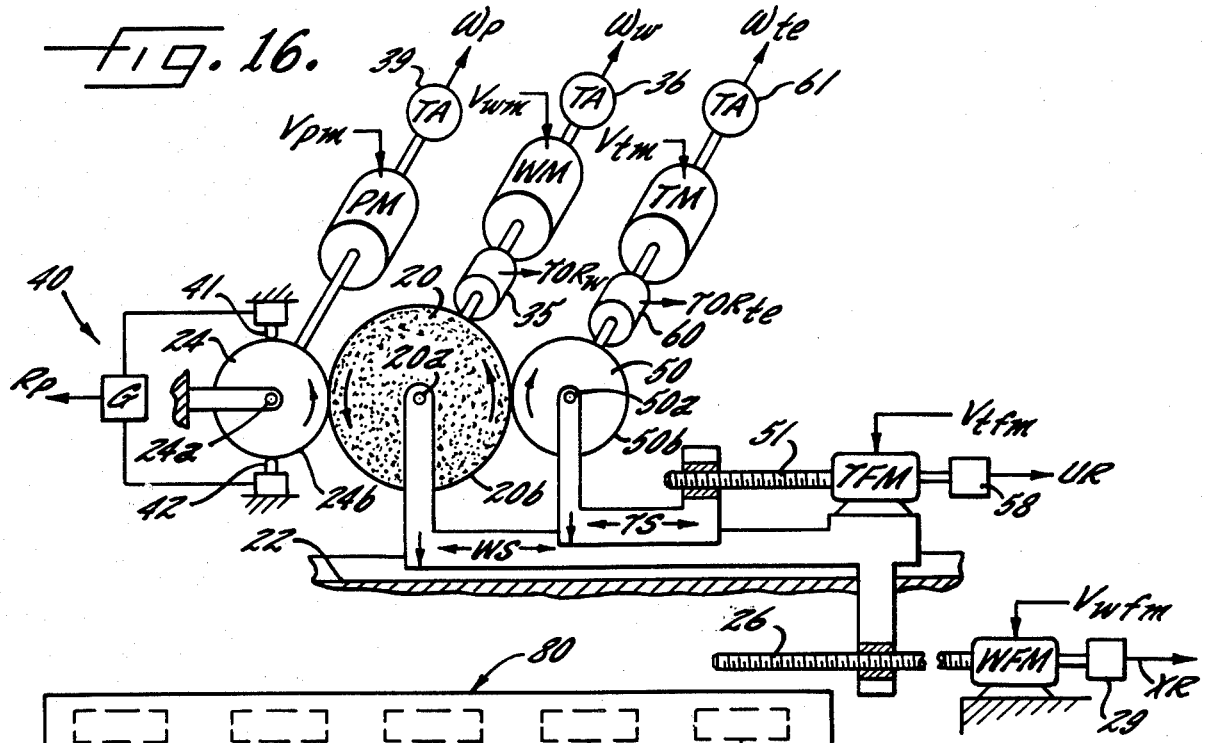
Figure 18:
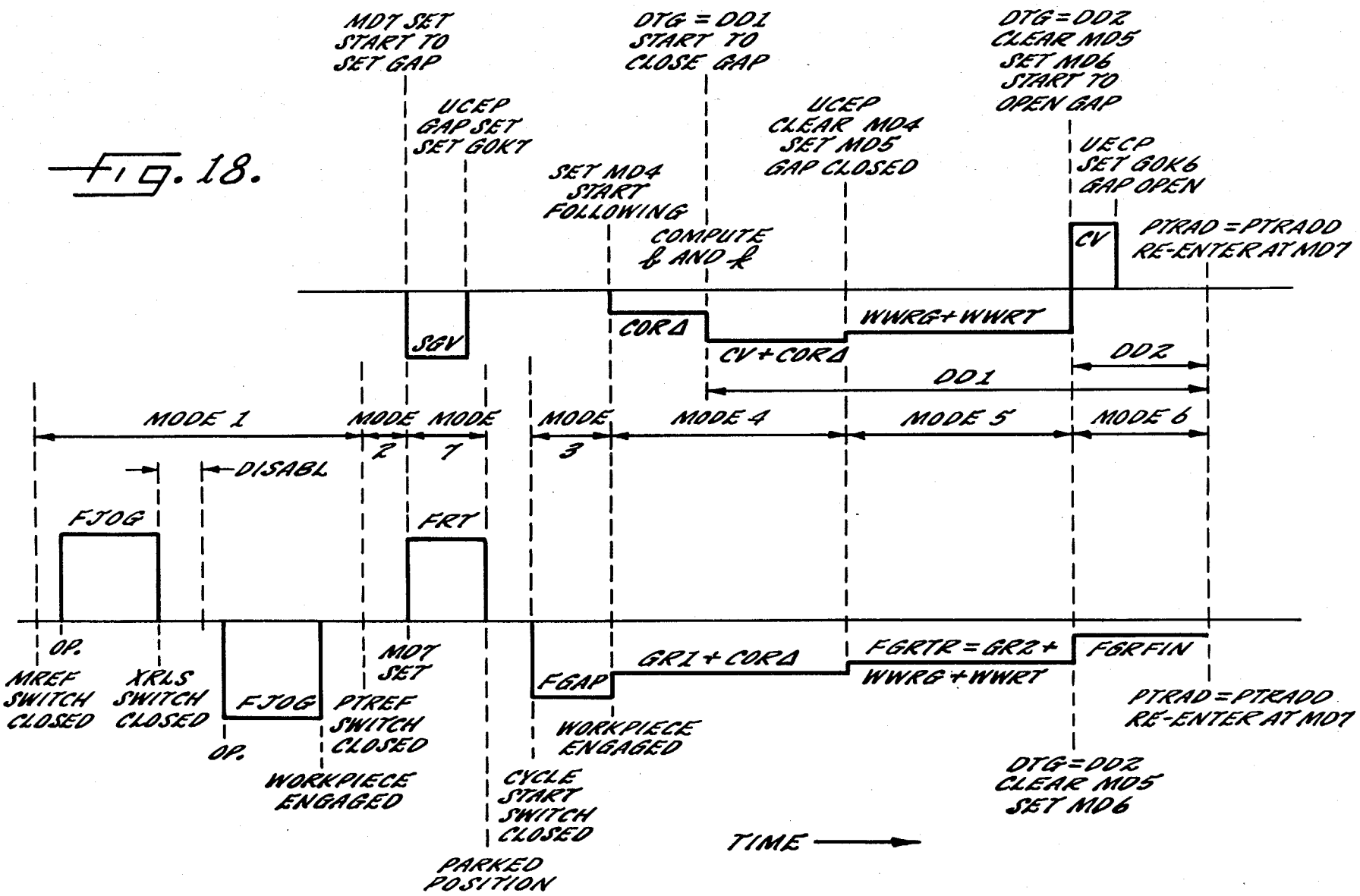
Figure 19A:
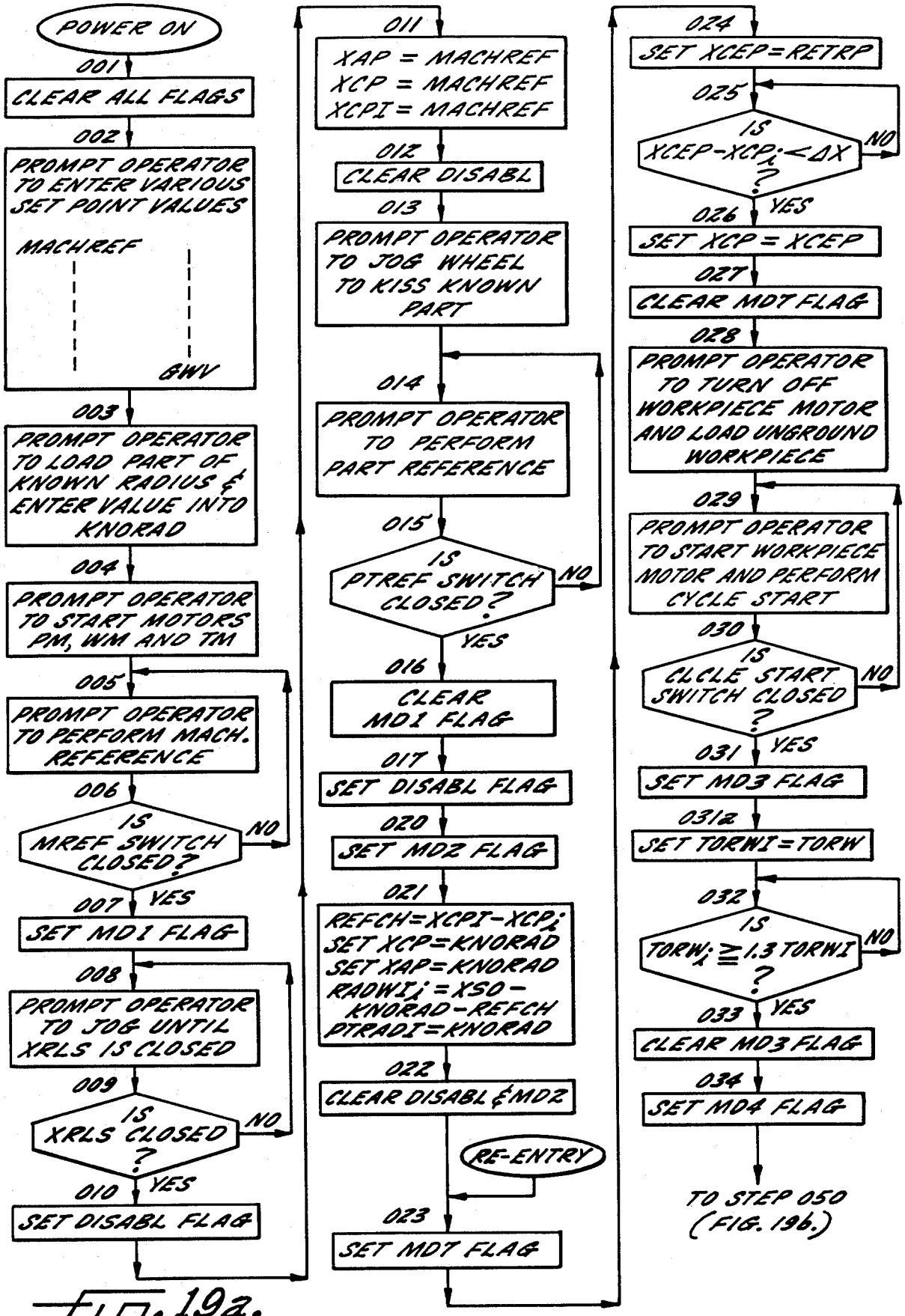
Figure 19B:
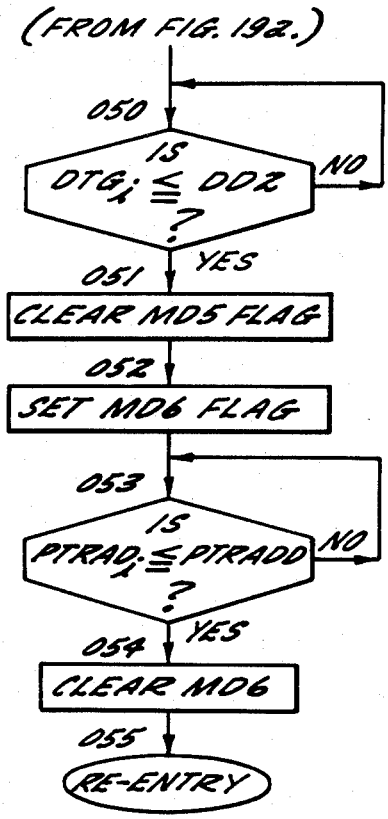
Figure 21:
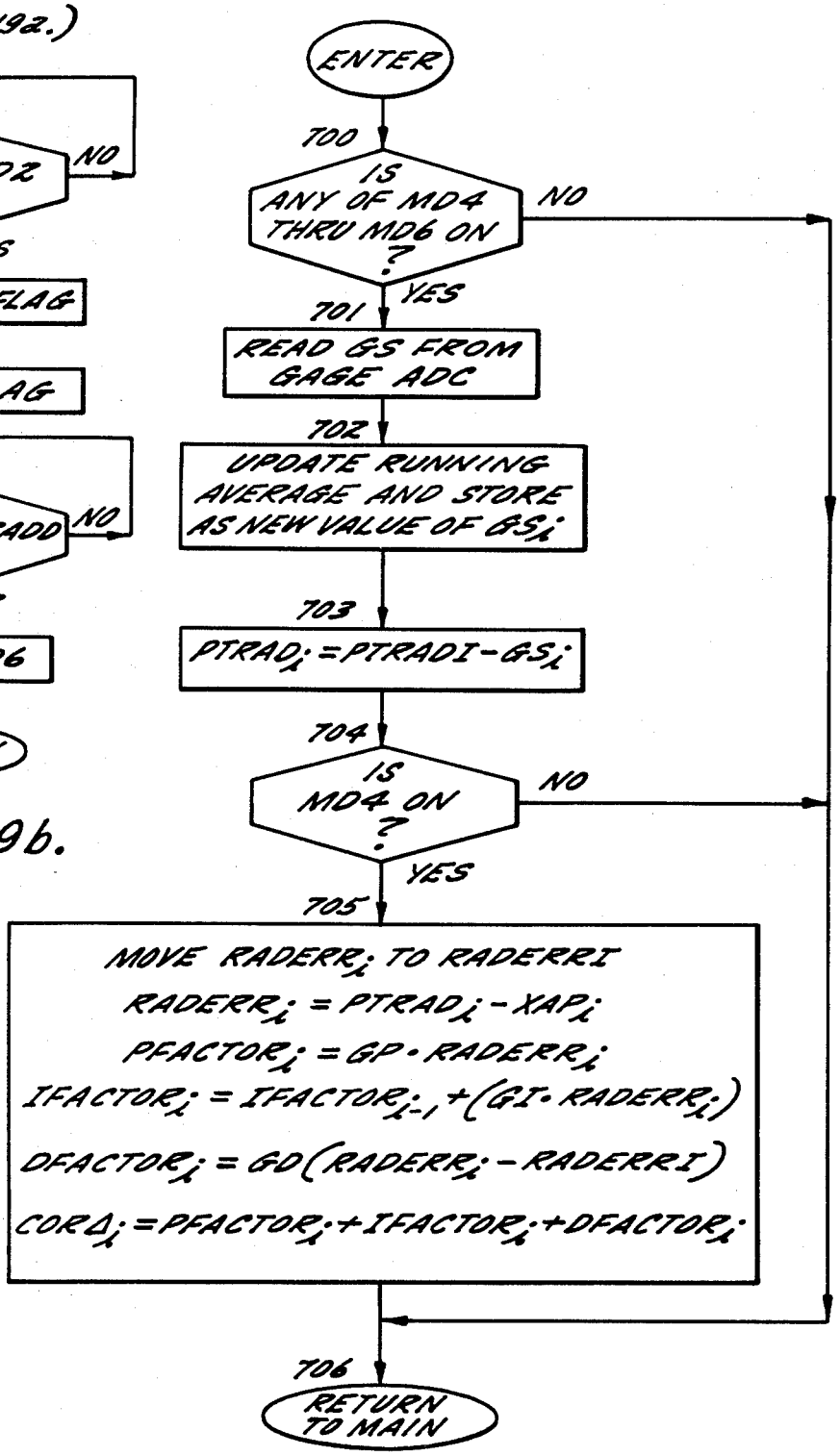
Figure 22A:
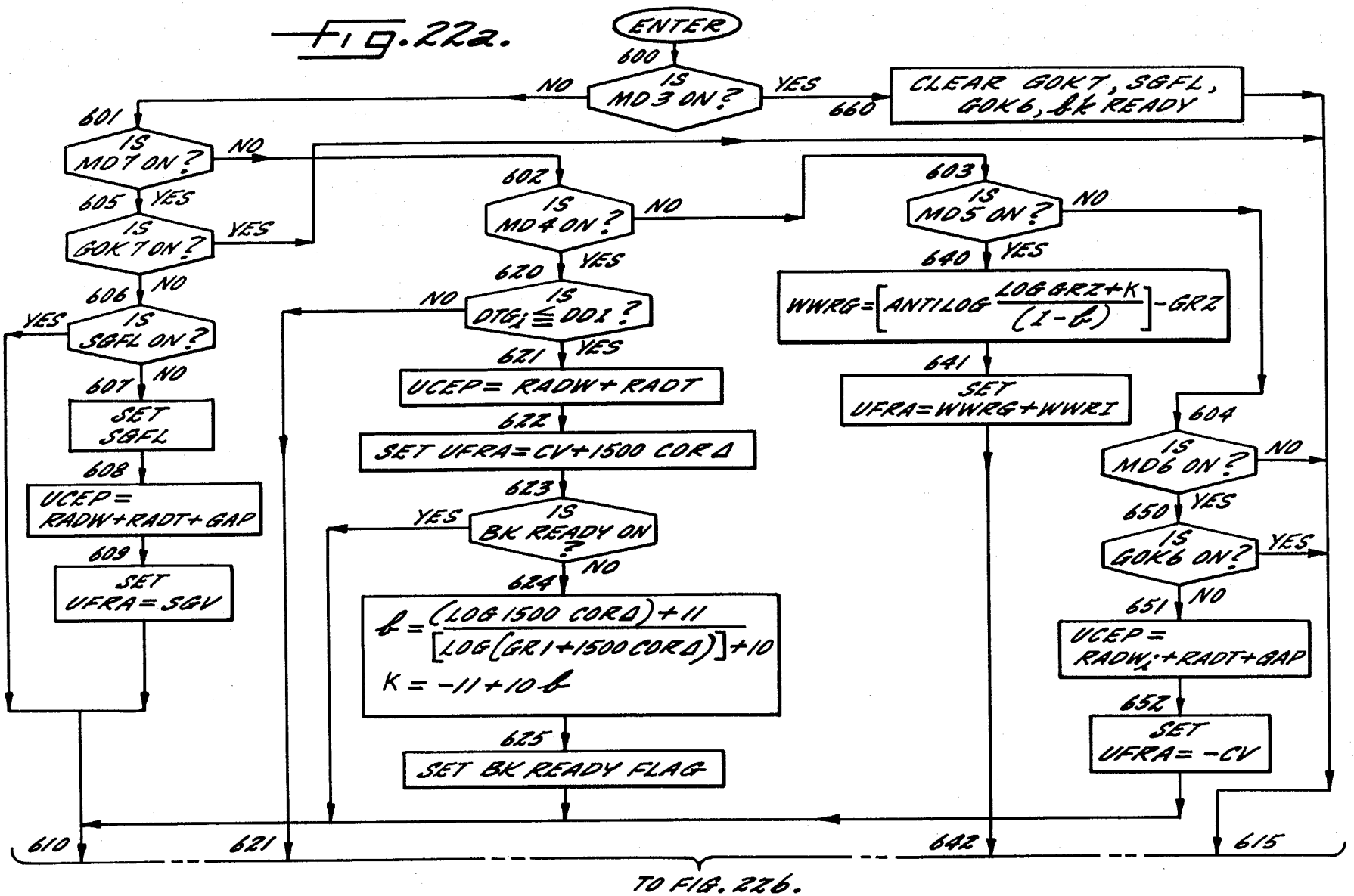
Figure 22B:
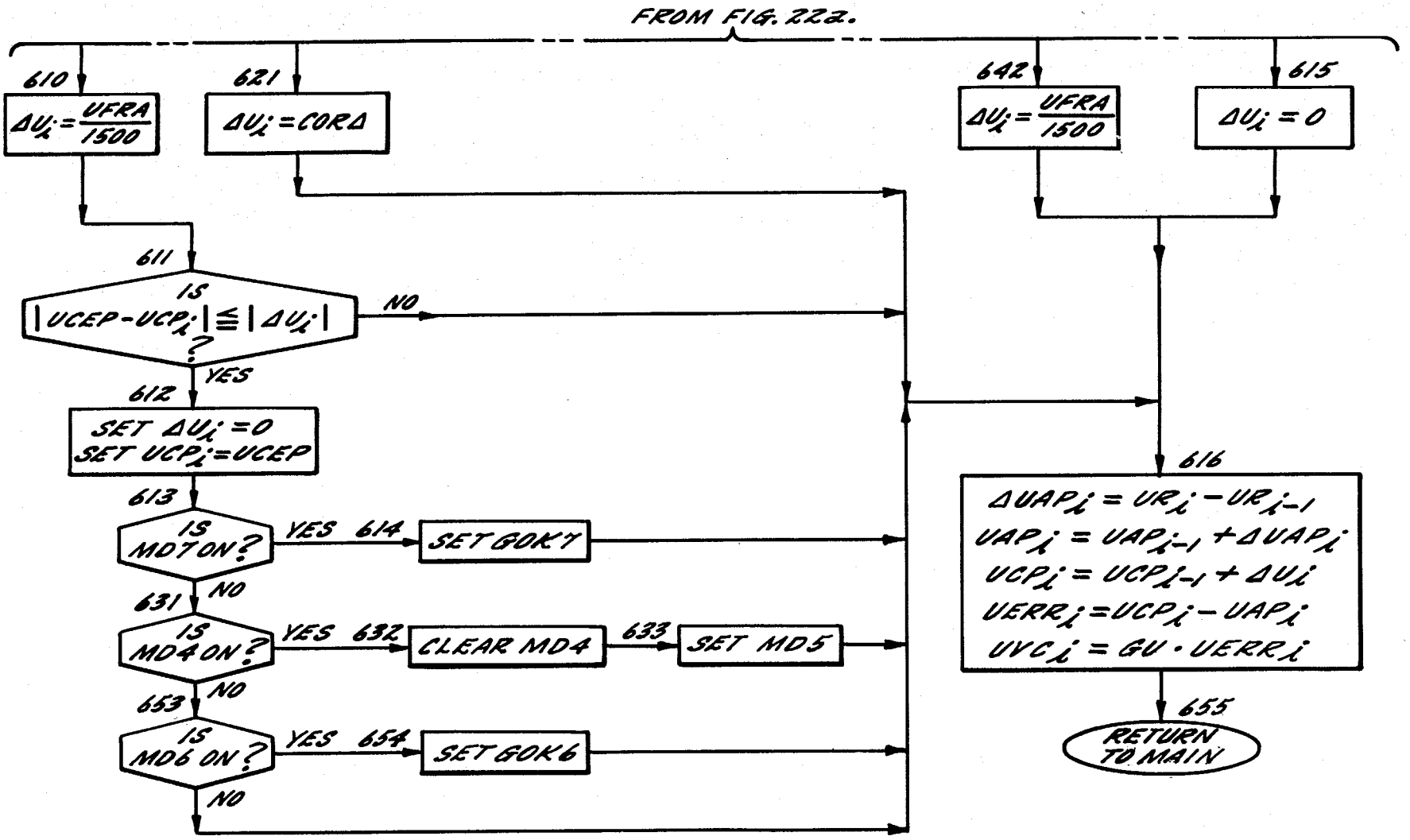
Figure 23:
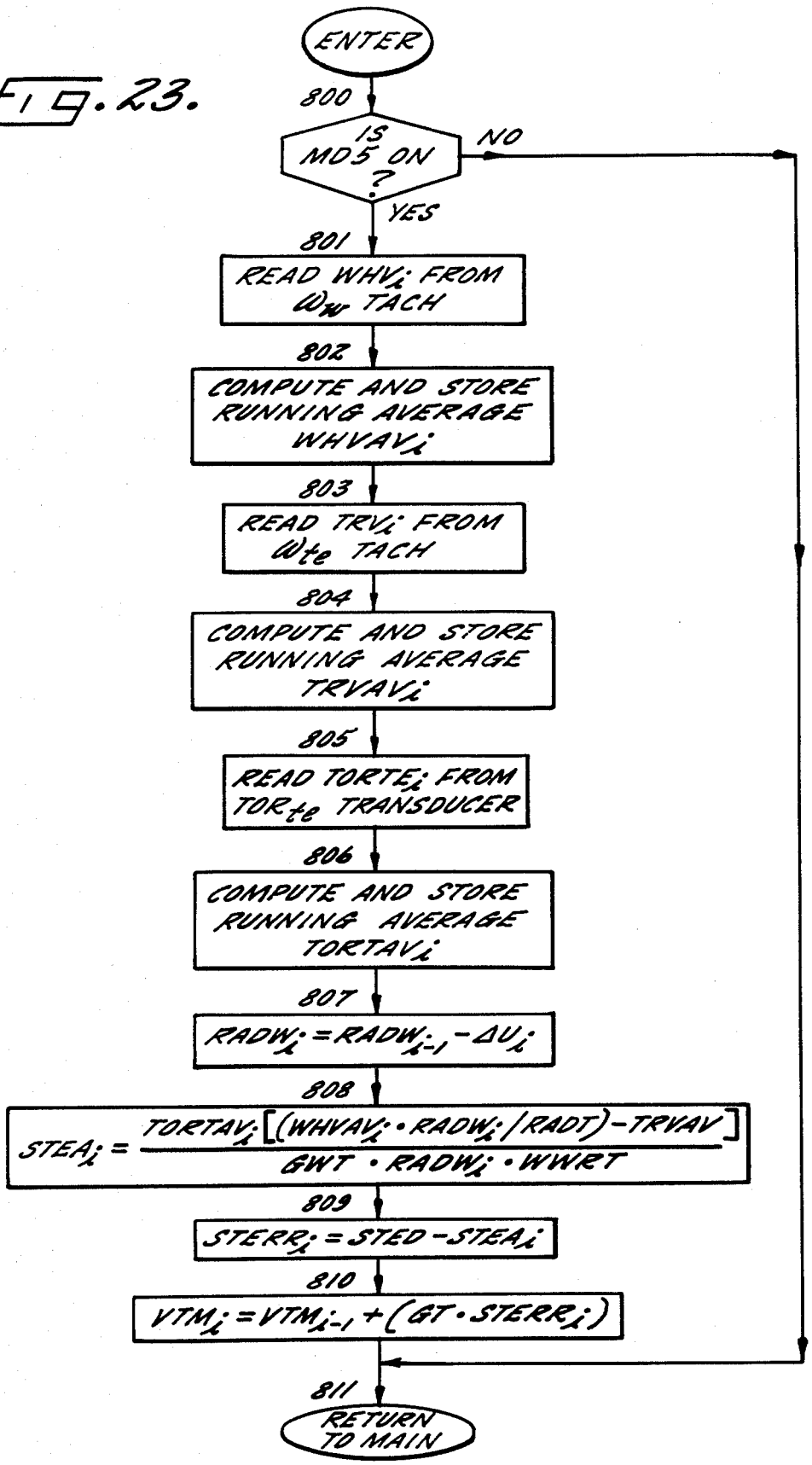

FIGS. 10*a* and 10*b* (hereinafter collectively referred to as FIG. 10) constitute a flow chart illustrating the sequences of operations carried out according to a main program stored in the memory of FIG. 8 and executed by the minicomputer of FIG. 7 for controlling the grinding machine of FIG. 6;

FIG. 11 is a flow chart illustrating the sequences of operations carried out according to a subroutine program stored in the memory of FIG. 8 and executed by the minicomputer of FIG. 7 for controlling the wheel slide feed motor WFM in the grinding machine of FIG. 6;

FIG. 12 is a flow chart illustrating the sequences of operations carried out according to a subroutine program stored in the memory of FIG. 8 and executed by the minicomputer of FIG. 7 for performing certain operations during mode 4 of FIG. 9;

FIG. 13 is a flow chart illustrating the sequence of operations carried out according to a subroutine program stored in the memory of FIG. 8 and executed by the minicomputer of FIG. 7 for carrying out certain operations during modes 5 and 6 of FIG. 9;

FIG. 14 is a flow chart illustrating the sequences of operations carried out according to a subroutine program stored in the memory of FIG. 8 and executed by the minicomputer of FIG. 7 for controlling the workpiece drive motor PM in the grinding machine of FIG. 6;

FIG. 15 is a flow chart illustrating the sequences of operations carried out according to a subroutine program stored in the memory of FIG. 8 and executed by the minicomputer of FIG. 7 for controlling the wheel drive motor WM in the grinding machine of FIG. 6;

FIG. 16 is a diagrammatic illustration of a portion of the exemplary grinding machine of FIG. 1 which is used in a second example of the present invention;

FIG. 17 is a block diagram of the signal storage units or memory for the minicomputer of FIG. 7 when used to control the grinding machine of FIG. 16 according to the second example of the invention;

FIG. 18 is a timing diagram illustrating the different modes of operation involved in the grinding of a single workpiece according to the second example of the invention, using the grinding machine of FIG. 16 as controlled by the minicomputer of FIG. 7;

FIGS. 19*a* and 19*b* (hereinafter collectively referred to as FIG. 19) constitute a flow chart illustrating the sequences of operations carried out according to a main program stored in the memory of FIG. 8 and executed by the minicomputer of FIG. 7 for controlling the grinding machine of FIG. 16 according to the second example of the invention;

FIG. 20 is a flow chart illustrating the sequences of operations carried out according to a subroutine program stored in the memory of FIG. 17 and executed by the minicomputer of FIG. 7 for controlling the wheel slide feed motor WFM in the grinding machine of FIG. 16;

FIG. 21 is a flow chart illustrating the sequences of operations carried out according to a subroutine program stored in the memory of FIG. 17 and executed by the minicomputer of FIG. 7 for performing certain operations during modes 4–6 of FIG. 18;

FIGS. 22*a* and 22*b* (hereinafter collectively referred to as FIG. 22) constitute a flow chart illustrating the sequences of operations carried out according to a subroutine program stored in the memory of FIG. 17 and executed by the minicomputer of FIG. 7 for controlling the truing slide feed motor TFM in the grinding machine of FIG. 16; and FIG. 23 is a flow chart illustrating the sequences of operations carried out according to a subroutine program stored in the memory of FIG. 17 and executed by the minicomputer of FIG. 7 for controlling the truing roll drive motor TM in the grinding machine of FIG. 16.

TYPICAL GRINDING MACHINE CONFIGURATION AND COMPONENTS

FIG. 1 diagrammatically shows a typical grinding machine with its various relatively movable components, together with various sensors and driving motors or actuators. Not all the sensors and actuators are required in certain ones of the method and apparatus embodiments to be described, but FIG. 1 may be taken as an "overall" figure illustrating all the various machine-mounted components which are employed in one embodiment or another, so long as it is understood that certain ones of such components are to be omitted in some cases.

The grinding machine is here illustrated by way of example as a cylindrical grinder but the invention to be disclosed below is equally applicable to all other types of grinding machines such as surface grinders, roll grinders, etc. The machine includes a grinding wheel 20 journaled for rotation about an axis 20*a* and rotationally driven (here, counterclockwise) by a wheel motor WM. The wheel 20 and its spindle or axis 20*a* are bodily carried on a wheel slide WS slidable along ways of the machine bed 22. As shown, the face 20*b* of the wheel is brought into relative rubbing contact with the work surface 24*b* of a part or workpiece 24, and the wheel face is fed relatively into the workpiece by movement of the carriage WS toward the left, to create abrasive grinding action at the work/wheel interface.

In the exemplary arrangement shown, the workpiece 24 is generally cylindrical in shape (or its outer surface is a surface of revolution) and supported on fixed portions of the machine bed 22 but journaled for rotation about an axis 24*a*. The workpiece is rotationally driven (here, counterclockwise) at an angular velocity $\omega_p$ by a part motor PM mounted on the bed 22. Since the workpiece and wheel surfaces move in opposite directions at their interface, the relative surface speed of their rubbing contact is equal to the sum of the peripheral surface speeds of the two cylindrical elements.

Any appropriate controllable means may be employed to move the slide WS left or right along the bed 22, including hydraulic cylinders or hydraulic rotary motors. As here shown, however, the slide WS mounts a nut 25 engaged with a lead screw 26 connected to be reversibly driven at controllable speeds by a wheel feed motor WFM fixed on the bed. It may be assumed for purposes of discussion that the motor WFM moves the slide WS, and thus the wheel 20, to the left or the right, according to the polarity of an energizing voltage $V_{wfm}$ applied to the motor, and at a rate proportional to the magnitude of such voltage.

A position sensor in the form of a resolver 29 is coupled to the slide WS or the lead screw 26 to produce a signal XR which varies to represent the position of the wheel slide as it moves back and forth. In the present instance, the position of the wheel slide is measured along a scale 30 (fixed to the bed) as the distance between a zero reference point 31 and an index point 32 on the slide. The reference and index points 31 and 32 are for convenience of discussion here shown as vertically alined with the workpiece and wheel axes 24*a* and 20*a*, respectively, and the value $P_{ws}$ represents the position of the wheel axis 20*a* relative to the workpiece axis 24*a*.

In the practice of the invention in certain of its embodiments, it is desirable (for a purpose to be explained) to sense and signal the power which is being applied for rotational drive of the grinding wheel 20, and also to sense and signal the rotational speed of the wheel. While power may be sensed and signaled in a variety of ways, FIG. 1 illustrates for purposes of power computation a torque transducer 35 associated with the shaft which couples the wheel motor WM to the wheel 20. The torque sensor 35 produces a dc. voltage $TOR_w$ which is proportional to the torque exerted in driving the wheel to produce the rubbing contact described above at the interface of the wheel 20 and the workpiece 24. The wheel motor WM is one which is controllable in speed, and while that motor may take a variety of forms such as an hydraulic motor, it is here assumed to be a dc. motor which operates at a rotational speed $\omega_w$ which is proportional to an applied energizing voltage $V_{wm}$. As a convenient but exemplary device for sensing and signaling the actual rotational speed of the wheel 20, a tachometer 36 is here shown as coupled to the shaft of the motor WM and producing a dc. voltage $\omega_w$ proportional to the rotational speed (e.g., in units of r.p.m.) of the wheel 20.

In similar fashion, it is desirable in the practice of the invention according to certain ones of the embodiments to be described that the power and rotational speed of the workpiece or part 24 be signaled directly or indirectly. For this purpose, and as explained further below, a torque transducer 38 is associated with the shaft which drivingly couples the part motor PM to drive the workpiece 24. The latter torque transducer may take any suitable known form and it will here be assumed that it produces, as an output signal, a dc. voltage $TOR_p$ proportional to the torque which is exerted by the motor PM in rotationally driving the workpiece 24 counterclockwise during grinding action. The rotational speed of the workpiece 24 is controllable, and in the present instance it is assumed that 7 the motor PM drives the workpiece 24 at an angular velocity $\omega_p$ proportional to the magnitude of a dc. energizing voltage $V_{pm}$ applied to that motor. Further, to sense the actual angular velocity of the rotationally driven workpiece 24, a tachometer 39 is coupled to the shaft of the motor PM and produces a dc. signal $\omega_p$ proportional to the workpiece speed.

Again, although not essential to the practice of the invention in all of its embodiments, FIG. 1 illustrates a typical and suitable arrangement for continuously sensing and signaling the size (i.e., radius) of the workpiece 24 as the latter is reduced in diameter due to the effects of grinding action. Such workpiece sensing devices are often called "in-process part gages", and one known type of such gage is a diametral gage 40 which has a pair of sensors 41 and 42 which ride lightly on the workpiece surface at diametrically spaced points. These sensors 41 and 42 are preferably located in the top and bottom of the workpiece to minimize any effect of workpiece deflection (due to the pressure of the grinding wheel) on the gage signal. The output signal from the gage 40 is directly proportional to the distance between the two sensors 41 and 42, which is the actual diameter $D_p$ of the workpiece at any given time. Since the workpiece diameter $D_p$ is twice the workpiece radius $R_p$, the gage signal is also proportional to the actual workpiece radius and thus has been designated "$R_p$" in FIG. 1.

As will be treated more fully below, as grinding of the part 24 by the wheel 20 proceeds, the wheel may not only become dull but its face may deteriorate from the desired shape. Accordingly, it has been the practice in the prior art to periodically "dress" the grinding wheel to restore sharpness and/or periodically "true" the grinding wheel face in order to restore its shape or geometric form to the desired shape. These related procedures of dressing and truing will here be generically called "conditioning" the wheel face.

For future reference, it may be noted here that the grinding machine of FIG. 1 includes a conditioning element or truing roll 50 having an operative surface 50*b* which conforms to the desired wheel face shape. Whenever truing or dressing is required or desired, the operative surface of the truing roll 50 may be relatively fed into relative rubbing contact with the wheel face 20*b* in order to either wear away that wheel face so it is restored to the desired shape, or to affect the sharpness of the abrasive grits carried at the wheel face. Thus, FIG. 1 shows the truing roll 50 as being mounted for rotation about its axis 50*a* on a spindle supported by a truing slide TS movable to the left or right relative to the wheel slide WS. That is, the truing slide TS is slidable along the ways formed on the wheel slide WS and it may be shifted or fed to the left or the right relative to the index mark 32 by a truing feed motor TFM mechanically coupled to a lead screw 51 engaged with a nut 52 in the slide TS. The motor TFM has its stator rigidly mounted on the wheel slide WS so that as the lead screw 51 turns in one direction or the other, the slide TS is fed to the left or right relative to the wheel slide WS. The motor TFM is here assumed, for simplicity, to be a dc. motor which drives the lead screw in a direction which corresponds to, and at a speed which is proportional to, the polarity and magnitude of an energizing voltage $V_{tfm}$.

The position of the truing roll 50 and the truing slide TS is measured, for convenience, relative to the index mark 32 on the wheel slide WS. As here shown, an index mark 54 vertically alined with the axis 50*a* indicates the position $P_{ts}$ of the wheel 50 along a scale 55 on the wheel slide, such scale having its zero reference location alined vertically with the axis 20*a* and the index mark 32. In order that the position of the truing roll 50 may at all times be known, a resolver 58 is coupled to the lead screw 51 and produces a signal UR which varies with the physical position $P_{ts}$ of the truing slide TS along the scale 55 as the slide moves to the left or to the right.

When the conditioning element 50 is employed in a cylindrical grinding machine, it will usually take the form of a cylindrical roll having an operative surface which conforms to the desired shape of the wheel face. In order to produce the relative rubbing of the wheel and truing roll 50, the latter is rotationally driven or braked at controllable speeds by a truing motor TM which is mounted upon, and moves with, the truing slide TS. Merely for simplicity in the description which ensues, it is assumed that the motor TM is a dc. motor which may act bi-directionally, i.e., either as a source which drives the roll 50 in a clockwise direction or which affirmatively brakes the roll 50 (when the latter is driven c.w. by the wheel 20 in contact therewith) by torque acting in a c.c.w. direction. It is known in the motor art that a dc. motor may be controlled to act as a variable brake by regenerative action. Assuming that the grinding wheel 20 has been brought into peripheral contact with the roll 50, the motor TM may thus serve as a controllable brake producing a retarding effect proportional to an energizing voltage $V_{tm}$ applied thereto. If desired, one may view the motor as an electromagnetic brake creating a variable torque by which the rotational speed $\omega_{te}$ of the truing roll 50 is controlled by variation of the applied voltage $V_{tm}$. In this fashion, the relative rubbing surface speed between the wheel face and the truing roll 50 may be controlled by controlling the braking effort exerted by the motor TM through a shaft coupled to the roll 50.

Also for a purpose which will become clear, it is desired to sense or control the power expended in either driving or braking the truing roll 50 by the action of the motor TM during the relative rubbing contact. While a variety of known power sensing devices may be utilized, the arrangement illustrated by way of example in FIG. 1 includes a torque transducer 60 associated with the shaft which couples the motor TM to the truing roll 50. That transducer produces a signal in the form of a dc. voltage $TOR_{te}$ which is proportional to the torque transmitted (either by motoring or braking action, but usually the latter). Also, the rotational velocity of the truing roll 50 is desirably sensed and signaled for reasons to be made clear. For this purpose, a tachometer 61 is coupled to the roll 50 or to the shaft of the motor/-brake TM and it produces a dc. voltage $\omega_{te}$ which is proportional to the speed (expressible in r.p.m.) with which the roll 50 is turning at any instant.

In setting up a grinding system of the type illustrated in FIG. 1, the grinding wheel slide WS is always positioned initially at a known reference position fixed by a reference limit switch XRLS. When the wheel slide is in this position, the distance between the grinding wheel axis 20*a* and the workpiece axis 24*a* is a known value.

FIG. 1A is a generic block representation of a control system 71 employed in the various embodiments of the invention to be described and which operates to carry out the inventive methods. In its most detailed form, the control system receives as inputs the signals XR, UR, $R_p$, $TOR_{te}$, $TOR_w$, $\omega_p$, $\omega_{te}$ and $\omega_w$ produced as shown in FIG. 1; and it provides as output signals the motor energizing signals $V_{pm}$, $V_{wm}$, $V_{tm}$ which determine the respective rotational speeds of the workpiece 24, wheel 50 and truing roll 50—as well as the signals $V_{wfm}$ and $V_{tfm}$ which determine the feed rates of the wheel slide WS and the truing slide TS. Yet, it will become apparent that not all the sensors, and signals representing sensed physical variables, need be used in the practice of all embodiments of the invention. Several typical but different embodiments will be described in some detail, both as to apparatus and method, in the following portions of the present specification.

DEFINITIONS AND SYMBOLS

Wheel Conditioning:

The modification of the face of a grinding wheel (i) to affect its sharpness (making it either duller or sharper); or (ii) to affect its shape, essentially to restore it to the desired shape; or (iii) to carry out both functions (i) and (ii).

Wheel Conditioning Element:

Any member having an operative surface conforming to the desired shape of a grinding wheel to be conditioned, and which can be brought into contact with the face of the wheel to create both relative rubbing and feeding which causes materal to be removed from the wheel (and in some cases undesireably causes material to be removed from the conditioning element). Throughout this specification the terms "truing" and "truing roll" will be used as synonymous with "conditioning" and "conditioning element" merely for convenience.

Relative Surface Speed:

The relative surface velocity with which rubbing contact occurs at the wheel face/operative surface interface. If the wheel surface is moving in one direction at 3000 feet per minute and the operative surface (workpiece or truing roll) is moving at 1000 feet per minute in the opposite direction, the relative surface speed is 4000 feet per minute. If the operative surface is not moving, then the relative speed of rubbing is equal to the surface speed of the wheel face due to wheel rotation. If the operative surface is moving in the same direction as the wheel face, the relative surface speed is the difference between the surface velocity of the wheel face and the surface velocity of the operative surface. If those two individual surface velocities are equal, the relative surface speed is zero, and there is no relative rubbing of the wheel face and operative surface, even though they are in contact. This latter situation exists during crush truing.

Relative Feed:

The relative bodily movement of a grinding wheel and conditioning element which causes progressive interference as the relative rubbing contact continues and by which the material of the wheel is progressively removed. It is of no consequence whether the wheel is moved bodily with the conditioning element stationary (although perhaps rotating about an axis) or vice versa, or if both the wheel and element are moved bodily. Feeding is expressible in units of velocity, e.g., inches per minute.

Rate of Material Removal:

This refers to the volume of material removed from a grinding wheel (or some other component) per unit time. It has dimensional units such as cubic centimeters per second or cubic inches per minute. In the present application alphabetical symbols with a prime symbol added designate first derivatives with respect to time, and thus the symbol W′ represents volumetric rate of removal of material from a grinding wheel. In similar fashions, the symbols P′ and TE′ respectively represent volumetric rates of removal of material from a part (workpiece) and a truing roll. From the introductory treatment of FIG. 1, it will also be apparent that the following symbols designate different physical variables as summarized below:

PWR = power, i.e., energy expended per unit time $PWR_w$ = power devoted by the wheel motor to rotationally drive a grinding wheel $PWR_{te}$ = power devoted by the truing element motor to drive or brake a truing element to create, in part, rubbing contact with wheel $PWR_{wt}$ = that portion of PWR devoted to truing action $PWR_{wg}$ = that portion of $PWR_w$ devoted to grinding action $PWR_t$ total power devoted to truing action $PWR_g$ = total power devoted to grinding action $TOR_p$ = torque exerted to drive the workpiece $TOR_w$ = torque exerted to drive the wheel $TOR_{te}$ = torque exerted to drive or brake the truing element $TOR_{wg}$ = that portion of total wheel torque $TOR_w$ applied to rubbing action at the grinding interface, when truing and grinding are occurring simultaneously $TOR_{wt}$ = similar to $TOR_{wg}$, but that portion of $TOR_w$ applied to rubbing action at the truing interface FOR = the force, in a direction tangential to a grinding wheel periphery, on a grinding wheel, a truing roll, or a workpiece due to rubbing action $\omega_w$ = rotational speed of grinding wheel (typically in units of r.p.m.)

$\omega_p$ = rotational speed of workpiece, i.e., the part to be ground $\omega_{te}$ = rotational speed of the truing element $S_w$ = the surface speed of the grinding wheel (typically in feet per minute)

$S_p$ = the surface speed of the workpiece or part $S_{te}$ = the surface speed of the truing element $S_r$ = the relative surface speed of rubbing contact $R_w$ = radius of grinding wheel $R_p$ = radius of workpiece or part $R_{te}$ = radius of truing element $P_{ws}$ = position of wheel slide $P_{ts}$ = position of truing slide (relative to wheel axis)

$F_{ws}$ = total feed rate (velocity) of wheel slide $F_{wsg}$ = feed rate (velocity) of wheel slide devoted to grinding action $F_{ts}$ = feed rate (velocity) of truing slide $R'_w$ = rate of radius reduction of wheel $R'_{wg}$ = rate of radius reduction of wheel due to grinding $R'_{wt}$ = rate of radius reduction of wheel due to truing $R'_p$ = rate of radius reduction of part being ground $R'_{te}$ = rate of radius reduction of truing element L = axial length of wheel face or region of grinding or truing contact M' = the volumetric rate of removal of material (metal) from the part being ground. Exemplary units: cubic inches per min.

W' = the volumetric rate of removal of material from the wheel. Exemplary units: cubic inches per min.

NOTE: Any of the foregoing symbols with an added "d" subscript represents a "desired" or set point value for the corresponding variable. For example, $\omega_{wd}$ represents a commanded or set point value for the rotational speed of the wheel. Similarly, any of the foregoing symbols with an added "o" subscript represents an original or initial value for the corresponding variable.

Certain ones of the foregoing symbols will be explained more fully as the description proceeds.

The parameter "Specific Truing Energy" (herein designated STE), which has been mentioned above, can be defined as:

STE = Specific Truing Energy; the ratio of (i) energy consumed in removing wheel material to (ii) the volume of such material removed. The same ratio is represented by the ratio of (i) power expended (energy per unit time) to (ii) rate of material removal (volume of material removed per unit time)—i.e., PWR/W'. Exemplary units: Horsepower per cubic inch per minute, or gram-centimeters per second per cubic centimeter per second.

The uses and benefits of STE are described in detail in my aforementioned copending U.S. patent application Ser. No. 249,192.

The Power Function Relationship Between Radius Reduction Rate And Feed Rate

Figure 2:
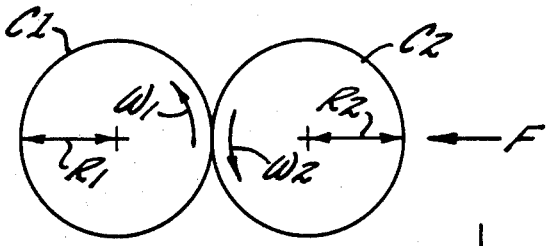
FIG. 2 is a schematic illustration of two rotating cylinders in rubbing contact with each other and being fed into each other at a feed rate F.

The present invention will be most clearly understood by beginning with a discussion of a simplified, hypothetical pair of rotating cylinders C1 and C2 in rubbing contact with each other, as illustrated in FIG. 2. The two cylinders C1 and C2 are fed into each other at a feed rate F, and the rubbing contact between the two cylinders reduces the respective radii R1 and R2 at rates $R'_1$ and $R'_2$ respectively. The two cylinders C1 and C2 may represent, for example, a workpiece and a grinding wheel, or a grinding wheel and a truing roll.

For any given set of grinding conditions, there is a power function relationship between the feed rate F and the rates of reduction of the radii R1 and R2 of the cylinders C1 and C2 at the rubbing interface. These power function relationships can be defined by the following equations:

| Cylinder C1 | Cylinder C2 | |
|---|---|---|
| $R'_1 = k_1F^a$ | $R'_2 = k_2F^b$ | (1,2) |

The values of the exponents a and b in the above equations are different for different sets of grinding conditions. For example, the values of these exponents vary with changes in the respective radii R1 and R2, the relative surface velocity $S_r$ of rubbing contact at the rubbing interface, the composition or hardness of either cylinder, the surface conditions of the cylinders (particularly the "sharpness" of a grinding wheel surface), etc. Thus, a significant change in one or more of these conditions will result in a change in the value of one or more of the exponents in the above equations.

The relationships defined by the above equations are power functions, which in general are represented by the equation $$y = a\,x^n \qquad (3)$$

Figure 3:
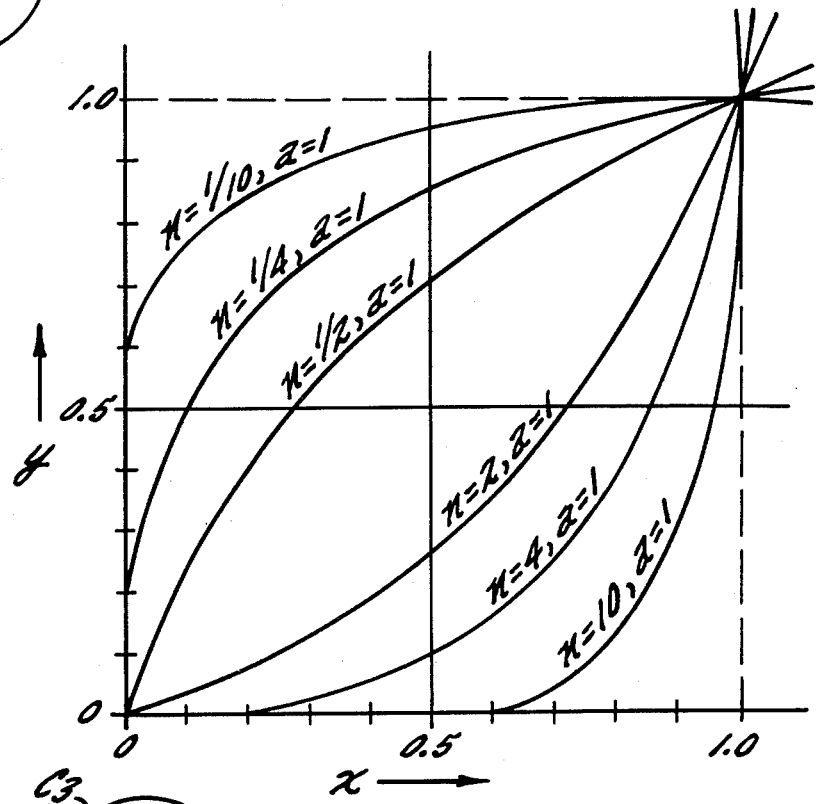
FIG. 3 is a graphical illustration of a family of parabolic power functions plotted on a linear x-y coordinate system.

It is known that the curves represented by the above power function Equation (3) must pass through the origin (x=o, y=o) in a linear coordinate system, and that such curves will always pass through the point (x=1, y=a), regardless of the value of n, because $x^n$ is always 1 when x is 1. This is illustrated by the family of curves in FIG. 3 which shows a group of curves defined by Equation (3) for different values of n and a coefficient a value of 1.

Figure 4:
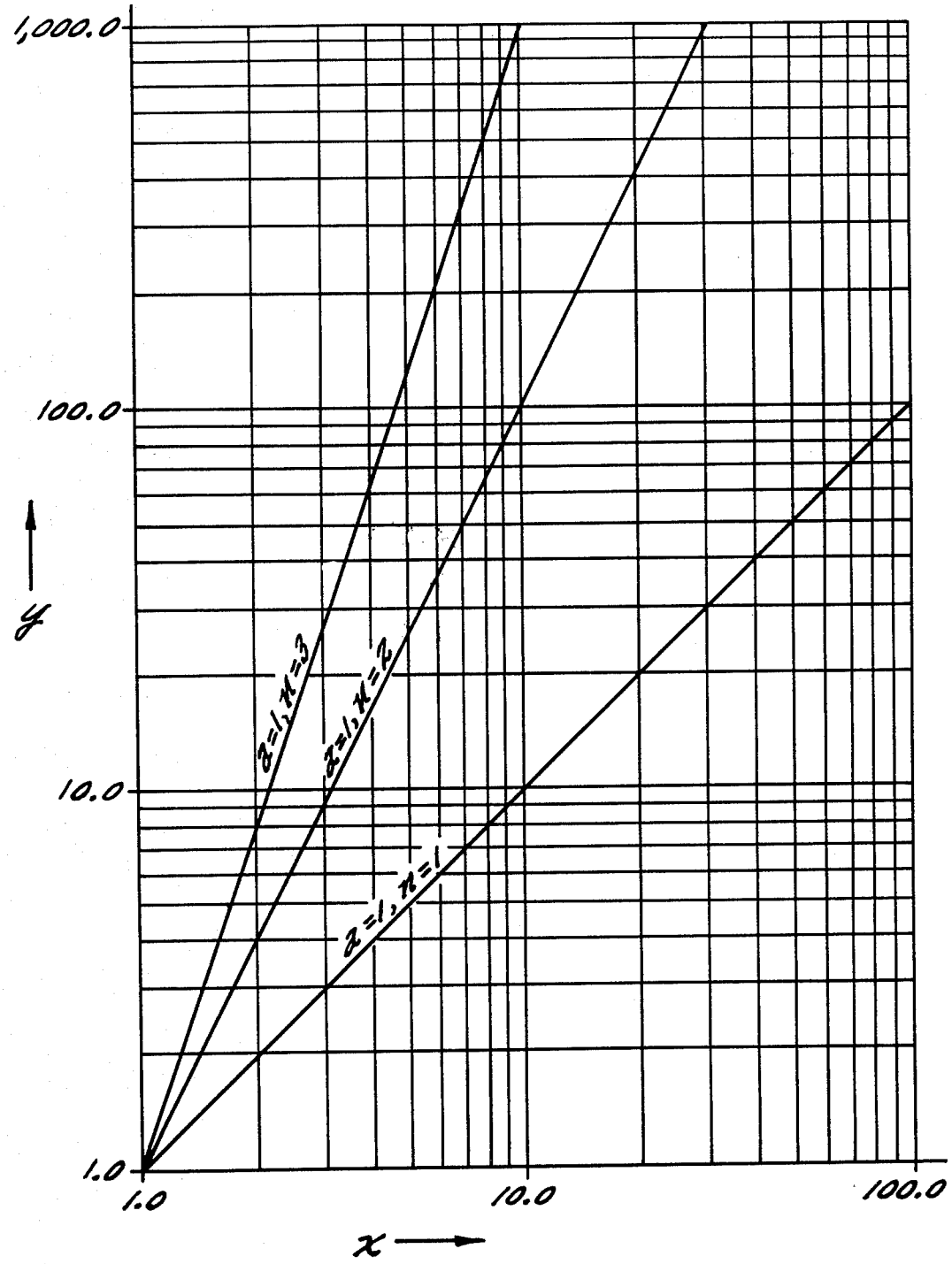
FIG. 4 is a graphical illustration of the same family of prabolic power functions shown in FIG. 3 but plotted on a log x-y coordinate system.

It is also known that the curves represented by Equation (3) are always straight lines in a log-log coordinate system, as can be seen from the equation:

$$\log y = a + n \log x \qquad (4)$$

where a=log a of curves defined by Equation (3) are illustrated in FIG. 4, which has log-log coordinates.

Thus, if Equations (1) and (2) above are generalized as $$R'=kF^b \tag{5}$$

such equation can be rewritten as $$\log R'k+b \log F \tag{6}$$

where K=log k.

If two specific points ($R'_1$, $F_1$) and ($R'_2$, $F_2$) on the log-log curve are known, Equation (6) yields the following two equations:

$$\log R'_1=k+b \log F_1 \tag{7}$$

$$\log R'_2=k+b \log F_2 \tag{8}$$

Equations (7) and (8) can then be solved for k and b, viz:

$$b = \frac{\log R'_2 - \log R'_1}{\log F_2 - \log F_1} \tag{9}$$

$$K = \log R'_1 - \log F_1 \frac{\log R'_2 - \log R'_1}{\log F_2 - \log F_1} \tag{10}$$

$$= \log R'_1 - b \log F_1$$

Then k is the antilog of k.

Thus it can be seen that Equations (9) and (10) can be used to determine the values of both b and k from only two points ($R'_1$, $F_1$) and ($R'_2$, $F_2$) on the curve defined by Equation (5). It is known that one point lies close to the origin (R'=0, F=0), and thus one point can be assumed to be represented by R' and F values close to zero, such as $R'_1=10^{-11}$ and $F_1=10^{-10}$. Consequently, knowledge of only one other data point ($R'_2$, $F_2$), e.g., determined from actual measurements, can be used to determine the values of b and k from:

$$b = \frac{\log R'_2 - \log 10^{-11}}{\log F_2 - \log 10^{-10}} = \frac{\log R'_2 - (-11)}{\log F_2 - (-10)} \tag{11}$$

$$K = \log 10^{-11} - \log 10^{-10} \frac{\log R'_2 - \log 10^{-11}}{\log F_2 - \log 10^{-10}} \tag{12}$$

$$= -11 + 10b$$

Again, k is the antilog of k. Consequently, the values of the coefficient k and the exponent b can be determined from a single set of data for the feed rate F and one of the radius reduction rates $R'_1$ or $R'_2$. For example, if a feed rate F of 0.1 inch/minute produces a wheel wear rate $R'_w$ of 0.05 inch/minute in a given grinding system, the value of the exponent b in the power function $R'_w=kF^b$ can be computed as follows:

$$b = \frac{\log R'_w + 11}{\log F + 10}$$

$$= \frac{\log 0.05 + 11}{\log 0.1 + 10}$$

$$= \frac{-1.30103 + 11}{-2 + 10}$$

-continued $$= 1.2123713$$

and the value of the coefficient k can be computed as the antilog of k which is:

$$K = -11 + 12.123713$$

$$= 1.123713$$

Of course, any measured value is accurate only within the limits of experimental error in taking the measurements, and thus it is normally preferred to use several sets of data (F, $R'_1$) or (F, $R'_2$) and then average the resulting values to minimize the effect of experimental errors.

The value of the radius reduction rate $R'_1$ or $R'_2$ used to compute k and b is usually not measured directly, but rather computed from successive measurements of the actual radius of one of the cylinders C1 and C2 using a gage. The actual rate $R'_1$ at which the radius $R_1$ is reduced, for example, can be expressed as $$R'_1 = \frac{\Delta R_1}{\Delta T} \tag{13}$$

where $\Delta R_1$ is the reduction in the workpiece radius in the time interval $\Delta T$. By repetitively measuring $\Delta R_1$ in successive time intervals $\Delta T$, and continually averaging the resulting values of $R'_1$ over the last N (e.g., 10) $\Delta T$'s, the value of $R'_1$ can be monitored with a high degree of accuracy.

From FIG. 2 it can be seen that in the steady state (i.e., ignoring deflection and springback of the cylinders, which occurs during acceleration and deceleration of F), the feed rate F will always be equal to the sum of the two radius reduction rates $R'_1$ and $R'_2$ or $$F=R'_1+R'_2 \tag{14}$$

Thus, the value of $R'_1$ determined from the gage measurements can be used to compute the value of $R'_2$ as $$R'_2=F-R'_1 \tag{15}$$

Consequently, the values of both the coefficients $k_1$ and $k_2$ and both the exponents a and b can be determined for Equations (1) and (2) above from a single measured data point ($F_1$, $R'_1$) or ($F_1$, $R'_2$).

The accuracy of the values determined for the coefficients and exponents depends not only on the accuracy with which the feed rates and radius reduction rates are determined, but also on the similarity of the materials and conditions in (1) the grinding operation in which measurements are taken to determine actual feed rate and radius reduction rate values to compute the coefficient and exponent values and (2) the grinding operation in which the computed coefficient and exponent values are later used. More specifically, the computed values of the coefficient and exponents will usually have the highest degree of accuracy when the two grinding operations involve the same workpiece and grinding wheel materials, the same grinding wheel radius, and the same relative surface velocity at the rubbing interface.

In accordance with the present invention, the basic power function relationships described above are used in a variety of different ways in the control of various grinding systems to (1) improve the accuracy of the grinding operation, (2) simplify and reduce the cost of the grinding system such as by eliminating the need for certain in-process gages, (3) maintain more precise control of the grinding operation, and/or (4) reduce the time required to carry out the grinding operation. Two specific examples of the invention as embodied in two different kinds of grinding operations will be described herein, but it will be recognized that there are almost as many different applications for this invention as there are different kinds of grinding operations. In general, most of these various applications of the invention involve the steps of (1) determining the exact nature of a power function relationship between (a) the rate at which material is removed from one of the surfaces at a rubbing interface and (b) the feed rate at which the rubbing surfaces are fed into each other, for a particular grinding operation, i.e., a particular grinding wheel and other specified conditions affecting the rate of material removal at the rubbing interface, and (2) controlling, measuring or setting the material removal rate or the feed rate in such a grinding operation in accordance with said power function relationship. These steps will be described in more detail in the context of the two specific Examples I and II set forth below.

Example I: An Improved Grinding Method Using Control of Wheel Slide Feed Rate to Maintain A Set Grinding Rate One useful application of the invention is in achieving and maintaining a desired grind rate by controlling the wheel slide feed rate in a manner which accurately anticipates, and compensates for, wheel wear. From Equation (14) above, it is known that the wheel slide feed rate $F_{ws}$ for a given grinding operation can be defined as the sum of the grinding rate $R'_p$ and the wheel wear rate $R'_w$:

$$F_{ws}=R'_p+R'_w \tag{16}$$

Thus, when the desired grinding rate $R'_{pd}$ is known for a particular workpiece, to be ground with a particular grinding wheel, the desired feed rate $F_{wsd}$ can be defined as $$F_{wsd}=R'_{pd}+R'_w \tag{17}$$

And since $R'_w=kF_{wsd}^b$ $$F_{wsd}=R'_{pd}+kF_{wsd}^b \tag{18}$$

The values of the coefficient k and the exponent b are predetermined from one or more actual data sets for the specific grinding operation in question, using Equations (11) and (12) written as:

$$b = \frac{\log R'_w + 11}{\log F_{ws} + 10} \tag{19}$$

$$K = -11 + 10\,b \tag{20}$$

The actual values of $R'_w$ and $F_{ws}$ used in Equations (19) and (20) can be derived from an experimental run of the grinding system in question, at an arbitrarily commanded feed rate $F_{ws}$. Using a workpiece gage, the reduction in workpiece radius $\Delta R_p$ can be measured over a known grinding time $\Delta T$, so that the grind rate $R'_p$ can be computed as $$R'_p = \frac{\Delta R_p}{\Delta T} \tag{21}$$

This permits the wheel wear rate $R'_w$ to be computed, viz:

$$R'_w=F_{ws}-R'_p \tag{22}$$

Equations (19) and (20) can then be used to compute the values of k and b, after which Equation (18) can be solved for $F_{wsd}$ as follows:

$$\log F_{wsd} = \log R'_{pd} + K + b \log F_{wsd} \tag{23}$$

$$\log F_{wsd}(1 - b) = \log R'_{pd} + K \tag{24}$$

$$\log F_{wsd} = \frac{\log R'_{pd} + K}{(1 - b)} \tag{25}$$

$$F_{wsd} = \text{antilog}\,\frac{\log R'_{pd} + K}{(1 - b)} \tag{26}$$

Thus, the exact value of the feed rate $F_{wsd}$ required to achieve the desired grinding rate $R'_{pd}$—with built-in compensation for the grinding wheel wear rate $R'_w$—can be accurately predetermined even before the grinding operation is started.

Futhermore, the desired grinding rate $R'_{pd}$ can be maintained throughout the grinding operation by simply energizing the wheel slide drive motor with a voltage that will sustain the corresponding slide feed rate $F_{wsd}$. There is no need for a feedback control loop to continually monitor and compensate for wheel wear rate, nor is there even any need for a gage to monitor the actual workpiece radius (and hence the actual grinding rate). Since the grinding rate will be accurately maintained at the desired level $R'_{pd}$ by simply controlling the wheel slide feed rate, the actual workpiece radius can be continuously "monitored" without the use of any gages. The initial workpiece radius $R_{po}$, prior to the start of grinding, is always known, and the rate at which the workpiece radius is reduced is the desired grinding rate $R'_{pd}$. Thus, the actual workpiece radius $R_p$ at any given time period T after the start of grinding can be defined as $$R_p=R_{po}-(R'_{pd})(T) \tag{27}$$

This value of $R_p$, which can be ascertained at any instant during a grinding operation, can be used for a variety of different purposes. For example, by continually comparing the current value of $R_p$ with the desired final radius $R_{pd}$ of the workpiece, the grinding operation can be terminated at precisely the desired final workpiece radius. The value of $R_p$ can also be continually compared with a set "changeover" radius at which it is desired to terminate rough grinding and initiate finish grinding, with appropriate control changes being made when that changeover radius is reached. As another example, the $R_p$ value can be used to control the rate at which the grinding wheel feed rate is decelerated as the desired final radius is approached.

The value of $R_p$ can be continually updated during a grinding operation by successively subtracting each incremental radius reduction ($R'_{pd}$) ($\Delta T$), in each $\Delta T$, from the workpiece radius in the preceding ΔT. That is, the workpiece radius $R_{pi}$ at the end of any given time increment $\Delta T_i$ can be defined as $$R_{pi}=R_{p(i-1)}-(R'_{pd})(\Delta T_i) \quad (28)$$

Normally the value of $(R'_{pd})(\Delta T)$ will be constant for all ΔT's, but the grinding rate $R'_p$ can change if the commanded wheel slide feed rate $F_{ws}$ is changed, in which event the new value of $R'_p$ will be known because it will have been used to determine the new $F_{ws}$ in the first place.

Although a workpiece gage is preferably used to determine one or more actual grinding rate values for the purpose of initially computing the values of the coefficient k and the exponent b, it is not necessary to have such a gage on all the grinding machines used in actual production. Many grinding operations are highly repetitious, using grinding wheels of the same material and the same initial size to grind the same kind of workpiece day after day. Thus, once the values of the coefficient k and the exponent b have been accurately determined for the grinding of one such workpiece with one such grinding wheel in a given set of grinding conditions, those values of k and b will normally have a high degree of validity for subsequent grinding operations of the same kind.

Even in situations where the values of the coefficient k and/or the exponent b vary over the course of one or more grinding operations—for example, due to the constantly reducing radius of the grinding wheel, which changes the relative surface velocity at the rubbing interface even though the rotational speed of the wheel is held constant—the changes in the values of k and b will also tend to be highly repetitious. A new grinding wheel with a diameter of 24 inches, for example, will normally be used until it has worn down to a diameter of about 10 inches; the values of k and b will change substantially over the course of such a size reduction in the grinding wheel, but they will usually change in a similar manner for similar wheels grinding similar workpieces under similar conditions. Thus, rather than using only a single set of predetermined values of k and b, and a corresponding single value of $F_{ws}$, several different values of k, b and $F_{ws}$ can be predetermined for successive stages in the life of the grinding wheel. For example, different k and b values, and thus a different $F_{ws}$ value, might be predetermined for each half-inch reduction in the radius of the grinding wheel.

In the case of grinding machines that are equipped with workpiece gages, new values of the coefficient k and the exponent b can be determined "on the fly" from Equations (19) and (20), using the current values of $F_{ws}$ and $R'_p$ in that particular grinding operation. Then the value of the wheel feed rate $F_{wsd}$ required to maintain the desired grinding rate $R'_{pd}$, at the current (reduced) wheel radius $R_w$, can be determined from Equation (28) using the new values of k and b.

Of course the radius of the grinding wheel is constantly reducing, as is the grinding rate, but if desired the control k system can be programmed to reset the values of k and b and the commanded feed rate $F_{wsd}$ only in response to grinding rate changes of a certain preselected magnitude.

One specific embodiment of the present invention in a grinding operation will be described in more detail using the diagrammatic illustration of FIG. 6. With the wheel 20 grinding on the part 24, the wheel is driven by the motor WM and the part is driven by the motor PM in order to create the relative rubbing contact of wheel face **20*b* and work surface 24*b*. The wheel slide WS is moved to the left by the motor WFM at a "feed rate" $F_{ws}$ proportional to the voltage $V_{wfm}$ to advance the wheel 20 steadily into the workpiece 24** as the radius of the latter is progressively reduced. When this is occurring, the feed rate $F_{ws}$ of the slide is equal to the sum of the rates $R'_p$ and $R'_w$ at which the workpiece and wheel radii are being reduced.

In the illustrative cylindrical grinding machine, the feeding motion of the wheel 20 is along a horizontal path parallel to a radius of the wheel extending through the region of rubbing contact. This is here called "infeeding". It is the only relative feed which is required for cylindrical grinding (although as an obvious equivalent the rotating wheel 20 could be bodily stationary and the workpiece 24 then bodily fed to the right), and it results in material being removed by abrasive action from the workpiece (as well as material being removed from the wheel due to wheel wear).

The preferred means for controlling the grinding apparatus of FIG. 6, using the control method described above, is a software-programmed digital minicomputer or microprocessor illustrated in FIG. 7 although it could, if desired, be implemented in an analog computer using d-c. voltages to indicate signal values, or as a hard-wired iterative computer programmed by its wiring connections. The internal construction details of digital minicomputers are well known to those skilled in the art, and any of a wide variety of such computers currently available in the United States market may be chosen.

By way of background, and as is well known, the computer includes a clock oscillator 70 (FIG. 7) which supplies pulses at a relatively high and constant frequency to a timing signal divider 71 which in turn sends timing signals to the other computer components so that elementary steps of fetching signals from memory, performing arithmetic operations, and storing the results are carried out in rapid sequence according to a stored master program of instructions. For this purpose, the computer includes an arithmetic-logic unit (ALU) 72 served by an input trunk 73. An accumulator 75 receives the output from ALU and transmits it over an output trunk 76. The output from the accumulator is sent back as an operand input to the ALU in certain arithmetic or comparing steps. These trunks are multiconductor wires which carry multi-bit signals representing in binary or BCD format numerical values of variables which change as a result of inputs from a tape reader 77 or computations performed by the ALU 72. The tape reader 77 is coupled to the computer via a decoder 78 and an input/output interface 79.

The computer includes signal storage registers within a system storage or "memory" 80 which functionally is divided into sections containing instruction units **80*a* and data units 80*b*, as explained more fully below. The memory registers in the instruction section 80*a*** are set by reading in and storage of a "master program" to contain multi-bit words of instruction which designate the operations to be performed in sequence, with logic branching and interrupts. The instruction memory contains the master program and sets up the gates and controls of the general purpose minicomputer to convert it into a special purpose digital control apparatus, the pertinent portion of that program being described hereinafter. Although a single minicomputer has been illustrated in FIG. 7 for carrying out all the functions needed to control the grinding machine of FIG. 6, it will be understood that these functions can be split among separate minicomputers arranged to share tasks by crosstalking through a common bus.

Since the organization and operation of the digital computer is well known, it will suffice to observe briefly that advancement of a program counter 81 to an address number will cause address selection and routing gates 82 to read the addressed memory instruction onto the input trunk 73 and into an instruction register 84. The operation code in the latter is decoded and sent to the ALU 72 to designate the operation to be performed next (e.g., add, subtract, complement, compare, etc.). It is herein assumed for ease of discussion that the ALU will algebraically add two operands unless instructed to subtract, multiply, divide, and so on. The data address in the instruction register is transferred to and conditions the storage address and routing gates 85 to fetch from memory the data word to be used next as an operand, the multi-bit signals being sent via the trunk 73 to the input of the ALU. At the conclusion of an arithmetic or logic sequence, the result or answer appears in the accumulator 75 and is routed via the trunk 76 through the gates 85 to an appropriate location or register in the memory 80. The gates 85 are controlled by the data address output of the instruction register, so that an answer is sent for storage to the proper memory location, replacing any numeric signals previously stored there.

FIG. 8 is an expanded diagrammatic illustration of the computer memory, with the pertinent storage registers or locations having acronym labels to make clear how certain signals are created and utilized. The program instruction section 80*a* contains a very large number of instruction words which are formulated to cause orderly sequencing through the master program, with branching and interrupts. To avoid a mass of detail and yet fully explain the invention to those skilled in the art, the pertinent program instructions are not labeled in FIG. 8 but are set out in flow charts to be described below.

As indicated in FIG. 8, the primary command signals in this particular example are labeled "XVC", "VPM", and "VWM". These three digital signals are passed through digital-to-analog converters 101, 102 and 103, respectively, to produce the three voltages $V_{wfm}$, $V_{pm}$, and $V_{wm}$ which drive the respective motors WFM, PM, and WM in FIG. 6. Thus, the command signals XVC, VPM, and VWM control the wheel slide feed rate $F_{ws}$, the rotational velocity $\omega_p$ of the workpiece 24, and the rotational velocity $\omega_w$ of the grinding wheel 20.

FIG. 8 also shows that the transducer signals XR, $\omega_p$, $\omega_w$, $R_p$ and $TOR_w$ from FIG. 6 are brought into the storage section 80*b* from the resolver 29, the tachometers 39 and 36, the gage 40, and the transducer 35, respectively. These analog signals are passed through respective analog-to-digital converters 104, 105, 106, 107 and 108 to produce corresponding digital signals labeled "XR", "PTV", "WHV", "GS" and TORW respectively. These signals are treated as if they came from storage units, and thus by appropriate instruction they can be retrieved and sent to the ALU 72.

The diagonal lines at the corners of certain rectangles in FIG. 8 are intended to indicate that the word stored and signled in that register is a predetermined numerical constant. Of course, the stored number or constant is readily adjustable by reading into the register a different value via a manual data input keyboard or as a part of the master program. As in the case of the transducer signals, these predetermined constant but adjustable signals can also be retrieved and sent to the ALU 72 by appropriate instructions.

The storage section 80*b* in the memory diagram in FIG. 8 contains means for producing various signals which are utilized and changed periodically, to the end objective of energizing correctly the three motors WFM, PM and WM of FIG. 6. Such means include memory or storage units which are identified by acronyms which signify not only the storage units but also the signals produced thereby. The quantity represented by the changeable number in any register may be represented by the same acronym, and these numbers can be changed in value by programmed computations or transfers effected by the ALU under control of the stored master program. The acronyms are too numerous to permit all of them to be identified in FIG. 8, but a complete listing is as follows (including signals used in Example II to be described below, even if not used in the present Example I):

PTRAD = $R_p$ = workpiece radius
PTRADD = $R_{pd}$ = desired final workpiece radius (after grinding)
KNORAD = known radius of master part
RADW = $R_w$ = grinding wheel radius
WWR = $R'_w$ = wheel wear rate
WWRG $R'_{wg}$ = wheel wear rate due to grinding
WWRT = $R'_{wt}$ = wheel wear rate due to truing
XAP = actual position of wheel face relative to rotational axis of workpiece, sometimes artificially adjusted by a quantity CORΔ to make distance from rotational axis of workpiece seem smaller than it actually is.
ΔXAP = change in XAP in ΔT
XR = resolver signal indicating actual position of wheel slide
XCEP = a commanded end position to which wheel face is to be moved
XCP = commanded position of wheel face relative to rotational axis of workpiece
XCPI = initial value of XCP
ΔX = the increment by which XCP is changed for each ΔT, i.e., the commanded wheel slide feed rate in inches per ΔT
RADERR = difference between actual workpiece radius PTRAD and XAP
CORΔ = sum of PFACTOR, IFACTOR and DFACTOR, used to artificially adjust XAP to compensate for wheel wear in PID servo control loop
XERR = difference between XCP and XAP
XVC = drive signal for wheel slide feed motor WFM
GX = preselected constant, but adjustable, signal representing proportional gain factor to be applied to XERR in deriving XVC
ΔT = iteration internal for the iterative control system
COUNT = number of ΔT's
GP = preselected constant, but adjustable, signal representing proportional gain factor to be applied to RADERR in deriving PFACTOR
GI = preselected constant, but adjustable, signal representing integral gain factor to be applied to RADERR in deriving IFACTOR
GD = preselected constant, but adjustable, signal representing derivatives gain factor to be applied to RADERR in deriving DFACTOR PFACTOR=proportional gain factor in PID servo loop controlling wheel slide motor WFM
IFACTOR=integral gain factor in PID servo loop controlling wheel slide motor WFM
DFACTOR=derivative gain factor in PID servo loop controlling wheel slide motor WFM
PTV=actual rotational velocity of workpiece
PTVD=desired rotational velocity of workpiece
PTVERR=difference between PTV and PTVD
VPM=drive signal for workpiece motor PM
GPV=preselected constant, but adjustable, signal representing gain factor to be applied to PTERR in deriving VPM
WHV=actual rotational velocity of grinding wheel
WHVD=desired rotational velocity of grinding wheel
WHVERR=difference between WHV and WHVD
VWM=drive signal for wheel motor WM
GWV=preselected constant, but adjustable signal, representing gain factor to be applied to WHVERR in deriving VWM
TRV=actual rotational velocity of truing roll
TRVD=desired rotational velocity of truing roll
VTM=drive signal for truing roll motor TM
RADT=$R_{te}$=truing roll radius
GAP=preselected constant, but adjustable, signal representing desired distance between truing roll face and grinding wheel face when truing roll is "following with a gap"
UFRA=commanded truing slide feed rate in inches per minute
SGV=preselected constant, but adjustable, signal representing the desired value of UFRA during movement of truing slide to establish GAP
CV=preselected constant, but adjustable, signal representing value used to derive the desired value of UFRA during advancement of the truing roll into engagement with the grinding wheel, and during retracting movement of truing roll
$\Delta$U=the commanded truing slide feed rate in inches per $\Delta$T
GU=preselected constant, but adjustable, signal representing gain factor to be applied to UERR in deriving UVC
UR=resolver signal indicating actual position of truing slide
UCEP=a commanded end position to which truing roll face is to be moved
MACHREF=a preselected constant, but adjustable, signal representing the distance between the rotational axis of the workpiece and the face of the grinding wheel when the wheel is engaging the reference limit switch XRLS and when the wheel has a selected radius (e.g., 12 inches)
TORW=$TOR_w$=torque exerted to drive grinding wheel
TORWI=initial value of TORW
TORTE=$TOR_{te}$=torque exerted to drive or brake the truing roll
REFCH=difference between XCPI and XCP
XSO=a preselected constant, but adjustable, signal representing distance between rotational axes of workpiece and grinding wheel when wheel is in reference position (engaging XRLS)
RETRP=a preselected constant, but adjustable, signal representing a "parked" position to which the grinding wheel is returned before the grinding of any new workpiece is started
DTG=the difference between the current workpiece radius PTRAD and the desired final radius PTRADD
DD=a preselected constant, but adjustable, signal representing a particular value of DTG at which a commanded event is to occur
GS=signal from gage 40
PTRADI=gage reference signal
XFRA=commanded wheel slide feed rate in inches per minute
FJOG=preselected constant, but adjustable, signal representing the desired value of XFRA during a "jogging" mode
FGAP=preselected constant, but adjustable, signal representing the desired value of XFRA during a "gap closing" mode when the wheel is being advanced into engagement with the workpiece
GR=preselected constant, but adjustable, signal representing the desired value of XFRA during a grinding mode
FGR=preselected constant, but adjustable, signal representing the desired value of XFRA during another grinding mode
FGRFIN=preselected constant, but adjustable, signal representing the desired value of XFRA during a finish grinding mode
FRT=preselected constant, but adjustable, signal representing the desired value of XFRA during return movement of the wheel to its "parked" position
STEA=actual value of the STE ratio
STED=desired value of the STE ratio
STERR=difference between STED and STEA
GT=preselected constant, but adjustable, signal representing gain factor to be applied to STERR in deriving VTM
MREF=a one-bit signal indicating whether or not the operator has actuated the "Machine Reference" switch
XRLS=a one-bit signal indicating whether or not the wheel slide is engaging the X-axis reference limit switch XRLS
PTREF=a one-bit signal indicating whether or not the operator has actuated the "Part Reference" switch The foregoing acronyms will be used hereinafter with various subscripts, suffixes and prefixes which are conventional and have readily apparent meanings. For example, the subscript i signifies the instantaneous value in the current iteration interval $\Delta$T, the subscript (i−1) signifies the value in the preceding interval $\Delta$T, etc. The suffix "AVG" or "AV" added to any of the acronyms indicates an average value of that quantity, usually an average of ten values for the last ten iteration intervals $\Delta$T, and the suffix "I" indicates an initial value of that particular quantity. The prefix "Z" added to any of the acronyms indicates a sum of several such values, usually the sum of the ten values measured or computed during the last ten iteratim intervals $\Delta$T.

In carrying out this particular embodiment of the invention, the minicomputer system of FIG. 7 is conditioned by a master program to constitute a plurality of means for performing certain functions and to carry out the method steps which are involved. The minicomputer system is not the only apparatus involved, however, since the resolver 29, the tachometers 36 and 39, the gage 40, the ADC converters 104–108, the DAC converters 101–103, and the motors WFM, PM and WM are all outside the computer system. With this in mind, a detailed understanding of this embodiment of the invention may best be gained from a narrative sequence of the operations which repeatedly recur, the pertinent sub-routines of the master program thereby being explained in detail with reference to the flow charts in FIGS. 10–16.

FIG. 10 illustrates a main program which the computer system follows while being interrupted at successive intervals for execution of the subroutines illustrated in FIGS. 12, 13, 14, 15 and 16. For example, the successive time periods ΔT measured off by the clock 70 and the timing signal generator 71 may be 40 milliseconds in duration. Within each such period, sub-periods are marked off by timing pulses so that a sub-routine may be executed during a fraction of every ΔT, although there will almost always be time remaining at the end of each such sub-period during which the system returns to the main program and proceeds therethrough. Thus, each sub-routine is executed once during each of the main iteration periods ΔT; e.g., every 40 ms. Computational step pulses typically appear every 20 microseconds, so that 2000 fetch, compute or store steps may be executed during each 40-ms interval. The various servo motors are preferably updated multiple times within each iteration interval ΔT, in accordance with the "micromove-macromove" system described in U.S. Pat. No. 3,656,124. The particular time periods mentioned here are exemplary only, and these periods can be chosen to have other specific values.

Referring now to FIG. 10, there is shown a main program which the system follows whenever power to the grinding machine is turned on. The first step 001 clears all flags in the system, after which step 002 produces a prompting message instructing the operator to enter the desired predetermined values for the various set points and constants required in later steps. This prompting message is typically displayed on the CRT 86 (FIG. 7) located adjacent the manual data input keyboard 87. The particular values that must be entered by the operator are those values contained in the rectangles with the diagonal corner lines in the memory diagram of FIG. 8. These values may be manually keyed into the memory 80, or they may be previously recorded on a tape and entered via the tape reader 77.

At step 003, the system produces another prompting message which instructs the operator to load a workpiece of known radius and to key-in the value KNORAD of that known radius. This workpiece of known radius is normally a "master" part which has been previously ground to a smooth surface finish, and whose radius has been precisely measured with a micrometer. As will be seen from the ensuing description, the use of such a "master" part is desirable because it permits the starting position of the grinding wheel to be known with a high degree of precision, and it also permits the starting radius of the grinding wheel to be accurately computed in those applications where it is necessary or desirable to know the wheel radius. Alternatively, for applications where such a high degree of precision is not required, the workpiece that is initially loaded into the machine may be the actual workpiece to be ground; although such a workpiece will have a rougher surface than a "master" part, and its starting radius will not be ascertainable with the same degree of precision as a "master" part, the degree of accuracy attainable by starting with such a rough part may be acceptable in a large number of applications.

At step 004, the system displays still another prompting message which instructs the operator to start the drive motors PM and WM which rotate the workpiece and the grinding wheel, respectively. Of course, as soon as these motors PM and WM are started, the subroutines to be described below for controlling the rotational velocities of these motors to drive the workpiece and the grinding wheel at the set point speeds will immediately take over control of the motors, supplying them with the voltage levels required to achieve and maintain the set point speeds.

At step 005, the system displays yet another prompting message which instructs the operator to "Perform Machine Reference", which the operator initiates by simply closing an "MREF" switch, which is one of the switches 87 indicated generally in FIG. 7 and typicilly located on the keyboard. This prompting message might be displayed before the operator has completed all the set-up steps indicated by the previous messages at steps 002, 003 and 004, and thus the system sustains the message to "Perform Machine Reference" until step 006 senses the closing of the "MREF" switch. When this switch is closed, the system proceeds to step 007 and sets a "Mode 1" flag MD1 which enables the X-axis subroutine of FIG. 11 to advance the wheel slide at a "jogging" feed rate FJOG whenever the operator closes a "JOG" switch, which is another one of the switches 87 in FIG. 7.

In mode 1, the wheel slide feed motor WFM is energized to move the wheel slide at the rate FJOG whenever the operator closes the "jog" switch, with the direction of movement depending upon whether the operator moves the "jog" switch to the "forward" position (producing a minus FJOG signal which causes the wheel slide to move toward the workpiece) or to the "reverse" position (producing a plus FJOG signal which causes the wheel slide to move away from the workpiece). Energization of the motor WFM to move the wheel slide at this rate, when the "jog" switch is closed, is effected by the X-axis subroutine of FIG. 11. That is, the axis of movement of the wheel slide is referred to herein as the "X-axis".

The X-axis subroutine of FIG. 11 begins at step 101 which samples a disabling flag DISABL. If this flag is off, the subroutine proceeds to step 102 which determines whether or not the mode 1 flag MD1 is on. If it is, the system proceeds to step 103 which determines whether or not the operator has closed the "jog" switch. If the answer is affirmative, the system sets a commanded feed rate XFRA (in inches/minute) equal to the jogging rate FJOG at step 104, and this commanded feed rate XFRA is then used at step 105 to determine the value of $\Delta X_i$, which is the commanded feed rate in inches/ΔT. That is, step 105 merely converts the commanded inches-per-minute signal XFRA to an inches-per-ΔT signal by dividing XFRA by 1500, because there are 1500 40-ms. ΔT's in each minute. In other words, $\Delta X_i$ represents the incremental distance through which the wheel slide must be advanced in one iteration interval ΔT of 40 ms in order to achieve the desired feed rate FJOG, which is keyed into the memory in units of inches per minute.

It will be helpful to note at this point that the different wheel slide feed rates required during the different modes of operation illustrated in FIG. 9 are achieved by simply changing the value of the commanded feed rate signal XFRA in the X-axis subroutine of FIG. 11. Changing the value of XFRA always results in a corresponding change in the value of $\Delta X_i$, which in turn changes the level of the energizing voltage $V_{wfm}$ supplied to the wheel slide feed motor WFM.

After the value of $\Delta X_i$ has been determined at step 105; the subroutine of FIG. 11 proceeds to step 106, where the resolver signal XR is read. This resolver signal represents the changing position of the output shaft of the motor WFM, and thus the change $\Delta XAP_i$ represented by the difference between each pair of successive readings $XR_i$ and $XR_{i-1}$ of the resolver signal represents the actual change in position of the wheel slide in the iteration interval between the readings $XR_i$ and $XR_{i-1}$. Thus, the signal $XAP_i$ representing the current actual position of the wheel slide can be continually updated by adding each new $\Delta XAP_i$ to the value of the previous position signal $XAP_{i-1}$, which is the second computation carried out at step 106 as illustrated in FIG. 11. The signal $XCP_i$ representing the current commanded position of the wheel slide is similarly updated in each iteration interval by adding the value $\Delta X_i$ to the previous commanded position signal $XCP_{i-1}$, which is the third computation carried out at step 106 as illustrated in FIG. 11. The fourth computation determines the value of an error signal $XERR_i$, which is the difference between the current commanded position signal $XCP_i$ and the current actual position signal $XAP_i$. This error signal $XERR_i$ is then used in the final computation of step 106, which computes the value of the voltage command signal $XVC_i$ to be converted by the DAC converter 101 to the drive voltage $V_{wfm}$ for the wheel slide feed motor WFM. As illustrated in FIG. 11, the value of this command signal $XVC_i$ is the value of the error signal $XERR_i$ multiplied by a keyed-in proportionality or gain factor GX.

When the "jog" switch is not closed—e.g., due to intermittent operation of the switch by the operator—step 103 produces a negative response which causes the system to set XFRA to zero at step 115. As will be appreciated from the foregoing description, the wheel slide feed motor WFM will be de-energized, thus simply holding the wheel slide at a fixed position, as long as XFRA is zero.

It can be noted here that the computations just described as being carried out at step 106 are the same whenever the wheel slide feed motor WFM is energized in any of the modes 1, 3, 4, 5, 6 or 7. The value of $\Delta X_i$ changes depending upon the mode in which the system is operating at any given instant and, as indicated previously, this change in the value of $\Delta X_i$ is effected by simply changing the value of the commanded feed rate signal XFRA.

Returning now to the main program in FIG. 10, after the mode 1 flag MD1 has been set at step 007, the system proceeds to step 008 which displays another prompting message to the operator, this time instructing the operator to "jog until XRLS is closed". It will be recalled that XRLS is the limit switch which establishes the retracted reference position of the wheel slide, and when the wheel slide is in this reference position the distance from the rotational axis of the workpiece to the rotational axis of the grinding wheel is a known value represented by the signal XSO. In response to the prompting message at step 008, the operator proceeds to use the "jog" switch to retract the wheel slide until it closes the limit switch XRLS, which is sensed at step 009 and results in the setting of the flag DISABL at step 010. It is this flag DISABL which is read at step 101 of the X-axis subroutine of FIG. 11, and when this flag is set the system immediately exits the X-axis subroutine at step 108 and returns to the main program. This ensures that the wheel slide feed motor is de-energized when the switch XRLS is closed, even if the operator accidentally keeps the "jog" switch closed.

With the wheel slide now in its retracted reference position, the system proceeds to step 011 which sets the starting values of the actual wheel slide position signal XAP and the commanded wheel slide position signal XCP equal to the keyed-in value MACHREF, and it also sets the value of the initial commanded position signal XCPI equal to the same value. The value of MACHREF represents the distance from the rotational axis of the workpiece to the face of a grinding wheel which has a starting radius of a preselected value, e.g., 12 inches, which is normally selected to be the radius of the largest wheel that might be used in the machine. If the wheel actually has a smaller radius, of course the starting values of XAP and XCP must be adjusted accordingly, in a manner to be described below.

From step 011, the system proceeds to step 012 which clears the flag DISABL, after which another prompting message is displayed at step 013, instructing the operator to "jog wheel to kiss known part". The operator thus proceeds to use the "jog" switch again, this time slowly advancing the grinding wheel until it just lightly engages the workpiece. As can be seen in FIG. 9, this is still part of mode 1, i.e., the flag MD1 is still on, and thus the subroutine of FIG. 11 still sets the commanded feed rate XFRA at the "jogging" rate FJOG, though this value FJOG will now be negative because the operator will be moving the "jog" switch to the "forward" position. During the advancing jogging movement of the wheel slide, the values of XAP and XCP, which were both initially set at the value of MACHREF at step 011, are continually changed at step 106; that is, in each $\Delta T$ of jogging movement, XCP is changed by the value of $\Delta X$, and XAP follows with the same change due to the changing resolver signal XR as the wheel slide is advanced in response to the changes in XCP.

The operator is next instructed to "perform part reference", which is the promting message displayed at step 014. The operator initiates this procedure by simplying closing a "PTREF" switch, which is another one of the switches 87 in FIG. 7. Step 015 of the main program senses when the PTREF switch is closed, maintaining the prompting message at step 014 in the meantime, and clears the flag MD1 when closure of the PTREF switch is detected. This is the end of mode 1.

Immediately after clearing the flag MD1, the system sets the flag DISABL at step 017, and then sets the "mode 2" flag MD2 at step 020. In mode 2, the wheel slide feed motor WFM is disabled while the system (1) adjusts the values of both XCP and XAP to the value of the signal KNORAD representing the known radius KNORAD of the master workpiece and (2) computes the actual value of the initial wheel radius RADW by subtracting (a) the known workpiece radius KNORAD and (b) the distance REFCH traversed by the wheel slide during its advancing movement, from (c) the original distance XSO between the rotational axes of the workpiece and the grinding wheel. As indicated at step 021 in FIG. 10, which is the step at which the mode 2 operations are performed, the value of REFCH is computed as the difference between the final value of XCP at the end of mode 1, when the wheel first engages the workpiece, and the initial value XCPI set at step 011 when the wheel was in its retracted reference position.

The value XSO is one of the keyed-in constants stored in the memory and represents the distance between the rotational axes of the workpiece and the grinding wheel when the grinding wheel is in its retracted reference position set by the closing of the reference limit switch XRLS. This distance XSO is the sum of three dimensions, namely, the known radius KNORAD of the master workpiece, the starting wheel radius RADWI, and the original gap REFCH between the faces of the workpiece and the grinding wheel with the grinding wheel in its retracted reference position. Thus, by subtracting two of these dimensions, namely the original gap REFCH and the known workpiece radius KNORAD, from XSO, the remaining value represents the actual initial radius RADWI of the grinding wheel. Also, it is known at this point that the distance between the grinding wheel face and the rotatational axis of the master workpiece is exactly equal to the known radius KNORAD of the master workpiece, and thus the values of the signals XAP and XCP representing the actual and commanded positions of the grinding wheel face should both be exactly the same as the value of KNORAD. Thus, XAP and XCP are both initialized at this value. Finally, a gage reference signal PTRADI is set equal to the known workpiece radius KNORAD being read by the gage at this time.

This is the end of mode 2, which completes the "set up" procedure, and the main program proceeds to step 022 which clears the flag MD2 and again clears the flag DISABL. The system then proceeds to step 023 where a "mode 7" flag MD7 is set. In this mode, which is repeated at the end of the grinding of each workpiece (see FIG. 9), the grinding wheel is retracted from its known position XAP=KNORAD to a predetermined "parked" position so that the operator has enough room to remove the master workpiece and insert the actual workpiece to be ground. This actual workpiece will, of course, usually have a radius slightly different from that of the master workpiece, but the actual position of the face of the grinding wheel relative to the rotational axis of the workpiece is still precisely known because all movements of the wheel from its known starting position XAP=KNORAD are continually measured by monitoring the resolver signals XR and updating the value of the actual position signal XAP.

In order to retract the grinding wheel to the predetermined "parked" position, step 024 of the main program sets a commanded wheel slide "end point" position XCEP for the desired park position which is represented by the keyed-in value RETRP. Retracting movement of the wheel slide is effected by the X-axis subroutine of FIG. 11 which in mode 7 proceeds through steps 101, 102, 109, 110, 111, 112, and finally detects the presence of the flag MD7 at step 113. The subroutine then proceeds to step 114 which sets the commanded feed rate signal XFRA equal to a keyed-in value FRT representing the desired velocity of the wheel slide during retracting movement of the grinding wheel to the "parked" position. As described previously, the value of XFRA determines the actual rate of movement of the wheel slide by determining the value of $\Delta X_i$ at steps 105 and 106.

Step 025 of the main program senses when the grinding wheel has reached the desired "parked" position by detecting when the difference between the set "end point" position XCEP and the current commanded position $XCP_i$ is less than the value of $\Delta X_i$. When the answer at step 025 is affirmative, the system sets the value of the commanded position signal $XCP_i$ for step 106 of the subroutine of FIG. 11 equal to the value of the "end point" position signal XCEP, which causes the retracting movement of the wheel slide to be terminated at the position represented by XCEP, which is the desired "parked" position represented by the keyed-in value RETRP. The main program then clears the flag MD7 at step 027, thereby ending mode 7, and proceeds to step 028 where another prompting message is displayed for the operator, this time instructing the operator to "turn off part motor and load unground workpiece".

After an appropriate delay, allowing time for the operator to load the actual workpiece to be ground, the system proceeds to step 029 which displays another prompting message, instructing the operator to "start workpiece motor and perform cycle start." The "cycle start" operation by the operator, which initiates the actual grinding of the workpiece, is accomplished by simply closing a "cycle start" switch, which is another one of the switches 87 in FIG. 7. Step 030 of the main program senses when the operator has closed the "cycle start" switch, and then proceeds to set the "mode 3" flag MD3 at step 031. This initiates mode 3, in which the wheel slide is advanced from its "parked" position into "kissing" engagement with the workpiece to initiate grinding.

When the "mode 3" flag MD3 is on, the X-axis subroutine of FIG. 11 produces an affirmative response at step 109 and proceeds to step 116 which sets the commanded feed rate signal XFRA equal to a keyed-in value FGAP representing the rate at which it is desired to advance the grinding wheel into engagement with the workpiece. Here again, setting the commanded feed rate XFRA equal to the desired value automatically determines the wheel slide feed rate by determining the value of $\Delta X_i$ at steps 105 and 106 of the X-axis subroutine.

Steps 031*a* and 032 of the main program sense when the grinding wheel engages the workpiece. This is accomplished by setting the value of an "initial wheel torque" signal TORWI equal to the value of the current signal TORW received from the torque transducer 35 via the ADC 112, at step 031*a*. At this point, of course, the grinding wheel has no load on it, and thus the value of the signal TORW is relatively low. From step 031*a*, the main program advances to step 032 which senses when the actual grinding wheel torque $TORW_i$ exceeds a predetermined multiple, e.g., 1.3, of the initial wheel torque TORWI. When an affirmative response is produced at step 032, it is known that the grinding wheel has been brought into grinding contact with the workpiece, and the main program proceeds to step 033 where mode 3 is terminated by clearing the flag MD3. Mode 4 is then initiated at step 034 where a "mode 4" flag MD4 is set.

The clearing of the flag MD3 and the setting of the flag MD4 causes the X-axis subroutine of FIG. 11 to produce a negative response at step 109 and an affirmative response at step 110 in the next iteration cycle. The affirmative response at step 110 causes the subroutine to proceed to step 117 where the commanded feed rate signal XFRA is set at a keyed-in value GR representing the desired grind rate. It should be pointed out that setting the commanded feed rate signal equal to the desired grind rate will not actually effect grinding at the desired rate GR because no allowance has been made for wearing of the grinding wheel. However, this feed rate is used during mode 4, which is very short, simply for the purpose of establishing a known feed rate which can be used long enough to take the measurements needed to compute the actual values of the coefficient k and the exponent b in the power function relationship described previously. More specifically, the values needed to compute k and b are the actual grinding rate and the actual feed rate, both of which are averaged over a period of ten ΔT's to obtain more reliable values. The subroutine for obtaining the values needed for the computation of k and b, and actually carrying out these computations, is illustrated in FIG. 12.

Referring to FIG. 12, when the flag MD4 is set, the initial step 201 of this subroutine produces an affirmative response and proceeds to step 202 which determines whether or not a flag C150 has been set. The purpose of this flag C150 is to delay the measurements needed for the computation of b and k until the end of an initial delay interval, arbitrarily selected to be equal to 150ΔT's, which allows time for the newly initiated grinding operation to stabilize. As long as a negative response is produced at step 202, the subroutine proceeds to step 203 which determines when the value of a signal COUNT, representing the number of time periods ΔT elapsed following the setting of the flag MD4, reaches 150. As long as the answer at step 203 is negative, the subroutine proceeds to step 204 which increases the value of COUNT by one for each successive iteration interval ΔT. When 150 ΔT's have been counted, step 203 produces an affirmative response which sets the flag C150 at step 205 and resets COUNT to zero at step 206.

The subroutine of FIG. 12 now proceeds to step 207 which begins the counting of ten ΔT's, during which the particular values needed to compute b and k are measured ten times and averaged. During the ten ΔT's, step 207 produces a negative response and proceeds to step 208 which increases the value of COUNT by one for each successive ΔT, and then proceeds to step 209 which reads the value GS of the gage signal from the ADC 107 which is monitoring the actual radius of the workpiece. Step 210 updates a running average of the value GS and stores each new average value as $GS_i$.

Before grinding is started, the workpiece gage 40 is adjusted so that its output signal GS is zero, i.e., a GS value of zero corresponds to the starting gage reference value PTRADI. Thus, as the absolute value of the gage signal GS increases from zero, that value actually represents the reduction in the workpiece radius due to grinding. At step 211 in FIG. 12, the actual workpiece radius $PTRAD_i$ during grinding is determined by substracting the absolute value of the gage signal $GS_i$ from the starting gage reference value PTRADI. The actual change $\Delta PTRAD_i$ in the workpiece radius in each iteration interval ΔT is also determined at step 211 by subtracting each new workpiece radius value $PTRAD_i$ from the corresponding value $PTRAD_{i-1}$ for the immediately preceding iteration interval. A running total $\Sigma\Delta PTRAD_i$ of these incremental changes $\Delta PTRAD_i$ in the workpiece radius is maintained by adding each new incremental change $\Delta PTRAD_i$ to the total $\Sigma\Delta PTRAD_{i-1}$ of all the preceding incremental changes, producing a continually updated cumulative total $\Sigma\Delta PTRAD_i$, as indicated in FIG. 12. A similar running total $\Sigma\Delta XAP_i$ of the incremental changes $\Delta XAP_i$ in the wheel slide position is also maintained at step 211 by adding each new incremental change $\Sigma XAP_i$ to the total $\Sigma\Delta XAP_{i-1}$ of all the preceding incremental changes, producing a continually updated cumulative total $\Sigma\Delta XAP_i$.

Steps 208 through 211 are iterated for ten ΔT's, after which step 207 produces an affirmative response which causes the system to proceed to step 212 where the value of COUNT is again reset to zero. The system then proceeds to step 213 where the values of k and b are computed and then used to compute the value of a new feed rate FGR which will achieve the desired grinding rate GR while compensating for wheel wear.

The first computation carried out at step 213 determines the value WWR of the wheel wear rate during the preceding ten ΔT's. This value WWR is simply the difference between the actual wheel slide feed rate represented by the cumulative total $\Sigma\Delta XAP_i$ and the actual grind rate represented by the cumulative total $\Sigma\Delta PTRAD_i$, all of which are in units of inches per 10 ΔT. The value of the exponent b is then computed from WWR and $\Sigma\Delta XAP_i$ (each multiplied by 150 to convert inches/10ΔT to inches/minute) using Equation (19) described above, as rewritten at step 213 in FIG. 12. The value of the coefficient k is then computed from b, using Equation (20) described above, again as rewritten at step 213. Finally, the values of b, k and the desired grind rate GR are used to compute the desired feed rate FGR using Equation (26) described above and rewritten at step 213. This feed rate FGR will achieve the desired grind rate GR while at the same time compensating for wheel wear, as discussed previously.

From step 213, the subroutine of FIG. 12 proceeds to step 214 which resets all the values $\Delta PTRAD_i$, $\Sigma\Delta PTRAD_i$ and $\Sigma\Delta XAP_i$ to zero, and then step 215 which clears the flag MD4 before returning to the main program at step 216. This is the end of mode 4.

The foregoing description of the subroutine of FIG. 12 assumes that the grinding machine is equipped with a workpiece gage and that the starting values of the exponent b and the coefficient k are determined at the start of an actual grinding operation, i.e., in mode 4. As an alternative, however, the values of b and k may be predetermined in a preliminary test run on the same or a similar grinding machine, using a similar test workpiece. The subroutine set forth in FIG. 12 will be essentially the same regardless of which procedure is followed. As still another alternative, the steps set forth in the subroutine of FIG. 12 may be carried out manually or with other kinds of apparatus, such as analog circuits, if desired.

Returning again to the main program in FIG. 10, clearing of the flag MD4 is detected at step 035, which immediately sets the "mode 5" flag MD5. This causes the X-axis subroutine of FIG. 11 to produce a negative response at step 110 and an affirmative response at step 111, which results in a resetting of the value of the commanded feed rate signal XFRA to the newly computed value FGR at step 118. This feed rate value FGR is then used as the commanded wheel slide feed rate value for the balance of the rough grinding operation, which is mode 5 in FIG. 9. As rough grinding proceeds, step 119 of the X-axis subroutine continues to update the value of the actual workpiece radius $PTRAD_i$ by subtracting an increment GR/1500 (inches/ΔT removed from the workpiece radius) from the previous value $PTRAD_{i-1}$ of the workpiece radius in each iteration interval ΔT. As mentioned previously, the computed wheel value FGR for the commanded feed rate signal XFRA ensures that grinding will proceed at the desired rate GR, which is expressed in units of inches per minute, and thus by subtracting this incremental radius reduction GR/1500 from the previous value $PTRAD_{i-1}$ of the workpiece radius in each ΔT, an accurate value of the current workpiece radius $PTRAD_i$ is continuously maintained.

Step 119 of the X-axis subroutine uses the current value $PTRAD_i$ of the workpiece radius to compute the value of a signal $DTG_i$ representing the remaining distance to go to the desired final workpiece radius PTRADD. More specifically, the remaining distance to go $DTG_i$ is computed as the difference between the desired final workpiece radius PTRADD and the current workpiece radius $PTRAD_i$. This "distance to go" value $DTG_i$ is used to determine when the transition should be made from rough grinding to finish grinding. As mentioned previously, finish grinding is usually carried out at a slower feed rate, and in some applications it is also desirable to change other parameters during the finish grinding stage. In the present example, however, it will be assumed that the only parameter changed for finish grinding is the wheel slide feed rate.

In the present example, rough grinding is terminated, and finish grinding initiated, when the "distance to go" signal $DTG_i$ reaches a value DD which is keyed in by the operator as one of the preselected constants. When the value of $DTG_i$ is reduced to DD, this condition is detected at step 037 of the main program, which then clears the flag MD5 at step 038 and sets a "mode 6" flag MD6 at step 039. This causes the X-axis subroutine of FIG. 11 to produce a negative response at step 111 and an affirmative response at 112, which in turn causes the commanded feed rate signal XFRA to be set to a value FGRFIN representing a desired finish grind feed rate, at step 120. This finish grind feed rate value FGRFIN is computed by the subroutine of FIG. 13, which is also used to update the rough grind feed rate value FGR periodically throughout the grinding operation. As described previously in this specification, the actual values of the coefficient k and the exponent b in the power function equation can change during a grinding operation due to changes in the grinding wheel radius or other grinding parameters. In the subroutine as set forth in FIG. 13, the values of b and k are updated at intervals of 100 ΔT's throughout the grinding operation. During rough grinding the new values of b and k are used to update the rough grind feed rate value FGR, and during finish grinding the new values of b and k are used to update the finish grind feed rate value FGRFIN.

Referring now to FIG. 13, the first step 300 of this subroutine determines whether either flag MD5 or flag MD6 has been set, because it is only during the grinding modes 5 and 6 that it is desired to periodically recompute the values of b and k. If either of the flags MD5 or MD6 has been set, the subroutine proceeds to step 301 which determines whether or not a flag C100 has been set. The purpose of this flag C100 is to delay each recomputation of b and k until the end of each 100−ΔT time interval. As long as a negative response is produced at step 301, the subroutine proceeds to step 302 which determines when the value of the signal COUNT reaches 100. As long as the answer at step 302 is negative, the subroutine proceeds to step 303 which increases the value of COUNT by 1 for each successive iteration interval ΔT. When 100 ΔT's have been counted, step 302 produces an affirmative response which sets the flag C100 at step 304 and resets COUNT to zero at step 305.

The subroutine of FIG. 13 now proceeds to step 306 which begins the counting of ten ΔT's, during which the particular values needed to compute b and k are measured ten times and averaged. During the ten ΔT's, step 306 produces a negative response and proceeds to step 307 which increases the value of COUNT by 1 for each successive ΔT, and computes running values of $\Delta PTRAD_i$, $\Sigma\Delta PTRAD_i$ and $\Sigma\Delta XAP_i$. As indicated at step 307, these computations are identical to those performed at step 211 of the subroutine of FIG. 12 described above.

Step 307 is iterated for ten ΔT's, after which step 306 produces an affirmative response which causes the system to proceed to step 308 where the value of COUNT is again reset to zero. The system then proceeds to step 309 where the values of WWR, b and k are computed in exactly the same manner in which these computations are performed at step 213 of the subroutine of FIG. 12 described above, using the equations which have been rewritten at step 309 in FIG. 13. From step 309, the system proceeds to step 310 which determines whether or not the flag MD5 is on. If the answer is "yes", the system advances to step 311 where a new value FGR is computed using the same equation used to arrive at the original value, at step 213 of the subroutine of FIG. 12, but with the new values of b and k computed at step 309. This new value of FGR will then be used as the new value for the commanded feed rate signal XFRA at step 118 of the X-axis subroutine in the next 100 ΔT's.

From step 311, the subroutine of FIG. 13 proceeds to step 313 which resets all the values $\Delta PTRAD_i$, $\Sigma\Delta PTRAD_i$ and $\Sigma\Delta XAP_i$ to zero, and then step 314 which returns to the main program.

If a negative response is produced at step 310, it means that the system is in mode 6, because the subroutine of FIG. 13 never proceeds past step 300 unless the system is in either mode 5 or mode 6. It will be recalled that mode 6 is the finish grinding mode. When the system is in this mode 6, resulting in a negative response at step 310, the subroutine of FIG. 13 proceeds to step 312 where the value FGRFIN is computed using Equation (26) described above (as rewritten at step 312), the values of b and k computed at step 309, and the keyed-in finish grind rate value GRFIN. The resulting feed rate value FGRFIN, when used in the X-axis subroutine of FIG. 11, will produce the desired finish grind rate GRFIN while at the same time compensating for wheel wear, as discussed previously.

During the finish grinding mode 6, the system continues to update the actual workpiece radius value $PTRAD_i$ in each ΔT by subtracting the value of the ratio GRFIN/1500 from the value of the workpiece radius $PTRAD_{i-1}$ in the last ΔT. This computation is performed at step 121 in the subroutine of FIG. 11, and is based on the same rationale described above for the computation of PTRADi at step 119 in mode 5. The continually updated value $PTRAD_i$ of the actual workpiece radius is used to determine when finish grinding should be terminated, by determining when the actual workpiece radius value $PTRAD_i$ has been reduced to the desired final workpiece radius value PTRADD. This comparison is carried out at step 040 of the main program, and when this step produces an affirmative answer, the flag MD6 is immediately cleared at step 041. The main program then proceeds to step 042 which returns to step 023 where the flag MD7 is set. Thus, mode 6 is terminated, and mode 7 is re-entered.

When the flag MD7 is set, the X-axis subroutine of FIG. 11 again proceeds to step 113 which, as already described above, causes the wheel slide drive motor WFM to retract the grinding wheel to its "parked" position. Thus, the system is ready for a new workpiece to be inserted by the operator, as prompted by the message displayed to the operator at step 028 of the main program. When the operator is ready to start grinding the new workpiece, he once again closes the "cycle start" switch to set the flag MD3 at step 031 of the main program.

When none of the mode flags sensed by the X-axis subroutine of FIG. 11 is set, this subroutine produces a series of negative responses at steps 102, 109, 110, 111, 112 and 113, thereby causing the subroutine to proceed to step 122 where the value of $\Delta X_i$ is set to zero. This de-energizes the wheel slide drive motor WFM until one of the mode flags is again set.

It will be recalled that the operator was originally prompted to start the workpiece drive motor PM and the grinding wheel drive motor WM at step 004 of the main program. The subroutines for producing the command signals VPM and VWM for controlling the driving voltages $V_{pm}$ and $V_{wm}$ for the two motors PM and WM are illustrated in FIGS. 14 and 15, respectively. Turning first to FIG. 14, which is the subroutine for controlling the workpiece drive motor PM, the first step 400 of this subroutine reads the value of the signal PTV which is the digital counterpart of the analog signal $\omega_p$ received from the workpiece tachometer 39 via the ADC 105. This signal PTV represents the actual speed of the workpiece at any given instant. Step 401 computes and stores a running average PTVAVG of the speed signal PTV over, for example, the last ten $\Delta T$'s. This is a conventional averaging technique well known to those skilled in the art, and can be performed, for example, by a "stacking" procedure which continuously stores the latest 10 readings, adding the new value $PTV_i$ and discarding the oldest value $PTV_{i-10}$ in each $\Delta T$. The ten values stored at any given time are summed and divided by ten to provide the desired average value PTVAVG. This averaging procedure is used simply to enhance the reliability of the value of PTVAVG by using a running average of the last ten signal values rather than relying on the single value of only the latest signal.

At step 402, the subroutine of FIG. 14 computes an error signal $PTVERR_i$ as the difference (if any) between the keyed-in set point speed value PTVD (in rpm) and the latest average value $PTVAVG_i$. This error signal $PTVERR_i$ is then used to effect any adjustment required in the command signal VPM which controls the driving voltage $V_{pm}$ supplied to the drive motor PM. More specifically, the error signal $PTVERR_i$ is used to make an integrating correction by multipying it by a proportionality or gain factor GPV (one of the keyed-in constants), and then adding the resulting product to the value of the command signal $VPM_{i-1}$ for the previous $\Delta T$. The resulting new value $VPM_i$ of the command signal will tend to restore the actual workpiece speed PTV to the set point speed PTVD. The command signal will remain at this new value, holding the actual workpiece speed at the set point speed, unless and until there is a further deviation of the actual speed from the set point speed. Step 503 of this subroutine returns the system to the main program.

The "VWM" subroutine of FIG. 15, for controlling the grinding wheel drive motor WM, is similar to the subroutine of FIG. 14 which has just been described. Thus, the first step 500 of the VWM subroutine reads the value of the actual wheel speed signal WHV from the tachometer 36 and the ADC 106. A running average WHVAVG of the actual speed signal WHV is computed and stored at step 501 and used at step 502 to compute an error signal $WHVERR_i$. This error signal is the difference between the keyed-in set point speed value WHVD (in rpm) and the current average value $WHVAVG_i$, and is used to effect any adjustment required in the command signal VWM to hold the actual wheel speed at the set point speed. More particularly, the error signal $WHVERR_i$ is multiplied by a keyed-in gain factor GWV, and the resulting product is added to the previous value $VWM_{i-1}$ of the command signal to produce a new command signal value $VWM_i$. The final step 503 returns the system to the main program.

Example II: An Improved Grinding Method Using Simultaneous Truing And Grinding With STE Control One of the most useful applications of the invention is in a grinding system which involves two or more simultaneous rubbing interfaces with a single grinding wheel, such as the simultaneous truing and grinding operation described in my co-pending application identified above. Even though the grinding wheel in such a system is worn down simultaneously at two different rubbing interfaces, the power function equations permit the radius reduction rate for each of the four rubbing surfaces to be separately determined. As will be described in more detail below, this knowledge of the individual radius reduction rates for each of the four surfaces is invaluable in achieving the desired results in a simultaneous truing and grinding operation, particularly when STE is used as a primary control parameter.

Figure 5:
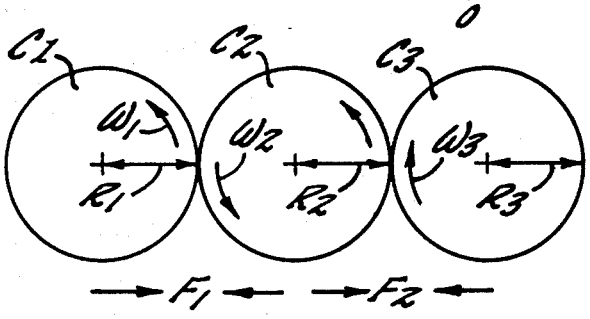
FIG. 5 is a schematic illustration of three rotating cylinders with each of the two end cylinders in rubbing contact with the center cylinder, the cylinders being fed into each other at the two rubbing interfaces at feed rates F1 and F2, respectively.

To facilitate an understanding of the simultaneous truing and grinding operation to be described in detail later, it will be helpful to discuss the simplified illustration of three rotating cylinders C1, C2 and C3 in FIG. 5. Cylinders C1 and C2 are the same as shown in FIG. 2, but a third rotating cylinder C3 has been added to establish a second rubbing interface with the middle cylinder C2. Cylinders C1 and C2 are fed into each other at a rate F1, and the cylinders C2 and C3 are fed into each other at a rate F2. With the two rubbing interfaces, there are now four different radius reduction rates which can be identified as follows:

$R'_1$ = rate of reduction of C1 radius at interface C1, C2
$R'_2$ = rate of reduction of C2 radius at interface C1, C2
$R'_3$ = rate of reduction of C2 radius at interface C2, C3
$R'_4$ = rate of reduction of C3 radius at interface C2, C3

The power function relationships between each of these removal rates and the respective feed rates F1 and F2 for the two interfaces C1, C2 and C2, C3 can be defined by the following equations:

| Interface C1,C2 | | Interface C2,C3 | | |
|---|---|---|---|---|
| Cylinder C1 | Cylinder C2 | Cylinder C2 | Cylinder C3 | |
| $R'_1 = k_1F_1^a$ | $R'_2 = k_2F_1^b$ | $R'_3 = k_3F_2^c$ | $R'_4 = k_4F_2^d$ | (29–32) |

It will be apparent from the discussion thus far that similar power function equations could be written for any desired number of rubbing interfaces, whether on a common cylinder or on multiple cylinders. And, as described above in connection with FIG. 2, the values of the various coefficients and exponents will change with changes in the grinding conditions such as relative surface velocities, cylinder radii etc.

For a simultaneous truing and grinding operation involving a workpiece with a radius $R_p$, a grinding wheel with a radius $R_w$ and fed into the workpiece at a rate $F_w$, and a truing roll with a radius $R_{te}$ and fed into the grinding wheel at a rate $F_t$, these equations become:

| Grinding Interface | | Truing Interface | | |
|---|---|---|---|---|
| Workpiece | Grinding Wheel | Grinding Wheel | Truing Roll | |
| $R'_p = k_1F_w^a$ | $R'_{wg} = k_2F_w^b$ | $R'_{wt} = k_3F_t^c$ | $R'_{te} = k_4F_t^d$ | (33–36) |

It should be noted that the truing roll feed rate $F_t$ in the above equations is not the same as the truing slide feed rate $F_{ts}$. The truing slide must be advanced at a rate $F_{ts}$ that is equal to the sum of not only the two radius reductions taking place at the truing interface, but also the reduction in the radius of the grinding wheel effected at the grinding interface. That is:

$$F_{ts}=R'_{te}+R'_{wt}+R'_{wg} \tag{37}$$

The effective feed rate $F_t$ of the truing roll face at the truing interface, however, is equal to the sum of only the two radius reductions taking place at the truing interface. Thus:

$$F_t=R'_{te}+R'_{wt} \tag{38}$$

Although the rotational axis of the truing roll actually advances at the same rate $F_{ts}$ as the truing slide, a portion of that advance is merely closing the gap that would be opened by the removal of grinding wheel material at the grinding interface at the rate $R'_{wg}$. The rate $F_t$ at which the truing roll face actually feeds into the grinding wheel is, therefore, the truing slide feed rate $F_{ts}$ minus $R'_{wg}$, or $$\begin{aligned} F_t &= F_{ts} - R'_{wg} \\ &= R'_{te} + R'_{wt} + R'_{wg} - R'_{wg} \\ &= R'_{te} + R'_{wt} \end{aligned} \tag{39}$$

thereby confirming the accuracy of Equation (38) above.

Similarly, at the grinding interface the grinding wheel feed rate $F_w$ is not the same as the wheel slide feed rate $F_{ws}$. The wheel *slide* must be advanced at a rate $F_{ws}$ that is equal to the sum of not only the two radius reductions taking place at the grinding interface, but also the reduction in the radius of the grinding wheel effected at the truing interface. That is:

$$F_{ws}=R'_p+R'_{wg}+R'_{wt} \tag{40}$$

The effective feed rate $F_w$ of the grinding *wheel face* at the grinding interface, however, is equal to the sum of only the two radius reductions taking place at the grinding interface. Thus:

$$F_w=R'_p+R'_{wg} \tag{41}$$

Although the rotational axis of the grinding wheel actually advances at the same rate $F_{ws}$ as the wheel slide, a portion of that advance is merely closing the gap that would be opened by the removal of grinding wheel material at the truing interface at the rate $R'_{wt}$. The rate at which the grinding wheel face actually feeds into the workpiece is, therefore, the wheel slide feed rate $F_{ws}$ minus $R'_{wt}$ or $$\begin{aligned} F_w &= F_{ws} - R'_{wt} \\ &= R'_p + R'_{wg} + R'_{wt} - R'_{wt} \\ &= R'_p + R'_{wg} \end{aligned} \tag{42}$$

thereby confirming the accuracy of Equation (41) above.

One specific embodiment of the present invention in a simultaneous truing and grinding operation will be described in more detail using the diagrammatic illustration of FIG. 16, which illustrates the system of FIG. 1 as it exists during simultaneous truing and grinding. This basic system is essentially the same as described in my co-pending application Ser. No. 249,192 under the heading "Truing or Wheel Conditioning While Grinding With STE Control". In the system there described, the removal of material at the truing interface is controlled according to the parameter defined as "STE'-'—Specific Truing Energy—which is a measure of the energy efficiency with which material is being removed from the grinding wheel at the truing interface. More specifically, STE is expressible as a ratio of an amount of energy $E_t$ expended in removing a given volume $W_t$ of wheel material at the truing interface:

$$STE = \frac{\text{Energy Expended}}{\text{Wheel Volume Removed}} = \frac{E_t}{W_t} \tag{43}$$

The dimensional units of STE are expressible, for example, as foot-pounds per cubic inch, watt-minutes per cubic centimeter, or horsepower-minutes per cubic inch.

If one divides the numerator and denominator in Equation (43) by the time span during which the volume $W_t$ is removed, then STE becomes the ratio of power applied in removing wheel material to the volumetric rate of material removal. This is expressed:

$$STE = \frac{PWR_t}{W'_t} \tag{44}$$

For simultaneous truing and grinding, the above equation becomes:

$$STE = \frac{PWR_{wt} - PWR_{te}}{2\pi (L)(R_w)(R'_{wt})} \tag{45}$$

By maintaining STE within a predetermined range or at a predetermined value, the wheel face can be kept in a desired shape and at a desired degree of sharpness, so that the consequences of the wheel face condition on the workpiece can be controlled with quantitative predictability. As described in the introductory portion of this specification, however, one of the problems in controlling STE during simultaneous truing and grinding is that it is usually uncertain how much of the wheel wear is occurring at the grinding interface and how much at the truing interface. This uncertainty makes it difficult to accurately control the denominator of the STE ratio, either to hold the denominator constant so that STE can be controlled by adjusting the term $\omega_{te}$ (see Equation (60), infra, in the numerator, or to adjust the denominator for the purpose of controlling STE. More specifically, the principal variable in the denominator of the STE ratio is $R'_{wt}$, i.e., the wheel wear rate *at the truing interface.* With the present invention, this factor $R'_{wt}$ can be accurately quantified and controlled.

Normally, a certain amount of rough grinding, without simultaneous truing, precedes the initiation of simultaneous truing and grinding. Before truing begins, the entire wheel wear occurs at the grinding interface and can be determined from the difference between the grind rate and the wheel slide feed rate, as described earlier in this specification. After truing begins the wear rate of the grinding wheel due to grinding can no longer be determined from the difference between the grinding rate $R'_p$ and the wheel feed rate $F_{ws}$ because the wheel is being worn away simultaneously at both the truing interface and the grinding interface. However, the values of the coefficient k and the exponent b in the equation $R'_{wg}=kF_w^b$ can be determined because actual values of $R'_{wg}$ and $F_w$ are known from the portion of the grinding operation carried out before the initiation of simultaneous truing, i.e., when the total wheel wear rate $R'_w$ is attributable to grinding ($R'_{wg}=R'_w$) and the wheel feed rate $F_w$ is the same as the wheel slide feed rate ($F_w=F_{ws}$). Thus, the values of k and b can be computed from Equations (19) and (20).

Preferably, the values of $R'_{wg}$ and $F_{ws}$ just before the start of simultaneous truing are used to solve for k and b because (1) the values of k and b change with the wheel radius $R_w$, and thus the *latest* values of $R'_{wg}$ and $F_{ws}$ will yield the most accurate values of k and b for the wheel size at the start of simultaneous truing, and (2) any "following error" in the control system should be at a minimum at that point (following errors normally diminish with each successive iteration period).

Heretofore, the actual value of $R'_{wt}$ in the denominator of the STE ratio for simultaneous truing and grinding has been merely approximated by assuming that the total wear of the grinding wheel was occurring at the truing interface. By using the power function relationships and predetermining the values of the coefficient k and the exponent b, however, the actual value of $R'_{wt}$ can be more precisely quantified and controlled, as will now be described in more detail.

The primary operator-selected set points are as follows for a simultaneous truing and grinding operation carried out in accordance with the present invention:

(1) desired grind rate $R'_{pd}$
(2) desired truing rate $R'_{wtd}$
(3) desired $STE_d$
(4) grinding wheel speed $\omega_{wd}$
(5) workpiece speed $\omega_{pd}$ Controlled parameters include (4) and (5) above plus wheel slide feed rate $F_{ws}$, truing slide feed rate $F_{ts}$ and truing roll speed $\omega_{te}$, the set points for which are computed from the five operator-selected set points. The control of these latter three parameters is particularly important because they are the principal means of maintaining the grind rate $R'_p$, the truing rate $R'_{wt}$ and the STE at the respective set points.

To compute the set points for the two slide feed rates $F_{ws}$ and $F_{ts}$, the wheel wear rate $R'_{wg}$ at the grinding interface must first be determined. From the set grinding rate $R'_{pd}$ and the predetermined values of the coefficient k and the exponent b, that component $F_{wsg}$ of the wheel slide feed rate $F_{ws}$ needed to grind at the desired rate $R'_{pd}$ (ignoring truing) can be computed from Equation (26) as follows:

$$F_{wsg} = \text{antilog}\,\frac{\log R'_{pd} + K}{(1-b)} \tag{46}$$

Then the wheel wear rate $R'_{wg}$ due to grinding is $$R'_{wg}=F_{wsg}-R'_{pd} \tag{47}$$

Having thus determined the desired values of $F_{wsg}$ and $R'_{wg}$, the desired set points for both the wheel slide feed rate $F_{ws}$ and the truing slide feed rate $F_{ts}$ can be computed as follows:

$$F_{tsd}=R'_{wtd}+R'_{wg} \tag{48}$$

$$F_{wsd}=F_{tsd}+R'_{pd} \tag{49}$$

As long as the wheel slide and the truing slide are advanced at the set point rates $F_{tsd}$ and $F_{wsd}$, respectively, grinding and truing will proceed at the desired rates $R'_{pd}$ and $R'_{wtd}$, respectively, provided the grinding and truing condiions are held sufficiently constant that the predetermined values of k and b remain valid. In order to maintain the requisite degree of constancy of the grinding conditions, the control system continuously monitors the actual STE and automatically varies the truing roll speed $\omega_{te}$ in response to any deviations of the actual STE from the set point $STE_d$. If the actual STE rises above the set point value $STE_d$, the motor voltage $V_{tm}$ is increased, causing the braking torque applied to the truing roll 50 by the motor TM to decrease and thereby increasing the truing roll speed $\omega_{te}$. The increase in the truing roll speed $\omega_{te}$ decreases the relative surface speed $S_r$ at the truing interface so that the wheel becomes sharper and the torque $TOR_{te}$ drops. This reverses the changes described above until the actual STE is restored to substantial equality with the set point $STE_d$. That is, the reduction in $TOR_{te}$ reduces the actual STE, which in turn reduces the voltage $V_{tm}$ so that the truing roll speed $\omega_{te}$ is returned to its original level. The incremental increases in $V_{tm}$ are preferably integrated over successive cycles of this corrective action so that $V_{tm}$ is held at a nearly constant value. The self-correcting action of this servo loop will be almost imperceptible to the human eye after the actual STE and the set point $STE_d$ have initially become equal.

By controlling the STE in this manner, both the geometry and the sharpness of the grinding wheel are maintained essentially constant. The use of the power function relationships and the predetermined values of k and b to determine the requisite set points for the wheel slide and truing slide feed rates permits the STE to be controlled with a high degree of accuracy because the truing rate—one of the terms in the denominator of the STE ratio—can be held constant at a value consistent with all the other conditions of the grinding operation, including the desired grind rate. Conversely, accurate control of STE leads to a high degree of stability in the grinding and truing rates because it maintains relatively constant conditions at both the grinding and truing interfaces, so that the predetermined values of k and b remain valid throughout the simultaneous truing and grinding operation (until the wheel radius has been reduced significantly). This, in turn, means that the wheel slide and truing slide feed rate set points, which are computed in the first place from the predetermined k and b values, remain valid.

The starting point for ascertaining the actual value $STE_a$ is the basic STE equation:

$$STE = \frac{PWR_t}{W'_t} \tag{50}$$

It is possible to determine the total power $PWR_w$ applied to the grinding wheel 20 by the motor WM according to the equation:

$$PWR_w = 2\pi(TOR_w)(\omega_w) \tag{51}$$

However, a portion $PWR_{wg}$ of the total wheel driving power $PWR_w$ is taken up at the grinding interface between the grinding wheel and the workpiece and another portion $PWR_{wt}$ is expended at the truing interface between the grinding wheel and the truing element. The latter portion $PWR_{wt}$ of the total wheel power can be expressed as:

$$PWR_{wt} = 2\pi(TOR_{wt})(\omega_w) \tag{52}$$

Similarly, the power $PWR_{te}$ devoted by the motor TM to brake the truing roll can be expressed as $$PWR_{te} = 2\pi(TOR_{te})(\omega_{te}) \tag{53}$$

One may note that at the truing interface the tangential force $FOR_1$ which is transferred from the wheel face to the truing roll face is equal and opposite (absent acceleration effects) to the tangential force $FOR_2$ which, in effect, is applied to the truing roll by the motor TM acting as a brake. And, the torques $TOR_{wt}$ and $TOR_{te}$ in the above equations can be defined as:

$$TOR_{wt} = (FOR_1)\, R_w \tag{54}$$

$$TOR_{te} = (FOR_2)\, R_{te} \tag{55}$$

Since $FOR_1 = FOR_2$, $$TOR_{wt} = (TOR_{te})\left(\frac{R_w}{R_{te}}\right) \tag{56}$$

The value of $TOR_{wt}$ can be computed from this last equation because the value of $TOR_{te}$ is signalled by the transducer 60; the value of the wheel radius $R_w$ is the initial wheel radius $R_{wo}$ minus the amounts removed by grinding and truing, which for simultaneous truing and grinding is the same as the distance advanced by the truing slide after making contact with the grinding wheel, so $$R_w = R_{wo} - (F_{ts})(T) \tag{57}$$

where T is the elapsed time during truing and the value of the truing element radius $R_{te}$ can be assumed to remain constant at its initial value $R_{teo}$. Thus, the total power $PWR_{wt}$ applied by the motor WM via the wheel into the truing interface may be written $$PWR_{wt} = 2\pi(TOR_{wt})(\omega_w) \tag{58}$$

and by substitution from Equation 56:

$$PWR_{wt} = 2\pi\,(TOR_{te})\left(\frac{R_w}{R_{te}}\right)(\omega_w) \tag{59}$$

The power expended as work and friction-generated heat due to the rubbing contact at the truing interface is the input power less that removed to the motor TM acting as a brake. The motor TM acts as a brake because its torque is in a direction opposite to its rotation. Thus, the power $PWR_t$ (producing work to remove material and heat at the truing interface) is found by taking the $PWR_w$ sign as + and the $PWR_{te}$ sign as:

$$PWR_t = PWR_{wt} - PWR_{te} = 2\pi[(TOR_{wt})(\omega_{wt}) - (TOR_{te})(\omega_{te})] \tag{60}$$

Substituting from Equation (56), Equation (60) becomes $$PWR_t = 2\pi\; TOR_{te}\left[\left(\omega_w \frac{R_w}{R_{te}}\right) - \omega_{te}\right] \tag{61}$$

Thus, the STE equation becomes:

$$STE = \frac{PWR_t}{W'_t} = \frac{PWR_{wt} - PWR_{te}}{W'_t} \tag{62}$$

$$= \frac{2\pi\,(TOR_{wt})\,(\omega_w) - 2\pi\,(TOR_{te})\,(\omega_{te})}{2\pi\,(L)\,(R_w)\,(R'_{wt})} \tag{63}$$

$$= \frac{(TOR_{te})\,\frac{(R_w)}{R_{te}}\,(\omega_w) - (TOR_{te})\,(\omega_{te})}{L\,(R_w)\,(R'_{wt})} \tag{64}$$

$$= \frac{(TOR_{te})\left[\frac{(R_w)}{R_{te}}\,(\omega_w) - (\omega_{te})\right]}{L\,(R_w)\,(R'_{wt})} \tag{65}$$

All the factors in the above equation are known from transducer signals or previous measurements or computations except the wheel length L, which is a known constant for any grinding wheel, and the wheel radius $R_w$, which can be computed for any given instant by subtracting the total wheel wear up to that instant from the starting radius $R_{wo}$. Total wheel wear $\Delta R_w$ can be defined as $$\Delta R_w = \Delta T(R'_{wg} = R'_{wt}) \tag{66}$$

so $R_{wi}$ at any instant is $$R_{wi} = R_{wo} - \Delta T(R'_{wg} + R'_{wt}) \tag{67}$$

Thus, the actual value of STE can be iteratively computed during the grinding operation and compared with the set point $STE_d$ to determine what, if any, adjustment of the truing roll speed $\omega_{te}$ is needed to keep the actual STE at the set point $STE_d$.

As an alternative to the control system described above, the truing roll speed $\omega_{te}$ may be maintained constant at a set point value and the STE error used to correctively energize the motor TFM to adjust the truing slide feed $F_{ts}$ rather than $\omega_{te}$. Or, the truing slide feed rate $F_{ts}$ may be adjusted only in the event that the STE error becomes excessively negative indicating that STE has fallen to an extent that changes in $\omega_{te}$ will not restore STE to agreement with the set point $STE_d$. Adjusting $F_{ts}$ rather than $\omega_{te}$ offers the advantage that as an incident to keeping STE at the set point $STE_d$, the truing roll will always be infed sufficiently fast to maintain rubbing contact with the wheel face regardless of the wheel radius reduction rate caused by the grinding action.

Returning now to FIG. 16, the grinding machine there illustrated includes all the components of the machine previously described and illustrated in FIG. 6, plus the truing roll 50 and the motors TM and TFM associated therewith. The truing roll 50 is driven by the motor TM, and the truing slide TS is moved to the left by the motor TFM at a feed rate Fts proportional to the voltage $V_{tfm}$ to advance the truing roll into the grinding wheel 20. The feeding motion of the truing roll 50 is along a horizontal path parallel to the "X-axis" path followed by the feeding motion of the grinding wheel 20, and this axis of movement of the truing slide will be referred to herein as the "U-axis".

The preferred means for controlling the grinding apparatus of FIG. 16, using the control method described above, is the same software-programmed digital mini-computer illustrated in FIG. 7 and described above. FIG. 17 is an expanded diagrammatic illustration of the memory 80 in that mini-computer system with many of the pertinent storage registers or locations used in controlling the apparatus of FIG. 16 labelled with the same types of acronyms used in the description of Example I above. As indicated in FIG. 17, the primary command signals in this particular example include the same three command signals XVC, VPM and VWM used in Example I, plus two additional command signals UVC and VTM which produce the voltages $V_{ftm}$ and $V_{tm}$ which drive the respective motors TFM and TM in FIG. 16. All five of these digital command signals are passed through digital-to-analog converters 201–205 to produce the corresponding analog voltages.

The inputs to the memory of FIG. 17 also include the same five transducer signals XR, $\omega_p$, $\omega_w$, $R_p$ and TORW used in Example I, plus three additional transducer signals UR, TRV and TORTE. These latter three signals are derived from the U-axis resolver 58, the truing roll tachometer 61, and the truing roll drive motor torque transducer 60, respectively. The eight analog input signals are passed through respective analog-to-digital converters 206–213 to produce the corresponding digital signals identified by the acronym labels in FIG. 17.

It will also be noted in FIG. 17 that the number of values that are keyed in to the memory, i.e., the values identified by the acronyms in the rectangles having diagonal lines at the corners, is considerably greater than the number of keyed-in values required in Example I. As in the case of Example I, these predetermined constant but adjustable signals can all be retrieved and sent to the ALU 72 by appropriate instructions. All the acronyms used in this Example II have already been included in the glossary of acronyms given above in connection with Example I.

FIG. 18 is a timing diagram illustrating the sequence of the various operating modes included in the control system of this particular example, with the operating modes for the X-axis being illustrated in the bottom half of the drawing and the operating modes for the U-axis being illustrated in the top half of the drawing. References to this timing diagram will be made at appropriate points throughout the detailed description. FIG. 19 illustrates the main program which the mini-computer system follows while being interrupted at successive intervals for execution of the subroutines illustrated in FIGS. 20, 21, 22 and 23, as well as the subroutines of FIGS. 14 and 15 which are used in both Examples I and II. As in the case of Example I, the iteration intervals $\Delta T$ will be assumed to 40 milliseconds in duration, which means that the sub-periods marked off for execution of the various subroutines must be shorter, for at least some of the subroutines, than the 8-millisecond sub-periods allowed in Example I. Of course, these time periods are exemplary only, and may be altered to any other desired values.

Referring now to the flow chart of the main program in FIG. 19, steps 1 through 34 of this main program are virtually identical to the main program described above and illustrated in FIG. 10 for Example I. The only differences are that a different set of constants and set point values are entered by the operator at step 002, and the truing roll drive motor TM is turned on along with the motors PM and WM at step 004. Furthermore, modes 1, 3 and 7 of the X-axis subroutine illustrated by the flow chart in FIG. 20 for Example II are identical to the corresponding modes of the X-axis subroutine of FIG. 11 for Example I, and, as already mentioned, the VPM and VWM subroutines of FIGS. 14 and 15 are also identical in the two examples. Accordingly, there is no need to repeat the description of these portions of the control system which are common to the two examples. The significant differences between the two examples begin at mode 4, and, therefore, that is where this detailed description will begin.

The mode 4 flag MD4 is set at step 034 of the main program, which means that the next time the system enters the X-axis subroutine of FIG. 20 it proceeds from step 110 to step 117 where the commanded feed rate signal XFRA is set to the keyed-in value GR representing the desired grind rate for both modes 4 and 5. More specifically, it is desired to grind at this rate without simultaneous truing during mode 4, and then to continue grinding at a different rate GR2 with simultaneous truing in mode 5. It will be recalled that in Example I the commanded feed rate signal XFRA was set to the value GR of the desired grind rate for only a relatively brief interval to permit the necessary measurements to be taken for the initial computations of k and b.

In the X-axis subroutine of FIG. 20, the system proceeds through steps 151 and 152, which will be described below, to step 153 where the current value of the signal $XAP_i$ is computed. In Example I, and in all other modes of the present example, the value of this signal $XAP_i$ represents the actual position of the wheel face, and it is updated in each iteration interval $\Delta T$, by adding the current value of $\Delta XAP_i$ (representing the difference between the latest pair of resolver signals $XR_i$ and $XR_{i-1}$) to the previous value $XAP_{i-1}$. In mode 4 of Example II, however, the value of $XAP_i$ is modified by adding a further value $COR\Delta_i$ in order to compensate for wheel wear. Although the commanded feed rate signal XFRA is set exactly equal to the value of the desired grind rate GR, grinding will not actually proceed at this rate because no allowance has been made for wheel wear. This allowance is provided by the factor $COR\Delta_i$, the value of which is computed in the subroutine of FIG. 21.

Turning now to FIG. 21, this subroutine uses the gage signal GS to continually update the signal $PTRAD_i$ representing the actual workpiece radius, which is not only one of the values needed to compute the value of the wheel wear compensation factor CORΔ used in mode 4, but also is the value used to compute the value of the "distance to go" signal $DTG_i$ in modes 4 and 5. Thus, the subroutine of FIG. 21 is active only during modes 4 through 6, which are the only modes during which grinding is taking place.

The first step 700 of the subroutine of FIG. 21 detects whether any of the flags MD4, MD5 or MD6 is on, and if the answer is negative the system immediately exits from this subroutine. If the answer is "yes" at step 700, the system proceeds to step 701 where the value of the gage signal GS is read from the gage ADC 87. A running average of the gage signal value GS, for the last ten ΔT's, is continually updated and stored as the value $GS_i$ at step 702, and this value is then used at step 703 to update the actual workpiece radius value $PTRAD_i$ by adding the latest average gage signal value $GS_i$ to the original gage reference value PTRADI.

At step 704 the subroutine tests the flag MD4, and if the answer is negative it means that the system is in mode 5 or 6. Both of these modes 5 and 6 require only the updated workpiece radius value $PTRAD_i$, not the wheel wear compensation factor CORΔ, and thus the system exits from the subroutine of FIG. 21 in response to a negative answer at step 704 and returns the system to the main program at step 706. An affirmative response at step 704 means that the system is in mode 4, and thus the subroutine proceeds to step 705 where the value of the compensation factor CORΔ is computed. More specifically, step 705 first moves an error signal $RADERR_i$ to memory location RADERRI (thereby "saving" that signal), and then computes a new value for the error signal $RADERR_i$ by subtracting the current wheel position $XAP_i$ from the current workpiece radius $PTRAD_i$. Thus, the value of $RADERR_i$ represents the current difference between the actual workpiece radius as represented by $PTRAD_i$ and the current actual wheel face position as represented by $XAP_i$.

The error signal $RADERR_i$ is used to compute conventional "PID" control factors $PFACTOR_i$, $IFACTOR_i$ and $DFACTOR_i$ which, as is well known, represent proportional, integral and derivative control terms which are used to control the wheel slide feed motor WFM in a stable manner. Such "PID" control of servo motors is well known per se and need not be explained in detail herein. As indicated in FIG. 21, the proportional factor $PFACTOR_i$ is computed by multiplying the error signal $RADERR_i$ by a keyed-in gain factor GP; the integral factor $IFACTOR_i$ is computed by multiplying the error signal $RADERR_i$ by a keyed-in integral gain factor GI and adding the resulting product to the previous value $IFACTOR_{i-1}$; and the derivative factor $DFACTOR_i$ is computed by subtracting the previous error signal value RADERRI from the current error signal $RADERR_i$ and multiplying the resulting difference by a keyed-in derivative gain factor GD. The value of $COR\Delta_i$ is then the sum of the three factors $PFACTOR_i$, $IFACTOR_i$, and $DFACTOR_i$.

Returning now to the X-axis subroutine of FIG. 20, it will be noted that the value $COR\Delta_i$ is used at step 151 to continually update the signal $RADW_i$ representing the current actual wheel radius. This value $RADW_i$ is updated by subtracting the current value of $COR\Delta_i$ from the previous value $RADW_{i-1}$ in each iteration interval. From step 151, the X-axis subroutine advances to step 152 where the signal $DTG_i$ representing the distance to go to the desired final workpiece radius PTRADD is continually updated by subtracting the current value of the signal $PTRAD_i$ representing the actual workpiece radius from the desired final radius value PTRADD. The subroutine then proceeds to step 153 which has already been described above.

The net result of the X-axis control system in mode 4 is to advance the wheel slide at a rate equal to the sum of the desired grind rate GR and the wheel wear rate represented by the value of CORΔ. The truing roll has not yet engaged the grinding wheel, because there is no simultaneous truing during mode 4, but it is desired to have the truing roll follow the grinding wheel at a constant gap so that the truing roll can be quickly and smoothly brought into engagement with the grinding wheel when it is desired to initiate simultaneous truing. To accomplish this, the truing roll is initially set at a position which establishes the desired gap between the opposed faces of the truing roll and the grinding wheel, and then the truing slide is advanced at a rate set by the value of CORΔ during mode 4. As can be seen from the timing diagram in FIG. 18, the gap is initially set in mode 7, after which the truing slide remains stationary until its advancing movement at the rate CORΔ is started at the beginning of mode 4. The U-axis subroutine for controlling movement of the truing slide is shown in FIG. 22.

Turning now to FIG. 22, the first step 600 of this subroutine determines whether or not the flag MD3 is on because mode 3 is a convenient time to clear a series of flags in this subroutine. As can be seen in FIG. 18, mode 3 is the last mode before the truing slide feed motor TFM is energized for continuous movement in this particular example. When the system is not in mode 3, step 600 produces a negative response which causes the subroutine to proceed to step 601 to determine whether or not the system is in mode 7. If the answer is negative, the system proceeds to step 602 to test for mode 4, and a negative response causes the system to move on to step 603 to test for mode 5, and then on to 604 to test for mode 6. It is only in these four modes, namely modes 4, 5, 6 and 7, that the truing slide feed motor is energized.

When the system is in mode 7, step 601 yields an affirmative answer, and the subroutine proceeds to step 605 where a flag G0K7 is read to determine whether the truing slide has reached the end of its desired movement for this particular mode; this flag will be discussed in more detail below. If the flag G0K7 is clear, the system proceeds to step 606 to test a flag SGFL which is normally clear the first time this subroutine is entered in mode 7. A negative response at step 606 advances the system to step 607 which sets the flag SGFL so that the next two steps 608 and 609 are bypassed for the balance of this particular mode.

Step 608 sets the endpoint UCEP for the truing slide movement in mode 7. More specifically, in order to retract the truing slide to a position where the face of the truing roll is spaced a predetermined distance away from the rear face of the grinding wheel, this endpoint UCEP is set to a value that is equal to the sum of the signal $RADW_i$ representing the current wheel radius, the signal RADT representing the truing roll radius (one of the keyed-in constants), and a signal GAP representing the desired distance between the truing roll and the grinding wheel (another keyed-in constant). Having set the desired endpoint UCEP, the system advances to step 609 which sets the U-axis feed rate command signal UFRA equal to a keyed-in value SGV representing a rate of movement that is fast enough to move the truing slide to the desired position before mode 7 ends. From step 609, the system proceeds to step 610 where a value $\Delta U_i$ is set equal to the command signal UFRA, which is in units of inches per minute, divided by 1500 to convert the UFRA value to inches per $\Delta T$ (still assuming a $\Delta T$ of 40 ms.). It will be recognized that this value $\Delta U_i$ is the U-axis counterpart of the value $\Delta X_i$ already discussed above in connection with the X-axis subroutine. That is, the command signal UFRA is set at different values in different modes, always expressed in inches per minute, and $\Delta U_i$ is simply the commanded value UFRA divided by 1500 to convert the units to inches per $\Delta T$.

Once the value of UFRA has been set at step 609, there is no need to repeat steps 608 and 609 for the balance of this particular mode 7, and that is why the flag SGFL is set at step 607. As a result, in the next iteration interval step 606 produces an affirmative response which causes the system to proceed directly from 606 to step 610.

From step 610, the system proceeds to step 611 to determine when the truing slide is within one $\Delta T$ of the desired endpoint UCEP. This is determined by comparing the absolute value of $\Delta U_i$ with the absolute value of the difference between the desired endpoint UCEP and the current commanded truing slide position $UCP_i$. When the difference between UCEP and $UCP_i$ is less than $\Delta U_i$, step 611 produces an affirmative response which causes the system to proceed to step 612 where the value of $\Delta U_i$ is set to zero and the new commanded position $UCP_i$ of the truing slide is set at the value of the desired endpoint UCEP. This will cause the truing slide feed motor to be advanced only to the desired endpoint UCEP in the current $\Delta T$, thereby stopping the truing slide at the desired endpoint UCEP with the truing roll face spaced the desired distance GAP away from the grinding wheel face.

From step 612, the system advances to step 613, which determines whether or not the flag MD7 is on. An affirmative response advances the system to step 614 which sets the flag G0K7 tested at step 605. The setting of this flag indicates that the truing slide is in its last $\Delta T$ of movement in mode 7. Consequently, if mode 7 continues for one or more interation intervals, an affirmative answer will still be produced at step 601 because the flag MD7 will still be on, but the setting of the flag GOK7 will produce an affirmative answer at step 605. As a result, the system will proceed directly from step 605 to step 615 which sets $\Delta U_i$ to zero for the balance of this mode.

Before the truing slide moves to within one $\Delta T$ of the endpoint UCEP in mode 7, step 611 produces a negative response which advances the system to step 616. Step 616 reads the U-axis resolver signal UR, which represents the changing position of the output shaft of the motor TFM. Thus, the change $\Delta UAP_i$ represented by the difference between each pair of successive readings $UR_i$ and $UR_{i-1}$ of the resolver signal represents the actual change in position of the truing slide in the iteration interval between the readings $UR_i$ and $UR_{i-1}$. The value $\Delta UAP_i$ is used to continually update the signal $UAP_i$ representing the current actual position of the truing slide, by adding each new $\Delta UAP_i$ to the value of the previous position signal $UAP_{i-1}$, which is the second computation carried out at step 616 as illustrated in FIG. 22. The signal $UCP_i$ representing the current commanded position of the truing slide is similarly updated in each iteration interval by adding the value $\Delta U_i$ to the previous commanded position signal $UCP_{i-1}$, which is the third computation carried out at step 616 in FIG. 22. The fourth computation determines the value of an error signal $UERR_i$, which is the difference between the current commanded position signal $UCP_i$ and the current actual position signal $UAP_i$. This error signal $UERR_i$ is then used in the final computation of step 616, which computes the value of the voltage command signal $UVC_i$ to be converted by the DAC converter 202 to the drive voltage $V_{tfm}$ for the truing slide feed motor TFM. As illustrated in FIG. 22, the value of this command signal $UVC_i$ is the value of the error signal $UERR_i$ multiplied by a keyed-in proportionality or gain factor GU.

As in the case of the U-axis subroutine described previously, the computations just described as being carried out at step 616 are the same whenever the truing slide feed motor TFM is energized in any of the modes 4, 5, 6 or 7. The value of $\Delta U_i$ changes depending upon the mode in which the system is operating at any given time, and in most cases a desired change in the value of $\Delta U_i$ is effected by simply changing the value of the commanded feed rate signal UFRA.

In mode 4, the U-axis subroutine of FIG. 22 controls the truing slide motor TFM to advance the truing slide at a rate which maintains the constant distance GAP between the truing roll face and the rear face of the grinding wheel. This constant "following gap" is maintained until it is desired to start closing the gap in order to initiate simultaneous truing and grinding. In this particular example, a preselected, keyed-in "distance to go" value DD1 (see FIG. 18) is used to accelerate the advancing movement of the truing slide to close the gap, and simultaneous truing and grinding is initiated when the truing roll makes contact with the grinding wheel.

Returning to the beginning of the U-axis subroutine of FIG. 22, when the system is in mode 4 negative responses are produced at both steps 600 and 601, and an affirmative response is produced at step 602. This causes the system to proceed to step 620 where the current "distance to go" value $DTG_i$ is compared with the preset value DD1 to determine whether or not it is time to start closing the gap. As long as $DTG_i$ is greater than DD1, step 620 produces a negative response which advances the system to step 621 where the value of $\Delta U_i$ is set equal to the value of CORΔ. It will be recalled CORΔ is the value used to adjust the feed rate of the wheel slide to compensate for wheel wear. It will also be recognized that as long it is desired to simply have the truing roll follow the grinding wheel at a constant distance GAP, the truing slide should be advanced at exactly the same rate at which the grinding wheel is wearing, which in units of inches per $\Delta T$ is represented by the value CORΔ. Consequently, setting $\Delta U_i$ equal to CORΔ will cause the truing roll to continue following the grinding wheel at a constant distance GAP.

When the value of $DTG_i$ becomes equal to or less than DD1, step 620 produces an affirmative response which causes the system to proceed to step 622 where a new desired endpoint UCEP is set equal to the sum of the current wheel radius $RADW_i$ and the truing roll radius value RADT. In other words, this endpoint represents the truing slide position where the face of the truing roll just comes into contact with the face of the grinding wheel, which is where UCP equals the sum of RADW and RADT. The next step 622 sets the U-axis feed rate command signal UFRA equal to a new value which is the sum of a preselected, keyed-in constant value CV and a term which is 1500 times the value of CORΔ. The latter term, 1500 CORΔ, is simply the wheel wear rate factor CORΔ converted from inches per ΔT to inches per minute, and the value CV represents a preselected rate (in inches per minute) at which it is desired to close the gap between the truing roll and the grinding wheel.

During the period when the gap between the truing roll and the grinding wheel is being eliminated, the values of the exponent b and the coefficient k are also computed. Following the setting of the closing velocity CV at step 622, the system proceeds to step 623 which determines whether or not a flag BKREADY has been set. If the answer is negative, the system proceeds to step 624 where the values of b and k are computed. The first computation carried out at step 624 determines the value of the exponent b from CORΔ and GR1 using Equation (19) described above, as rewritten at step 624 in FIG. 22 (the value CORΔ is multiplied by 1500 to convert the units from inches/ΔT to inches/minute). The value of the coefficient k is then computed as the antilog of k, which is computed from b, using Equation (20) described above, again as rewritten at step 624. From step 624, the system proceeds to 625 which sets the BKREADY flag, and then on to step 610. The next time the system reaches step 623, it produces an affirmative response which causes the system to proceed directly from step 623 to step 610.

While the truing roll is being advanced toward the grinding wheel at the closing velocity CV, step 611 is constantly comparing the remaining distance between the current commanded truing roll position $UCP_i$ and the desired endpoint UCEP with the value of $\Delta U_i$ to detect when the truing roll is within one ΔT of the desired endpoint UCEP. When step 611 produces an affirmative response, the system once again proceeds to step 612 which sets $\Delta U_i$ to zero and sets the new commanded position $UCP_i$ for the truing roll equal to the desired endpoint UCEP. Step 613 then tests the flag MD7, which will produce a negative response in mode 4 and advance the system to step 631. The flag MD4 is always set in mode 4, and thus produces an affirmative response at step 631. Arrival of the truing roll at the endpoint UCEP set at step 621, which is the point at which the truing roll will first contact the grinding wheel, is the event that should terminate mode 4. Consequently, the affirmative response at step 631 is used to clear the flag MD4 at step 632 and to set the "mode 5" flag MD5 at step 633. It will be understood that the truing slide feed motor TFM will remain energized at the UFRA value set at step 622 for whatever fraction of this last ΔT is required to bring the truing roll to the desired endpoint UCEP, but then the motor TFM will not be driven any further via the mode 4 channel in the U-axis subroutine.

The next time the system enters the U-axis subroutine, negative responses are produced at steps 600, 601 and 602, and an affirmative response is produced at step 603 because the flag MD5 has now been set. The system thus advances to step 640, where the wheel wear rate WWRG due to grinding is computed for the new grind rate GR2 desired for mode 5. This value WWRG is computed using Equations (46) and (47) described above, as rewritten at step 640 in FIG. 22, and is then used in step 641 to compute the value of the truing slide feed rate command signal UFRA (in units of inches per minute) that will achieve the desired truing rate represented by the value WWRT (one of the keyed-in set points) while the wheel is being worn down due to grinding at the desired grinding rate represented by the GR2. (As will be described below, the new grinding rate value GR2 is also used to determine the value of the new wheel slide feed rate command signal FGRTR for mode 5.) As indicated at step 641 in FIG. 22, this new value of the feed rate command signal UFRA is set equal to the sum of the value WWRG computed at step 640 and the set point truing rate value WWRT. The system then proceeds to step 642 where the new value of $\Delta U_i$ is once again determined by dividing the new UFRA by 1500. As before, this value of $\Delta U_i$ is used at step 616 to control the feed rate of the truing slide.

Turning again to the X-axis subroutine of FIG. 20, when the "mode 5" flag MD5 is set, this subroutine produces an affirmative response at step 111, which results in a resetting of the value of the commanded feed rate signal XFRA to a new value FGRTR at step 154. The new value FGRTR is computed as the sum of the "mode 5" U-axis feed rate command signal UFRA —as computed at step 641 above—and the new grind rate value GR2. Total wheel wear, due to both grinding and truing, is represented by the value UFRA, and thus the new wheel slide feed rate value FGRTR should result in grinding at the desired rate represented by the value GR2 throughout mode 5. Step 155 sets the commanded feed rate signal XFRA equal to the newly computed value FGRTR, and the system then proceeds to step 156 where a "distance to go" value $DTG_i$ is computed and constantly updated by subtracting the current workpiece radius $PTRAD_i$ from the desired final workpiece radius PTRADD.

From step 156, the X-axis subroutine proceeds to step 157 where the current actual wheel position value $XAP_i$ is updated in the usual manner. The system then proceeds to steps 105 and 106 described previously, and returns to the main program at step 107.

The point at which the simultaneous truing and grinding mode is terminated can be determined in a number of different ways, but in the particular example described here it is terminated when the "distance to go" $DTG_i$ reaches a value DD2 (one of the keyed-in constants). The value DD2 is chosen to represent the final fraction of the grinding operation during which it is desired to grind the workpiece at a finish grinding rate without simultaneous truing. That is, the desired shape of the workpiece has been insured by simultaneous truing and grinding during mode 5, and it is now desired to carry out the final increment of grinding at a much slower feed rate and, more importantly, with a changing surface condition on the grinding wheel in order to achieve the desired surface finish on the workpiece along with the desired final shape and dimension. Accordingly, when the value of $DTG_i$ reaches DD2, this condition is sensed at step 50 of the main program, which then clears the flag MD5 at step 51 and sets the "mode 6" flag MD6 at step 52.

The setting of the flag MD6 causes the U-axis subroutine of FIG. 22 to encounter negative responses at steps 600 through 603, and an affirmative response is produced at step 604 so that this subroutine enters the mode 6 channel. The first step 650 in this channel tests a flag GOK6 which, like flag GOK7 described above, determines when the truing roll reaches the desired endpoint UCEP for this particular mode. A negative response at step 650 advances the system to step 651 where the desired endpoint UCEP for mode 6 is set equal to the sum of the current wheel radius value $RADW_i$, the keyed-in truing roll radius value RADT, and the value GAP representing the desired distance between the truing roll face and the rear face of the grinding wheel when the truing slide is retracted. That is, it is desired to re-position the truing roll at the same predetermined distance from the grinding wheel that was previously established in mode 7, taking into account the fact that the radius of the grinding wheel has been reduced in the meantime.

From step 651, the system advances to step 652 which sets the feed rate command signal UFRA for mode 6 at the same value CV (but with the opposite polarity) that was used to close the gap in mode 4. This value CV determines the speed at which the truing roll is backed away from the grinding wheel in mode 6. From step 652 the system proceeds to step 610, where the value of $\Delta U_i$ is once again determined by dividing the new feed rate command signal UFRA by 1500.

While the truing roll is being retracted at the commanded rate, step 611 constantly compares the absolute value of $\Delta U_i$ with the remaining distance between the newly set endpoint UCEP and the current commanded truing position $UCP_i$, to determine when the truing roll is within one $\Delta T$ of the desired endpoint. When an affirmative response is produced at step 611, the system proceeds to step 612 (described previously), and steps 613 and 631, both of which produce negative responses because the system is now in mode 6. From step 631, the system advances to step 653 which produces an affirmative response because the flag MD6 is set. This affirmative response advances the system to step 654 which sets the flag G0K6 to indicate that the retracting movement of the truing slide is in its final $\Delta T$. Thus, if the system is still in mode 6 in the next $\Delta T$, it will proceed directly from step 650 to step 615 which sets $\Delta U_i$ to zero so that the truing slide is not driven any farther in this mode.

In the X-axis subroutine of FIG. 20, the setting of the "mode 6" flag MD6 advances the system from step 112 to step 158 where a new value FGRFIN is computed for the feed rate command signal XFRA. This new value FGRFIN is computed using the previously computed values of b and k and a keyed-in value GRFIN for the desired finish grinding rate; these values are used in Equation (26) as rewritten at step 158 in FIG. 20. The system then advances to step 159, where the wheel slide feed rate command signal XFRA is set at the newly computed value FGRFIN. As will be apparent from the earlier description of Example I, this value of the feed rate command signal will cause finish grinding to proceed at the desired rate GRFIN while compensating for wheel wear. Instead of using the values of b and k computed during mode 4 of the U-axis subroutine, these values may be periodically re-computed, if desired, using a subroutine like that described above and illustrated in FIG. 13 of Example I. From step 159, the X-axis subroutine of FIG. 20 proceeds on through the previously described steps 157, 105, 106 and 107.

During the finish grinding mode 6, the subroutine of FIG. 21 continues to update the actual workpiece radius value $PTRAD_i$ by subtracting the gage signal value $GS_i$ from the original gage reference value PTRADI. This workpiece radius value $PTRAD_i$ is used to determine when finish grinding should be terminated, by determining when the actual workpiece radius value $PTRAD_i$ has been reduced to the desired final workpiece radius value PTRADD. This comparison is carried out at step 053 of the main program, and when this step produces an affirmative answer, the flag MD6 is immediately cleared at step 054. The main program then proceeds to step 055 which returns to step 023 where the flag MD7 is set. This causes the wheel slide drive motor WFM to retract the grinding wheel to its "parked" position in the same manner described previously in Example I.

Although the truing roll drive motor TM was started at step 004 of the main program, control of the truing roll speed is not initiated until mode 5, because it is only during mode 5 that the truing roll engages the grinding wheel. The subroutine for controlling the truing roll speed during mode 5 is shown in FIG. 23. As explained above, the truing roll speed TRV is not used to hold the truing roll at a set point speed, but rather to hold the STE at a set point STED.

The first step 800 of this subroutine determines whether the flag MD5 is on, and if the answer is affirmative the system proceeds to step 801 which reads the current wheel speed signal $WHV_i$ from the grinding wheel tachometer 36. Step 802 computes and stores a running average $WHVAV_i$ of the last ten wheel speed readings $WHV_i$. Similarly, step 803 reads the truing roll velocity $TRV_i$ from the truing roll tachometer, and step 804 computes and stores a running average $TRVAV_i$ of the last ten truing roll speed readings $TRV_i$. Steps 805 and 806 repeat the same "read" and "average" steps for the truing roll torque, i.e., step 805 reads the truing roll torque signal $TORTE_i$ from the torque transducer 60, and step 806 computes and stores a running average $TORTAV_i$ of the last ten readings of $TORTE_i$. Step 807 maintains an updated value of the actual wheel radius $RADW_i$ by substracting each incremental movement $\Delta U_i$ of the truing slide from the last wheel radius value $RADW_{i-1}$. At this point, the system contains all the values needed to compute the actual value of STE, which is designated $STEA_i$ herein.

The value of $STEA_i$ in each $\Delta T$ is computed at step 808 using Equation (65) described above with a gain factor GWT replacing the term "L", which is a constant for any given grinding system, in the denominator. It will be recognized that this equation, which is rewritten at step 808 in FIG. 23, requires a series of separate computations each of which is a straight-forward addition, substraction, multiplication or division function. At step 809, an error signal $STERR_i$ is computed as the difference (if any) between the set point value STED and the actual value $STEA_i$. The error signal $STERR_i$ is then used at step 810 to make an integrating correction to the truing roll speed command signal VTM. More particularly, the error signal $STERR_i$ is multiplied by a gain factor GT, and the resulting product is added to the previous speed command signal $VTM_{i-1}$ to produce a new speed command signal $VTM_i$. The subroutine then returns the system to the main program at step 811.

It should be noted that the system described above is based upon an assumption that the truing roll wear is insignificant enough that it can be ignored, i.e., the value RADT is assumed to be a constant. If desired, however, the system can be refined to compensate for the wear rate of the truing roll, which is normally much smaller than the wear rate of the grinding wheel. Examples of specific systems for compensating for the truing roll wear rate are described in the aforementioned copending application Ser. No. 249,192, which is assigned to the assignee of the present invention.

While the invention in its various aspects has been shown and described in some detail with reference to different specific embodiments, there is no intention thereby to limit the invention to such detail. On the contrary, it is intended to cover all alternatives, variations and equivalents which fall within the spirit and scope of the following claims.

I claim as my invention:

1. A method of grinding a selected workpiece with a selected grinding wheel at a desired grinding rate, said method comprising determining the relationship between the wear rate of said grinding wheel and the feed rate at which said grinding wheel is fed into said workpiece, and feeding said grinding wheel into said workpiece at a feed rate which is approximately equal to the sum of the desired grinding rate and the wheel wear rate corresponding to the feed rate.

2. A method as set forth in claim 1 wherein said relationship between the wheel wear rate $R'_w$ and the feed rate $F_{ws}$ is defined by the expression:

$$R'_w = kF_w^b$$

wherein k and b are constants for grinding operations involving substantially the same workpiece material, grinding wheel material, grinding wheel radius, and relative surface velocities at the grinding interface.

3. A method as set forth in claim 2 wherein the values of k and b are determined by grinding the selected workpiece with the selected grinding wheel at different relative feed rates, determining the values of the relative feed rate $F_w$ and the corresponding wheel wear rate $R'_w$ at a plurality of different relative feed rates, and utilizing said values of $F_w$ and $R'_w$ to determine the values of k and b.

4. A method as set forth in claim 3 wherein said values of relative feed rate $F_w$ and wheel wear rate $R'_w$ are $(R'_1, F_1)$ and $(R'_2, F_2)$, and the values of k and b are determined from the equations $$b = \frac{\log R'_2 - \log R'_1}{\log F_2 - \log F_1}$$

$$K = \log R'_1 - \log F_1 \frac{\log R'_2 - \log R'_1}{\log F_2 - \log F_1}$$

k=antilog k.

5. A method of "gaging" the radius of a workpiece while it is being ground by a grinding wheel, said method comprising determining the relationship between the wear rate of said grinding wheel and the feed rate at which said grinding wheel is fed into said workpiece, measuring the starting radius of the workpiece to be ground, feeding the grinding wheel into the workpiece at a controlled feed rate or rates, determining the wheel wear rate corresponding to each feed rate and subtracting each such wear rate from the corresponding feed rate to ascertain the actual grinding rate at each feed rate, measuring the time period during which grinding is carried out at each feed rate, and determining the radius of the workpiece at any instant in the grinding operation by multiplying each grinding rate by the grinding time at that rate, summing the resulting products of the multiplying steps, and subtracting the resulting sum from the starting radius of the workpiece.

6. A method as set forth in claim 5 wherein the radius of the workpiece is determined iteratively at successive time intervals, comparing each such radius with a desired final radius of the workpiece to detect when the actual workpiece radius reaches the desired final radius, and terminating the feeding of the grinding wheel into the workpiece in response to the detection of said desired final radius.

7. A method of grinding a selected workpiece with a selected grinding wheel at a desired grinding rate GR, said method comprising feeding the grinding wheel toward the workpiece at a rate $F_w$ where:

$$F_w = \text{antilog} \frac{\log GR + K}{(1 - b)}$$

K is the antilog of k, and k and b are predetermined constants having values such that the wheel wear rate $R'_w$ at the grinding rate GF is approximately equal to k $F_w^b$.

8. A method of grinding a selected workpiece with a selected grinding wheel, said method comprising grinding the selected workpiece with the selected grinding wheel at different wheel feed rates, and determining the values of the wheel feed rate $F_w$ and the corresponding wheel wear rate $R'_w$ at a plurality of different feed rates, utilizing the determined values of $F_w$ and $R'_w$ to determine the values of the coefficient k and the exponent b in the relation:

$$R'_w = kF_w^b$$

utilizing the determined values of k and b to determine the wheel feed rate $F_{wd}$ required to achieve a desired grind rate GR, grinding said workpiece with said grinding wheel while feeding the grinding wheel at said rate $F_{wd}$ to achieve the desired grind rate GR while compensating for wear.

9. A method of grinding a workpiece at a desired grind rate GR while simultaneously truing the grinding wheel, said method comprising determining the relationship between the wear rate $R'_{wg}$ of said grinding wheel and the feed rate $F_w$ at which said grinding wheel is fed into said workpiece, grinding said workpiece with said grinding wheel while simultaneously truing the grinding wheel with a truing element, determining the wheel wear rate $R'_{wg}$ (at the grinding interface) corresponding to the desired grind rate GR from the previously determined relationship between $R'_{wg}$ and $F_w$, advancing the grinding wheel toward the workpiece at a controlled rate $F_{ws}$ which is approximately equal to the sum of the desired grinding rate GR, the corresponding wheel wear rate $R'_{wg}$ (at the grinding interface), and the rate $R'_{wt}$ of reduction in the wheel radius at the truing interface, and feeding the truing roll toward the grinding wheel, on the opposite side of said wheel from the workpiece, at a controlled rate $F_{ts}$ which is approximately equal to the sum of $R'_{wg}$ and $R'_{wt}$.

10. A method as set forth in claim 9 wherein said relationship between $R'_{wg}$ and $F_w$ is determined during grinding without simultaneous truing.

11. A method as set forth in claim 9 wherein said wheel wear $R'_{wg}$ is determined by determining the values of the coefficient k and the exponent b in the following relationship between $R'_w$ and $F_w$ $$R'_w = kF_w^b$$

determining the value of the grinding wheel feed rate $F_{wsg}$ at the grinding interface from the equation $$F_{wsg} = \text{antilog}\,\frac{\log GR + K}{(1 - b)}$$

where K is the log of k, and determining the wheel wear rate $R'_{wg}$ at the grinding interface from the equation $$R'_{wg} = F_{wsg} - GR$$

12. A method as set forth in claim 9 wherein at least one of the grinding system parameters is controlled to maintain a substantially constant value of Specific Truing Energy.

13. A method of grinding a selected workpiece with a selected grinding wheel, said method comprising determining the values of the coefficient k and the exponent b in the following power function relationship between the wear rate $R'_w$ of said grinding wheel and the feed rate $F_w$ at which said grinding wheel is fed into said workpiece $$R'_w = kF_w^b$$

selecting a desired grinding rate $R'_{pd}$ for said workpiece, determining a desired feed rate $F_{wsd}$ for grinding said workpiece at said desired grinding rate $R'_{pd}$ according to the equation $$F_{wsd} = \text{antilog}\,\frac{\log R'_{pd} + K}{(1 - b)}$$

where K is the log of k, and grinding said workpiece by feeding said grinding wheel into said workpiece at said desired feed rate $F_{wsd}$.

14. A method of grinding a selected workpiece with a selected grinding wheel, said method comprising determining the values of the coeffiecient k and the exponent b in the following power function relationship between the wear rate $R'_w$ of said grinding wheel and the feed rate $F_w$ at which said grinding wheel is fed into said workpiece $$R'_w = kF_w^b$$

and controlling, setting or measuring the value of one of the variables $R'_w$ and $F_w$ in accordance with said power function relatively and in response to changes in the other said variables.

15. A method of determining the actual rate at which a workpiece is being ground by a grinding wheel while said grinding wheel is being fed relatively into said workpiece, said method comprising determining the relationship between the wear rate of said grinding wheel and the feed rate at which said grinding wheel is fed into said workpiece, feeding the grinding wheel into the workpiece at a controlled feed rate or rates, and determining the wheel wear rate corresponding to each feed rate, using said relationship, and subtracting each such wear rate from the corresponding feed rate to ascertain the actual grinding rate at each feed rate.

16. A method as set forth in claim 15 which includes the step of adjusting said feed rate to maintain a desired grinding rate.

17. A method of grinding a selected workpiece with a selected grinding wheel, said method comprising grinding the selected workpiece with the selected grinding wheel at a know feed rate $F_w$ and a known wheel wear rate $R'_w$, utilizing the known values of $F_w$ and $R'_w$ to determine the values of the coefficient k and the exponent b in the relation:

$$R'_w = kF_w^b$$

and utilizing the determined values of k and b to determine the wheel feed rate $F_{wd}$ required to achieve a desired grind rate GR.

18. A method as set forth in claim 17 which includes the step of grinding said workpiece with said grinding wheel while feeding the grinding wheel at said rate $F_{wd}$ to achieve the desired grind rate GR while compensating for wear.

19. A grinding method comprising grinding a selected workpiece with a selected grinding wheel at a known feed rate $F_w$ and a known wheel wear rate $R'_w$, utilizing the known values of $F_w$ and $R'_w$ to determine the values of the coefficient k and the exponent b in the relation:

$$R'_w = kF_w^b$$

utilizing the determined values of k and b to determine the wheel feed rate $F_{wd}$ required to achieve a desired grind rate GR, and grinding a similar workpiece with a similar grinding wheel while feeding the grinding wheel at said rate $F_{wd}$ to achieve the desired grind rate GR while compensating for wear.

20. A method of grinding a workpiece at a desired grind rate GR while simultaneously truing the grinding wheel, said method comprising determining the relationship between the wear rate $R'_{wg}$ of said grinding wheel and the feed rate $F_w$ at which said grinding wheel is fed into said workpiece, grinding said workpiece with said grinding wheel while simultaneously truing the grinding wheel with a truing element, determining the wheel wear rate $R'_{wg}$ (at the grinding interface) corresponding to the desired grind rate GR from the previously determined relationship between $R'_{wg}$ and $F_w$, and advancing the grinding wheel toward the workpiece at a controlled rate $F_{ws}$ which is approximately equal to the sum of the desired grinding rate GR, the corresponding wheel wear rate $R'_{wg}$ (at the grinding interface), and the rate $R'_{wt}$ of reduction in the wheel radius at the truing interface.

21. A method as set forth in claim 20 which includes the step of feeding a truing roll toward the grinding wheel, on the opposite side of said wheel from the workpiece, at a controlled rate $F_{ts}$ which is approximately equal to the sum of $R'_{wg}$, $R'_{te}$ and $R'_{wt}$, where $R'_{te}$ is the rate of reduction in the radius of the truing roll.

22. A method of grinding a selected workpiece with a selected grinding wheel, said method comprising computing the values of the coefficient k and the exponent b in the following power function relationship between the wear rate $R'_w$ of said grinding wheel and the feed rate $F_w$ at which said grinding wheel is fed into said workpiece $$R'_w = kF_w^b$$

controlling, setting or measuring the value of one of the variables $R'_w$ and $F_w$ in accordance with said power function relationship and in response to changes in the other said variables, and periodically re-computing the values of k and b during the grinding operation.

23. The method of claim 22 wherein the values of k and b are computed from actual values of $R'_w$ and $F_w$.

24. The method of claim 22 wherein the variable $F_w$ is controlled in accordance with said power function relationship and in response to changes in the actual value of $R'_w$.

25. A method of controlling a grinding operation in which a grinding wheel surface engages another surface at a rubbing interface, said method comprising determining the exact nature of a power function relationship between (a) the rate at which material is removed from one of the surfaces at the rubbing interface and (b) the feed rate at which the rubbing surfaces are fed into each other, and controlling, measuring or setting the material removal rate or the feed rate in such a grinding operation in accordance with said power function relationship.

26. A method of determining the relationship between the wear rate $R'_w$ of a grinding wheel and the feed rate $F_w$ at which said grinding wheel is fed into a workpiece, said method comprising feeding said grinding wheel relatively into said workpiece at a feed rate which is approximately equal to the desired grinding rate, measuring the actual grinding rate and the actual feeding displacement of the grinding wheel face, determining the actual wheel wear rate as the difference between said actual grinding rate and said actual feeding displacement, and computing the values of the coefficient k and the exponent b in the equation $$R'_w = kF_w^b$$

from said actual wheel wear rate and said actual feed rate.

27. A method of grinding the work surface of a workpiece with a rotationally driven grinding wheel, said method comprising determining the nature of a power function relationship between (a) the rate at which material is removed from the surface of said grinding wheel at the grinding interface with said workpiece and (b) the feed rate at which said grinding wheel and workpiece are fed relatively into each other, feeding the grinding wheel face relative to the work surface and with relative rubbing contact to create grinding action, simultaneously feeding the operative surface of a conditioning element relative to the wheel face and with relative rubbing contact to creat dressing/truing action which reduces the wheel radius at a rate greater than the reduction rate caused by the grinding action, while said simultaneous feeding procedures are taking place, determining the rate of reduction of the wheel radius caused by the grinding action alone, from the feeding rates and said power function relationship, and utilizing said reduction rate caused by grinding action alone to conjointly control the relative feed rate and surface velocity of said dressing/truing action to vary and maintain the condition of the wheel face.

* * * * *